US011475739B2

(12) United States Patent
Elias et al.

(10) Patent No.: US 11,475,739 B2
(45) **Date of Patent: *Oct. 18, 2022**

(54) BINGO GAME SERVERS AND CONTROLLERS PROVIDING BINGO GAME PLAY WITH CONCURRENT BINGO SYMBOL DRAW SEQUENCES

(71) Applicant: Gamesys Ltd., London (GB)

(72) Inventors: Hans Elias, Hertfordshire (GB); Thomas David James Aicken, London (GB); Adam Scott, Surrey (GB); David Richard Nulty, Oxford (GB)

(73) Assignee: Gamesys, Ltd.

( * ) Notice: Subject to any disclaimer, the term of this patent is extended or adjusted under 35 U.S.C. 154(b) by 20 days.

This patent is subject to a terminal disclaimer.

(21) Appl. No.: 17/069,245

(22) Filed: Oct. 13, 2020

(65) Prior Publication Data

US 2021/0035401 A1 Feb. 4, 2021

Related U.S. Application Data

(63) Continuation of application No. 16/279,931, filed on Feb. 19, 2019, now Pat. No. 10,803,707, which is a continuation-in-part of application No. 15/173,682, filed on Jun. 5, 2016, now Pat. No. 10,210,714, which is a continuation-in-part of application No. 15/149,356, filed on May 9, 2016, now Pat. No. 10,269,219.

(60) Provisional application No. 62/170,894, filed on Jun. 4, 2015, provisional application No. 62/161,384, filed on May 14, 2015.

(51) Int. Cl.
*G07F 17/32* (2006.01)

(52) U.S. Cl.
CPC ..... *G07F 17/329* (2013.01); *G07F 17/3211* (2013.01); *G07F 17/3225* (2013.01); *G07F 17/3209* (2013.01)

(58) Field of Classification Search
CPC ..... A63F 3/06; G07F 17/32; G07F 17/329
See application file for complete search history.

(56) References Cited

U.S. PATENT DOCUMENTS

| | | | |
|---|---|---|---|
| 4,856,787 | A | 8/1989 | Itkis |
| 8,506,384 | B2 | 8/2013 | Coleman |
| 8,991,827 | B2 | 3/2015 | Thomassian |
| 10,210,714 | B2 | 2/2019 | Elias |
| 10,269,219 | B2 | 4/2019 | Elias |
| 2005/0233798 | A1 | 10/2005 | Van Asdale |
| 2014/0274280 | A1 | 9/2014 | Macbeth |

OTHER PUBLICATIONS

Office Action for U.S. Appl. No. 15/173,682 dated Oct. 25, 2017; 6 pps.
Office Action for U.S. Appl. No. 15/173,682 dated Feb. 13, 2018; 12 pps.

(Continued)

*Primary Examiner* — Omkar A Deodhar
(74) *Attorney, Agent, or Firm* — RowanTree Law Group, PLLC; Carson C. K. Fincham

(57) ABSTRACT

Systems, methods, apparatus, and articles of manufacture provide for new features and functionality for bingo games, including bingo games providing for multiple bingo symbol pools, multiple bingo symbol draw sequences, and/or features involving daubed symbols drawn from different symbol pools.

12 Claims, 19 Drawing Sheets

(56) References Cited

OTHER PUBLICATIONS

Notice of Allowance for U.S. Appl. No. 15/173,682 dated Oct. 3, 2018; 19 pps.
Office Action for U.S. Appl. No. 15/149,356 dated Mar. 26, 2018; 9 pps.
Notice of Allowance for U.S. Appl. No. 15/149,356 dated Dec. 6, 2018; 7 pps.
Notice of Allowance for U.S. Appl. No. 16/279,931 dated Jun. 9, 2020; 7 pps.

BINGO GAME SERVERS AND CONTROLLERS PROVIDING BINGO GAME PLAY WITH CONCURRENT BINGO SYMBOL DRAW SEQUENCES

COPYRIGHT NOTICE

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

CROSS-REFERENCE TO RELATED APPLICATIONS

The present application is a continuation and claims the benefit of priority of U.S. patent application Ser. No. 16/279,931 filed Feb. 19, 2019, entitled "Bingo Game Servers and Controllers Providing Bingo Game Play with Concurrent Bingo Symbol Draw Sequences," which is incorporated by reference in its entirety in the present application.

U.S. patent application Ser. No. 16/279,931 is a continuation-in-part and claims the benefit of priority of U.S. patent application Ser. No. 15/173,682 filed Jun. 5, 2016, entitled "Bingo Game Servers and Controllers Providing Bingo Game Play with Concurrent Bingo Symbol Draw Sequences"; which claims the benefit of priority of U.S. Provisional Patent Application No. 62/170,894, filed Jun. 4, 2015, entitled "Bingo Game Servers and Controllers Providing Bingo Game Play with Concurrent Bingo Symbol Draw Sequences," which are incorporated by reference in their entirety in the present application.

U.S. patent application Ser. No. 16/279,931 is a continuation-in-part and claims the benefit of priority of U.S. patent application Ser. No. 15/149,356 filed May 9, 2016, entitled "Bingo Game System and Controller Providing a Temporary Daub Function"; which claims the benefit of priority of U.S. Provisional Patent Application No. 62/161,384 filed May 14, 2015, entitled "Bingo Game System and Controller Providing a Temporary Daub Function," which are incorporated by reference in their entirety in the present application.

TECHNICAL FIELD OF THE INVENTION

The present disclosure generally relates to online and/or networked gaming systems and methods, and more particularly to processing multiple random sequences and controlling remote online game interfaces for a plurality of players communicating with a server through a communication network.

BACKGROUND

Various types of standalone, networked, and online gaming systems and methods have been developed. However, despite a general desire to provide interesting games, present gaming devices and gaming systems do not provide for effective generation, processing, or presentation of multiple sequences of random game information.

BRIEF DESCRIPTION OF THE DRAWINGS

An understanding of embodiments described in this disclosure and many of the related advantages may be readily obtained by reference to the following detailed description when considered with the accompanying drawings, of which.

DETAILED DESCRIPTION

Figure 1:
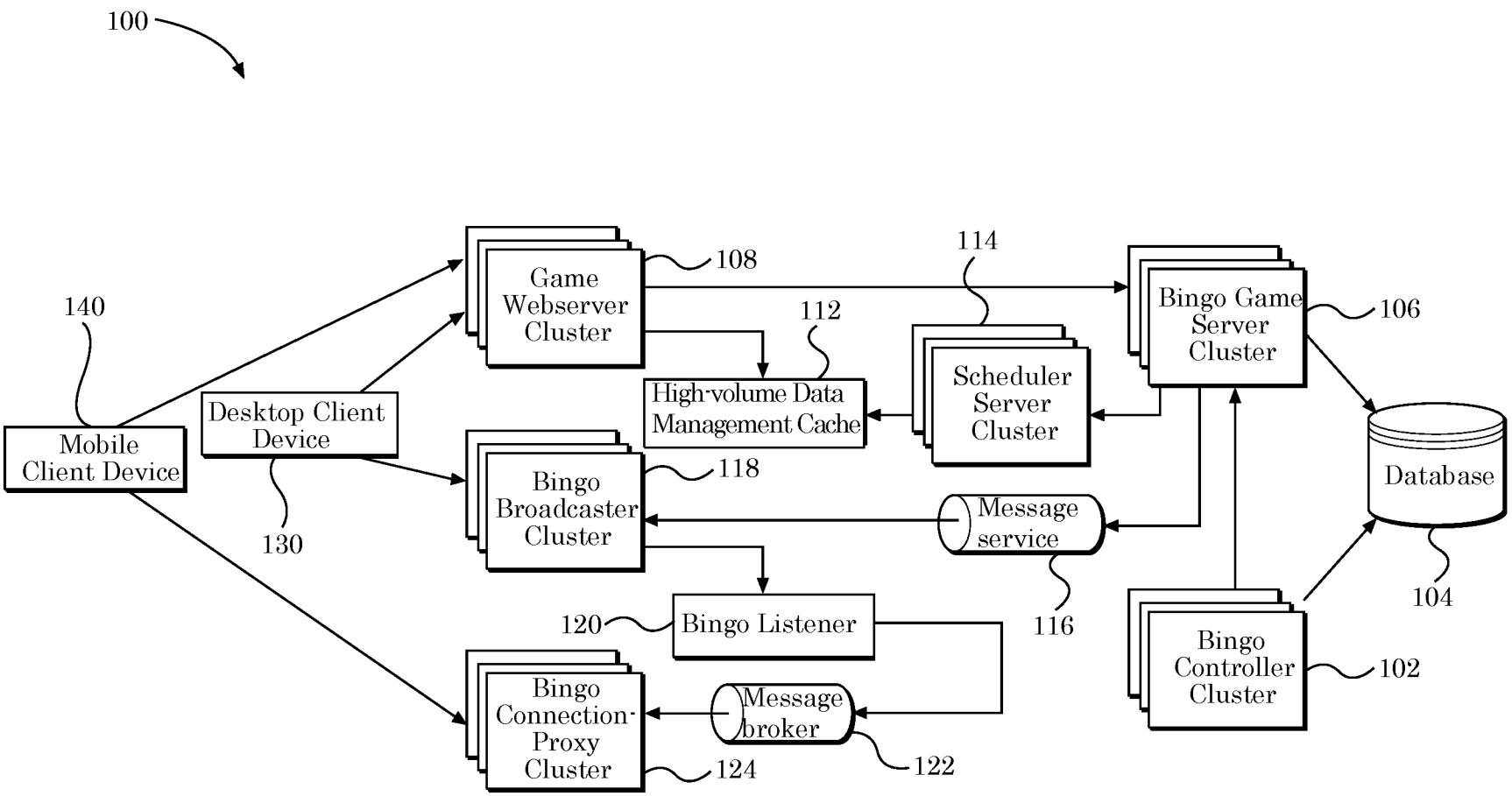
FIG. 1 is a block diagram of a bingo system according to one or more embodiments.

Some embodiments presented in this disclosure are descriptive of systems for providing bingo game play, comprising: (i) a bingo game server in communication with a player interface, a memory device, and/or a cloud-based cache; (ii) a bingo broadcaster in communication with the bingo game sever and the player interface; (iii) a bingo controller in communication with the bingo game server and with the memory device; and/or (iv) a game webserver in communication with the bingo game server (and/or with a cloud-based cache).

In some embodiments, a bingo game system may comprise a bingo broadcaster in communication with a bingo game sever and with a bingo listener (e.g., Java™-based message service component).

In accordance with some embodiments of the present invention an online gaming system for providing an online bingo game to a plurality of remote players comprises:

a) a plurality of gaming devices, each gaming device being configured with a display device, supported by a housing, for displaying an electronic gaming interface for a bingo game having a plurality of bingo game symbol sequences and at least one input device for receiving player input to daub a bingo space on the electronic gaming interface; and b) a bingo game server in communication with each of the plurality of gaming devices and configured to provide to the plurality of gaming devices the bingo game having a plurality of bingo game symbol sequences via the electronic gaming interface, the bingo game server being further configured to:

c) validate (e.g., in response to daub attempt messages received from gaming devices) attempts by players to daub bingo game spaces on the electronic gaming interface;

d) transmit ball calls to the plurality of gaming devices for the bingo game;

e) modify the electronic gaming interface (e.g., by transmitting a control signal to the gaming device) to control display of daubed game spaces on the electronic gaming interface;

f) modify the electronic gaming interface (e.g., by transmitting a control signal to the gaming device) to control generation of multiple daubs for the same bingo space on the electronic gaming interface (e.g., by applying a second game element indicative of a second daub on a previously daubed bingo game space);

g) determine wins by players of the bingo game (e.g., based on a first daub based on a first bingo game symbol draw sequence and a second daub based on a second bingo game symbol draw sequence); and h) provide awards to players, or transmit to the gaming device a signal indicating a win by a player (e.g., based daubs from multiple bingo symbol draw sequences) in the bingo game.

In accordance with some embodiments of the present invention, one or more systems, apparatus, methods, articles of manufacture, and/or computer readable media (e.g., a non-transitory computer readable memory storing instructions for directing a processor) provide for one or more of:

a) determining a first pool of bingo symbols for a bingo game session;

a) determining a first symbol draw sequence based on the first pool of bingo symbols;

b) determining a second pool of bingo game symbols for the bingo game session;

c) determining a second symbol draw sequence based on the second pool of bingo symbols;

d) daubing a first symbol from the first symbol draw sequence (e.g., marking a matching bingo space on a bingo ticket);

e) daubing a second symbol from the second symbol draw sequence (e.g., marking a matching bingo space on a bingo ticket); and/or f) determining a game outcome based on the daubed first symbol from the first symbol draw sequence and the daubed second symbol from the second symbol draw sequence.

In accordance with some embodiments of the present invention an online gaming system for providing an online bingo game to a plurality of remote players comprises:

a) a plurality of gaming devices, each gaming device being configured with a display device, supported by a housing, for displaying an electronic gaming interface for a bingo game having multiple bingo symbol draw sequences; and b) a bingo game server in communication with each of the plurality of gaming devices and configured to provide to the plurality of gaming devices the bingo game having multiple bingo symbol draw sequences via the electronic gaming interface, the bingo game server being further configured to:

display the electronic gaming interface at a gaming device, the electronic gaming interface comprising: (1) an interface object for receiving an indication from a player that the player has achieved a winning bingo pattern, (2) a bingo card area for the bingo game, the bingo card area including at least one bingo card comprising a plurality of bingo spaces for playing the bingo game, each bingo space being associated with a bingo game symbol; and (c) a called bingo game symbol history area for representing previously-called bingo game symbols;

call a first bingo game symbol for the bingo game from a first bingo game symbol draw sequence;

receive via the electronic gaming interface, a request by a player to daub a first bingo space associated with the first bingo game symbol;

validate the request to daub the first bingo space;

modify the electronic gaming interface to display a first daub applied to the first bingo space, wherein the displayed first daub is associated with the first bingo game symbol draw sequence;

modify the electronic gaming interface to represent the called first bingo game symbol in a first called bingo game symbol history area;

call a second bingo game symbol for the bingo game from a second bingo game symbol draw sequence;

receive, via the electronic gaming interface, a request by the player to daub a second bingo space associated with the second bingo game symbol;

validate the request to daub the second bingo space;

modify the electronic gaming interface to display a second daub applied to the second bingo space, wherein the displayed second daub is different from the displayed first daub;

modify the electronic gaming interface to represent the called second bingo game symbol in a second called bingo game symbol history area;

receive, via the interface object of the electronic gaming interface, an indication from the player that the player achieved a winning bingo pattern based on the first daub and the second daub;

validate the winning bingo pattern; and award a prize to the player based on the winning bingo pattern.

In accordance with some embodiments of the present invention an online gaming system for providing an online bingo game to a plurality of remote players comprises:

a) a plurality of gaming devices, each gaming device being configured with a display device, supported by a housing, for displaying an electronic gaming interface for a bingo game having multiple bingo symbol draw sequences; and b) a bingo game server in communication with each of the plurality of gaming devices and configured to provide to the plurality of gaming devices the bingo game having multiple bingo symbol draw sequences via the electronic gaming interface, the bingo game server being further configured to:

display the electronic gaming interface at a gaming device, the electronic gaming interface comprising: (1) an interface object for receiving an indication from a player that the player has achieved a winning bingo pattern, (2) a bingo card area for the bingo game, the bingo card area including at least one bingo card comprising a plurality of bingo spaces for playing the bingo game, each bingo space being associated with a bingo game symbol; and (c) a called bingo game symbol history area for representing previously-called bingo game symbols;

call a first bingo game symbol for the bingo game from a first bingo game symbol draw sequence;

receive via the electronic gaming interface, a request by a player to daub a bingo space associated with the first bingo game symbol;

validate the request to daub the bingo space;

modify the electronic gaming interface to display a first daub applied to the first bingo space, wherein the displayed first daub is associated with the first bingo game symbol draw sequence;

modify the electronic gaming interface to represent the called first bingo game symbol in a first called bingo game symbol history area;

call the bingo game symbol for the bingo game from a second bingo game symbol draw sequence;

receive, via the electronic gaming interface, a request by the player to daub the same bingo space;

validate the request to daub the same bingo space;

modify the electronic gaming interface to display a second daub (e.g., a combination daub) applied to the same bingo space, wherein the displayed daub indicates that the bingo space was daubed multiple times;

modify the electronic gaming interface to represent the called bingo game symbol in a second called bingo game symbol history area;

receive, via the interface object of the electronic gaming interface, an indication from the player that the player achieved a winning bingo pattern based on the daubed bingo space;

validate the winning bingo pattern; and award a prize to the player based on the winning bingo pattern.

In accordance with some embodiments of the present invention, one or more systems, apparatus, methods, articles of manufacture, and/or computer readable media (e.g., a non-transitory computer readable memory storing instructions for directing a processor) provide for one or more of:

a) calling a bingo game symbol for a bingo game, from one of a plurality of draw sequences for the bingo game;

b) receiving a daub request signal from a client device;

c) determining whether the requested daub is valid;

d) determining whether to apply a temporary daub to a bingo game space corresponding to the called bingo game symbol;

e) setting an expiration condition for the temporary daub; and/or f) applying the temporary daub to the bingo game space.

In accordance with some embodiments of the present invention, one or more systems, apparatus, methods, articles of manufacture, and/or computer readable media provide for one or more of:

a) assigning a temporary daub to a bingo game symbol;

b) applying a temporary daub to a bingo game space corresponding to the bingo game symbol;

c) determining an expiration condition for the temporary daub;

d) determining that the expiration condition is met; and/or e) removing the temporary daub from the bingo game space in response to determining that the expiration condition is met.

In accordance with some embodiments of the present invention, a bingo game system is provided, the bingo game system comprising:

a) a bingo game server in communication with a player interface and a memory device;

b) a bingo controller in communication with the bingo game server and with the memory device;

c) a game webserver in communication with the bingo game server;

d) a bingo broadcaster in communication with the bingo game sever; and e) the memory device storing bingo game instructions and player interface instructions which, when executed by the bingo game server, direct the bingo game server to:

f) assign a temporary daub to a bingo game symbol;

g) apply a temporary daub to a bingo game space corresponding to the bingo game symbol;

h) determine an expiration condition for the temporary daub;

i) determine that the expiration condition is met; and/or j) remove the temporary daub from the bingo game space in response to determining that the expiration condition is met.

In accordance with some embodiments, the bingo game system may further comprise a scheduler server in communication with the bingo game server and with the bingo broadcaster. In accordance with some embodiments, the bingo game system may comprise a cloud-based cache (e.g., a high-volume data management cache).

In accordance with some embodiments of the present invention, one or more systems, apparatus, methods, articles of manufacture, and/or computer readable media provide for one or more of:

a) calling a bingo game symbol for a bingo game, from one of a plurality of draw sequences for the bingo game;

b) applying a temporary daub for the called bingo game symbol to a bingo game space corresponding to the called bingo game symbol;

c) determining that an expiration condition for the temporary daub is not met;

d) determining that a winning bingo pattern is matched using the temporary daub; and/or e) applying a prize for the winning bingo pattern that includes the temporary daub.

The inventors have recognized that some types of game providers and players may find it beneficial to create additional anticipation, excitement, urgency, or volatility (or any combination thereof) in a bingo game system, by drawing bingo symbols from a plurality of sets (also referred to in this disclosure as "pools") of bingo symbols.

According to some embodiments, systems, methods, and apparatus are provided for play of a bingo game involving multiple, independently generated (or "drawn") sequences of bingo symbols (e.g., a first sequence of drawn bingo symbols and a second sequence of drawn bingo symbols). In some embodiments, each draw sequence is drawn independently (e.g., using a random number generator (RNG)) from a different set (or "pool") of bingo symbols. For example, the sets of bingo symbols from which the draw sequences are determined may differ with respect to the number of bingo symbols included in each set. In another example, the pools of bingo symbols may share at least one bingo symbol in common. In another example, one of the pools of bingo game symbols may have at least one bingo symbol that is not in the other set. In some embodiments, each independent draw sequence is drawn from an identical pool of bingo game symbols, but because each sequence is drawn independently (e.g., using an RNG), the draw sequences from the respective sets of bingo game symbols may (but do not necessarily) differ.

According to some embodiments, systems and methods are described that include a "multiple draw" or "multiple RNG" feature in which each of a plurality of draw sequences is determined independently for the same bingo game session. Some examples discussed in this disclosure for illustrative purposes may be referred to as "dual draw" or "dual RNG" games involving two independent draw sequences, but it will be readily understood that the inventive concepts are not intended to be limited solely to only two draw sequences. Some embodiments, for example, may involve any number of draw sequences (e.g., a "triple draw" feature, a "ten draw" feature, etc.) as deemed desirable for a particular implementation.

In some embodiments, multiple pools of bingo numbers are used for calling the bingo numbers in a given bingo game. In one example, during a bingo game, numbers may be drawn from any of two or more pools of bingo numbers.

In one or more embodiments, each bingo symbol pool has at least one symbol in it that is also in at least one other pool for the bingo game. In one example, bingo numbers may be drawn from a first bingo number pool or a second bingo number pool, and the first bingo number pool has at least one bingo number in common with the second bingo number pool (e.g., both bingo number pools include the numbers "5," "7," "15," and "75"). In one embodiment, each bingo symbol pool has at least one bingo symbol in it that is not also in another bingo symbol pool for the bingo game.

In accordance with some embodiments, an enhanced bingo game feature may be provided that allows multiple daubs to be applied to the same bingo space (e.g., a numbered space on a bingo card). In one or more embodiments, a bingo number may be drawn from a first bingo number pool, and daubed on a player's bingo card (e.g., automatically by the game and/or manually by the player). Subsequently, the same bingo number may be drawn from a second bingo number pool for the same bingo game, and daubed a second time on the player's bingo card.

The feature or act of daubing the same matching bingo symbol more than once in a bingo game may be referred to in this disclosure as "repeat daubing," "multiple daubing," or the like, and, with respect to particular examples, as "double daubing," "triple daubing," and so on, depending on the number of daubs made. A bingo symbol of a player that has received multiple daubs may be referred to as a "repeat daub," "multiple daubs," "double daub," or the like, depending on the number of daubs made.

According to some embodiments, a bingo game is provided in which a bingo space or player bingo symbol may be daubed based on a bingo symbol from a first bingo symbol pool, and then the same bingo space is affected by the drawing of the same bingo symbol (e.g., the same bingo number), in the same bingo game, from a second, different bingo symbol pool.

Some embodiments of this disclosure are descriptive of systems, apparatus, methods, and articles configured to provide for a bingo game including a temporary or expiring daub feature. In accordance with some embodiments, a daub of a matching bingo space (e.g., on a bingo ticket) may be only temporary. In one embodiment, a temporary daub may expire, disappear, be removed, be "undaubed," or otherwise be unavailable for completing a winning bingo pattern.

According to some embodiments, a temporary daub may expire after a certain number of ball calls in a bingo game. For example, a temporary daub may expire five ball calls after the temporary daub is made.

According to some embodiments, a temporary daub may be associated with a particular bingo symbol (e.g., with a particular ball call). For example, a specific called ball (e.g., "B6") may be associated with a temporary daub. For instance, if a "B6" ball is called, and that ball is associated with a temporary daub, if a player daubs "B6" on his bingo ticket, the daub will be a temporary daub.

According to some embodiments, a temporary daub may not be associated with a particular bingo symbol. For example, one or more temporary daubs, without a specific bingo symbol, may be called or otherwise available for play (e.g., a player may be permitted to make a predetermined number of temporary daubs). A player, for example, may use the unassociated temporary daub to temporarily daub one or more bingo spaces on a bingo ticket; however, in order to take advantage of the temporary daub(s), the player must complete a winning bingo pattern before the temporary daub(s) expire.

According to some embodiments, a bingo game including a temporary daub feature may include a win condition that requires at least one temporary daub and/or requires that a winning bingo pattern be completed with a daub that is not a temporary daub. For example, a player could daub a portion of a bingo pattern with a mix of temporary and persistent daubs, but in order to complete the winning bingo pattern, the final daub cannot be a temporary one. In accordance with some embodiments, it may be easier for a player to complete a win condition (e.g., using unspecified temporary daubs), as long as that win condition is completed with a permanent daub.

According to some embodiments, a bingo game including a temporary daub feature may also include a multiple daub feature, as discussed above. In particular, some types of new features and functionality of bingo games allow for the same bingo number or other symbol (e.g., on a bingo ticket) to be daubed more than once to create additional prize opportunities or other favorable game outcomes for a player. Accordingly, including a feature in which one or more types of daubs may be temporary (e.g., an initial daub of a given bingo space) provides for additional excitement where there may be a time limit in which the player must provide a second or other subsequent daub (e.g., to make a temporary daub permanent or persistent), in order to achieve a desired outcome (e.g., in order to earn a bonus prize, or unlock an enhanced symbol pool or other game function).

In some embodiments, the respective symbols called from each of a plurality of pools can interact in a single game or across independent games that also have a common element.

The following describes an example game environment for bingo game play involving multiple bingo symbol pools, multiple bingo symbol draws, repeat daubing, and examples combinations of the foregoing. According to one embodiment, multiple bingo symbol pools may be represented on a user interface with two ball call areas and two ball call histories. In one embodiment, each ball call area marks the bingo tickets with a different, respective dauber. According to the example game play, each bingo number pool contains the full list of numbers for the game, and the bingo numbers called from one bingo number pool are independent from the other bingo number pool. The following includes descriptions of some potential game enhancements available in the foregoing example bingo game play environment.

Double Daubing (and other Repeat Daubing)—According to some embodiments, every time a player marks a number that has already been marked (e.g., a double or triple daub), an event occurs. Potential events include one or more of:

a) An additional prize;
b) Activation of a feature (some examples of which are described in this disclosure);
c) Increase in the potential value of the line win associated with double daubed numbers;
d) Increment a count of the total number of double daubs earned during the game and/or increase a corresponding prize associated with the running total number of double daubs earned during the game;
e) Increase a "value" and/or potential prize associated with a repeatedly daubed number, based on the number of repeat daubs (e.g., prizes could be paid based upon the most daubed number on a line, and/or a total number of daubs on a line); and/or
f) "Knock Out" or Undaub—the second daub (e.g., from a second draw sequence, removes numbers daubed by first draw sequence).

Unique Prize Pools—Each individual pool of bingo symbols may have its own associated prize pool. In one example, a first, red daub pool is associated with 3 prizes and a second, blue daub pool is associated with 3 prizes. According to some embodiments, play of the bingo game continues until:

a) all the prizes are awarded;
b) one of the sets of prizes is awarded (either all the reds or all the blues); or
c) a particular number of prizes have been awarded (e.g., any combination of 3 prizes).

The feature of multiple, unique prize pools provides the advantage that even if a player has won the 1-line prize for a first symbol pool (e.g., the red daub pool) already, another player may still have the opportunity to win the 1-line prize of another symbol pool (e.g., the blue daub pool, or other color).

In some embodiments, a third prize pool could also be awarded (similar in some ways to double daubing, described above). In one example, a purple prize pool of higher value than the red or blue prize pools, may be provided. According to the example, the purple prize pool is awarded only if a player has marked all the required numbers for the win condition with both the red dauber and the blue dauber (i.e., each number of the winning bingo pattern must be double daubed). In one embodiment, a double daubed number (e.g., daubed with red and blue) no longer qualifies for the red or the blue prize conditions.

Combined Result—According to some embodiments, numbers drawn from a first and second pools may be combined in some way. In one example, two pools of number each include the numbers 0 to 9. A number is called from each pool, and the two numbers are combined to yield a two-digit number (e.g., a "3" drawn from one pool and a "2" drawn from the other pool are combined to yield "32"). In another example, each of two pools includes a full range of numbers for the bingo game (e.g., 1 to 90). The numbers are marked off individually when called, but a further evaluation pseudo-randomly generates a third number from the two individual numbers. For instance, "12" and "36" are called from the respective pools and marked off. After the corresponding spaces are daubed, the "1" digit from the "12" vanishes, and the "6" digit vanishes from the "36" to make "23," which is then marked off.

Extended/Split Ticket—According to some embodiments, a bingo game ticket is provided with dedicated spots for both first and second ball pools (e.g., a primary pool and a second pool). According to one embodiment, a winning bingo pattern may pay out if only one of the two dedicated portions of a winning line have been completed; an additional award may be paid if both dedicated areas of the winning line are completed. In some embodiments, a ticket may have a combination of generic positions and dedicated positions (e.g., for a specific pool or pools only) available for daubing.

Tiered pools—According to some embodiments, a bingo game includes at least two ball pools (e.g., gold, silver, and bronze). Numbers are drawn from only a first ball pool (e.g., a bronze pool) until a prize condition for the first pool has been met. If a first prize win condition is met, numbers are then drawn from a second pool (e.g., a silver pool). If a second prize win condition is met, numbers are then drawn from a third pool (e.g., a gold pool), and so on, according to the desired number of tiers. Some embodiments may provide for one or more of the following features:

a) The prize awarded is based on which pool the final ball came from that triggered the winning condition;
b) The prize awarded is based on the count of balls from each tier used to complete the win condition; and/or
c) The balls called from each tier overwrite one another.

According to one example of an overwriting feature, a player has "3," "8," "9," and "15" on a single line. The "3" and "8" are marked off by the bronze pool, and "9" by the silver pool. The game then draws gold "8" and the bronze daub for the "8" gets replaced by a gold daub. The player daubs "15" with a gold ball and wins the gold prize for completing the line ("8" and "15" have gold daubs).

According to some embodiments, calling from a second draw sequence may be limited to one or more particular players (e.g., a set of players). In one example, a player may be required to purchase at least a threshold number of bingo game tickets (e.g., a minimum of 6 tickets must be purchased in order to unlock a secondary ball pool). Alternatively, or in addition, a secondary pool may be unlocked for one, some, or all players during play of the bingo game. The following list provides examples, without limitation, of conditions that may be required in order for a player (or players) to be eligible to access a secondary ball pool:

a) When the first line win is paid out, all players with "1 to go" now get access to the secondary ball pool;
b) All players that have not won a prize at the point when full house is being played for are given access to the secondary ball pool;
c) The player that is furthest from winning gets access to the secondary ball pool; and/or
d) The player that is furthest ahead is provided draws from the secondary pool (e.g., that may detrimental to their progress, such as providing for undaubs).

In some embodiments, a second ball pool could be unique for each individual player or group of players. According to a team bingo game example, each team of players is associated with a unique secondary ball pool. An example advantage of unique secondary ball pools for is that the secondary ball pool could be customized for a player and/or team (e.g., a second unique ball pool contains only the numbers that the given player(s) have on their tickets).

According to some embodiments, as discussed above, a secondary ball pool may have a different subset of numbers in it, or at least one additional number in it that is not available in a primary pool. In one example, a secondary pool may contain one or more special numbers, such as combined numbers on a single ball (e.g., "5" and "8"). In this way, while all the numbers are represented in both pools, the secondary ball pool has them represented in forty-five balls with pairs of numbers, whereas the primary pool has all the numbers represented (in a conventional fashion) individually on ninety respective bingo balls.

According to another example of a partial secondary pool, a secondary ball pool may contain only the numbers required by those players (e.g., in the case where not all numbers are represented on the players' tickets). In another example, a secondary ball pool may contain one or more of the most frequent numbers represented on a player's ticket.

According to some embodiments, at least one of a plurality of pools of bingo symbols used in a bingo game may be generated and/or modified during the determination of the game outcomes (as opposed to at the beginning of game play). In one example, a primary pool may contain all numbers, and a secondary pool contains only numbers previously drawn from the primary pool. According to another example, both primary and secondary pools may contain the same numbers at the beginning of the game, but numbers called from the primary pool are removed as possible calls from the secondary ball pool.

Although some embodiments may be discussed in this disclosure, by means of example and for convenience of illustration only, in the context of particular examples of 75-ball bingo games, it will be readily understood that such embodiments may be adapted and/or implemented with respect to one or more other types of bingo games (e.g., 90-ball bingo, 80-ball bingo), as deemed desirable for a particular implementation. A bingo game in accordance with one or more embodiments described in this disclosure may be implemented, for example and without limitation, as an online game, offline game, wagering game, non-wagering game, and/or social network game.

Throughout this description, unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. While not generally limiting and while not limiting for all described embodiments, in some embodiments, the terms are specifically limited to the example definitions and/or examples provided. Other terms are defined throughout the present description.

A "game," as the term is used in this disclosure (unless specified otherwise), may generally comprise any game (e.g., wagering or non-wagering, electronically playable over a network) playable by one or more players in accordance with specified rules. A game may be playable on a personal computer (PC) online in web browsers, on a game console and/or on a mobile device such as a smart-phone or tablet computer. "Gaming" thus generally refers to play of a game.

A "casual game," as the term is utilized in this disclosure (unless otherwise specified), may generally comprise a game with simple rules with little or no time commitment on the time of a player to play. A casual game may feature, for example, very simple game play such as a puzzle or Scrabble™ game, may allow for short bursts of play (e.g., during work breaks), an ability to quickly reach a final stage and/or continuous play without a need to save the game.

A "social network game," as used in this disclosure (unless specified otherwise), generally refers to (and in specific embodiments may be expressly limited to) a type of online game that is played through a social network, and in some embodiments may feature multiplayer and asynchronous game play mechanics. A "social network" may refer to an online service, online community, platform, or site that focuses on facilitating the building of social networks or social relations among people. A social network service may, for example, consist of a representation of each user (often a profile), his/her social links, and a variety of additional services. A social network may be web-based and provide means for users to interact over the Internet, such as e-mail and instant messaging. A social network game may in some embodiments be implemented as a browser game, but may also be implemented on other platforms such as mobile devices.

A "wagering game," as the term is used in this disclosure (unless specified otherwise), may generally comprise (and in specific embodiments may be expressly limited to) a game on which a player can risk a wager or other consideration, such as, but not limited to: slot games, poker games, blackjack, baccarat, craps, roulette, lottery, bingo, keno, casino war, etc. A wager may comprise a monetary wager in the form of an amount of currency or any other tangible or intangible article having some value which may be risked on an outcome of a wagering game. "Gambling" or "wagering" generally refers to play of a wagering game.

The term "game provider," as used in this disclosure (unless specified otherwise), generally refers to (and in specific embodiments may be expressly limited to) an entity or system of components which provides games for play and facilitates play of such game by use of a network such as the Internet or a proprietary or closed networks (e.g., an intranet or wide area network). For example, a game provider may operate a website which provides games in a digital format over the Internet. In some embodiments in which a game comprising a wagering game is provided, a game provider may operate a gambling website over which wagers are accepted and results of wagering games are provided.

As utilized in this disclosure, the term "player" may generally refer to (and in specific embodiments may be expressly limited to) any type, quantity, and or manner of entity associated with the play of a game. In some embodiments, a player may comprise an entity conducting play of an online game, for example, may comprise an entity that desires to play a game (e.g., an entity registered and/or scheduled to play and/or an entity having expressed interest in the play of the game—e.g., a spectator) and/or may comprise an entity that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game). In some embodiments, a player may comprise an individual (or group) that enters, joins, logs into, registers for, and/or otherwise access an online game room, session, server, and/or other particular instance and/or segmentation of an online game.

Some embodiments described in this disclosure are associated with a "player device" or a "network device." As used in this disclosure, a "player device" is a subset of a "network device." The "network device," for example, may generally refer to any device that can communicate via a network, while the "player device" may comprise a network device that is owned and/or operated by or otherwise associated with a player. Examples of player and/or network devices may include, but are not limited to: a PC, a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

As used in this disclosure, the term "network component" may refer to a player or network device, or a component, piece, portion, or combination of player or network devices. Examples of network components may include a static random access memory (SRAM) device or module, a network processor, and a network communication path, connection, port, or cable.

In addition, some embodiments are associated with a "network" or a "communication network." As used in this disclosure, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration or type. Communication networks may include, for example, devices that communicate directly or indirectly, via a wired or wireless medium such as the Internet, intranet, a local area network (LAN), a wide area network (WAN), a cellular telephone network, a Bluetooth® network, a near-field communication (NFC) network, a radio frequency (RF) network, a virtual private network (VPN), Ethernet (or IEEE 802.3), token ring, or via any appropriate communications means or combination of communications means. Exemplary protocols include but are not limited to: Bluetooth™, time division multiple access (TDMA), code division multiple access (CDMA), global system for mobile communications (GSM), enhanced data rates for GSM evolution (EDGE), general packet radio service (GPRS), wideband CDMA (WCDMA), advanced mobile phone system (AMPS), digital AMPS (D-AMPS), IEEE 802.11 (WI-FI), IEEE 802.3, SAP, the best of breed (BOB), and/or system to system (S2S).

As used in this disclosure, the terms "information" and "data" may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard. Information may, according to some embodiments, be compressed, encoded, encrypted, and/or otherwise packaged or manipulated in accordance with any information processing method.

The term "indication," as used in this disclosure (unless specified otherwise), may generally refer to any indicia and/or other information indicative of or associated with a subject, item, entity, and/or other object and/or idea. As used in this disclosure, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

A "session", as the term is used in this disclosure (unless indicated otherwise), may generally comprise (and in specific embodiments may be expressly limited to) a period of time spanning a plurality of event instances or turns of the game, the session having a defined start and defined end. An event instance or turn is triggered upon an initiation of, or request for, at least one result of the game by a player, such as an actuation of a "start" or "spin" mechanism, which initiation causes an outcome to be determined or generated (e.g., a random number generator is contacted or communicated with to identify, generate or determine a random number to be used to determine a result for the event instance).

As used in this disclosure, the terms "outcome" and "result" should be differentiated in the present description in that an "outcome" is generally a representation of a "result," typically comprising one or more game elements or game symbols. For example, in a "fruit themed" game, a winning outcome (i.e., an outcome corresponding to some kind of award, prize or payout) may comprise a combination of three "cherry" symbols. The "result" of this outcome may be a payout of X credits awarded to the player associated with the game. In another example, in a game in which a character moves along a game interface from a starting position to a finish position, an "outcome" of the game may comprise a symbol representing one or more movements along the interface and the "result" corresponding to this outcome may be the particular number and direction of the character's movement (e.g., three (3) spaces backwards such that the character ends up further away from the finish line). In a session embodiment, a session result may comprise a binary result (e.g., a player or game character wins or loses the session) and/or the particular award (or magnitude of award) won or earned by the player based on the session (e.g., the number of credits awarded to the player). It should be noted that the embodiments described in this disclosure encompass awards, prizes, and payouts which are monetary, non-monetary, tangible, or intangible.

As used in this disclosure, the term "virtual currency" may generally refer to an in-game currency that may be used as part of a game or one or more games provided by a game provider as (i) currency for making wagers, and/or (ii) to purchase or access various in-game items, features, or powers.

A "credit balance", as the term is used in this disclosure (unless indicated otherwise), may generally refer to (i) a balance of currency, whether virtual currency and/or real currency, usable for making wagers in a game and/or (ii) another tracking mechanism for tracking a player's success or advancement in a game by deducting there from points or value for unsuccessful attempts at advancement and adding thereto points or value for successful attempts at advancement.

Some embodiments are descriptive of an "array" or "matrix" of symbols or game outcomes. As utilized in this disclosure, the terms "array" and "matrix" generally refer to a group of symbols, numbers, and/or expressions arranged in a plurality of rows and columns (or that can be readily and appropriately represented mathematically as being so arranged). In some embodiments, the term "array" is utilized to refer to a multi-dimensional matrix or combination of matrices while the term "matrix" is utilized to refer to a two-dimensional set of symbols or numbers (e.g., bingo tickets, slot reel symbols, and/or mathematical representations thereof). According to some embodiments, such as in the case that an array and/or matrix is populated with graphical game symbols, the array or matrix may be output and/or displayed (e.g., transmit to and/or rendered on a player device) as part of a game session.

Some embodiments of this disclosure relate to bingo games and/or computer software applications for providing bingo games. Some embodiments of this disclosure relate to gaming networks for providing bingo games, including social network games, single player games and/or multi-player games.

According to some embodiments, a bingo game is provided in which a player uses one or more cards (or tickets, or other type of physical or electronic game play area or game space) that include symbols (e.g., alphanumeric characters and/or other types of identifiers) assigned to respective spaces or other designated areas on the card. One or more symbols are drawn, selected, or otherwise determined from a set of symbols available for the bingo game, and, in accordance with some embodiments, the drawn symbols are compared to the symbols designated on the card to see if there are any matches. It will be readily understood that a set of symbols for a bingo game may include any range of numbers, multiple ranges of numbers, a non-sequential range of numbers, alphanumeric characters, non-numeric symbols, letters, punctuation marks, and/or any other representation of information.

According to some embodiments, for a given bingo game, the distribution of bingo symbols across cards, and/or the distribution of the tickets across players, may be in accordance with one or more distribution algorithms and/or at random. In some embodiments, a bingo system generates all possible combinations of available bingo symbols as cards, and distributes all of the possible cards before distributing any repeat cards.

According to some embodiments, if marked (or "daubed") spaces on a card form one or more previously designated arrangements (a "bingo pattern" or "winning pattern"), the card may be deemed a winning card and/or the player may be eligible for a prize. In one example, a player may win a prize by calling "Bingo" for a card with a winning pattern (e.g., by clicking a "Bingo" button or other interface object of a game interface to indicate the player thinks his electronic bingo card includes a winning bingo pattern). "Daubed" or "marked" will be used synonymously in this disclosure to refer to spaces, symbols, numbers, etc., on a card that have been marked, covered, stamped, daubed, highlighted, or otherwise identified physically, visually, and/or graphically, as potentially contributing to a winning pattern (e.g., alone or in combination with one or more other marked spaces). In some embodiments, spaces are daubed (e.g., automatically by a gaming device and/or manually by a player) if they match symbols drawn for a bingo game. Alternatively, or in addition, one or more spaces may be daubed without requiring that the space match a drawn symbol (a "free" daub or mark). For example, a card may have one or more free daubs automatically prior to the start of play (e.g., the center square of a 5×5 grid may be pre-marked with a free daub) and/or anytime during play (e.g., by receiving a free random daub in accordance with a game rule).

According to one embodiment, a card includes spaces arranged in columns and rows (e.g., a 5×5 grid of spaces, a 3×4 array of ticket lines), each having a designated number (e.g., selected from a set of bingo numbers 1-75) represented in a respective space on the card.

According to one embodiment, the card may include one or more types of location identifiers. Location identifiers may include, without limitation, one or more column identifiers, row identifiers, and/or other types of identifiers that uniquely identify a particular grid space, row, column, area, or other portion of a bingo card. For example, each column of a 5×5 bingo card may be identified respectively as "B,"

According to some embodiments, each symbol for a bingo game may be associated with one or more respective location identifiers. In one embodiment, certain symbols may be designated only in certain areas of a game card. For example, the "B" column of a 5×5 card may only include numbers selected in the range of 1-15. In another example, the first column of a 90-ball bingo game ticket may only include numbers selected in the range of 1-10, the second column may only include numbers selected in the range of 11-20, and so on. Accordingly, in some embodiments, a given bingo symbol may be associated with both a number (or a shape, color, or other type of symbol identifier that distinguishes it from other symbols) and location information (e.g., a column identifier, row identifier, and/or other type of location identifier) including information about where the symbol may appear on the card. In one example, a bingo ball may be associated with the number "3" and with a "B," indicating that if it appears on a card it would appear in a designated "B" column of spaces.

According to some embodiments, symbols may be represented (e.g., physically or electronically via a user interface) as numbered balls. Drawn numbers themselves may be referred to in this disclosure as "balls" for illustrative purposes and without limitation. As used in this disclosure, a "symbol draw" or "ball draw" may be used to refer to a process for selecting or otherwise determining (e.g., at random) numbers or other types of symbols drawn for use in comparing to symbols on a card for a bingo game. "Drawn balls" and "drawn numbers" may be used for convenience to refer to symbols selected in a symbol draw, and it will be understood that such terms are not limited to balls or numbers, but encompass any type of symbols drawn for a bingo game. Those of skill in the art will realize that the symbols used in an electronic bingo game may be displayed in any convenient fashion as deemed appropriate for a particular implementation, and that a simulated ball draw is merely one example. The number of balls drawn and the timing of ball draws may vary according to the desired type of bingo game.

According to some embodiments, a bingo game is played until at least one predetermined winning pattern is established on a bingo card. In some embodiments, determining whether a winning pattern is marked properly on a card may comprise determining whether each marked space may be compared to a set of drawn symbols to verify that it is a valid mark and therefore may qualify for or contribute to a winning pattern. In another example, determining if a marked pattern is a winning pattern may comprise determining whether any marked spaces are valid free daubs. According to some embodiments, a bingo game is played until a predetermined number of winning patterns are achieved (e.g., by one or more players) and/or until a time limit expires.

According to some embodiments, a player must identify any matches between drawn numbers and numbers designated on the player's card(s), the player must take action to daub spaces on the card (e.g., via a user interface) in order to form potential winning patterns, and/or the player must take action to declare a card has one or more winning patterns (e.g., by clicking a "Bingo" button). In one embodiment, one or more daubed spaces may be undaubed by a player and/or bingo game program. In one example, a player may undaub a space that the player mistakenly daubed. In some embodiments, one or more matching numbers may be daubed automatically and/or one or more winning patterns of marked spaces may be identified automatically (e.g., electronically by gaming device in accordance with instructions of a computer software program). Some embodiments may provide for automatic daubing of one or more spaces (e.g., for initial free daubs and/or random free daubs during play) and for manual daubing by the player of one or more spaces (e.g., in response to matching drawn numbers).

A. Systems

Referring now to FIG. 1, a block diagram of a bingo game system 100 according to some embodiments is shown. In some embodiments, the bingo game system 100 may comprise a bingo gaming platform such as a bingo game platform via which social, multiplayer, and/or online bingo games may be played (e.g., one or more bingo games as described in this disclosure, among others). In some embodiments, the bingo game system 100 may comprise a plurality of client or player devices, such as, for example, a mobile client device 140 and/or a desktop client device 130. Players, for example, may use these player devices to access bingo play via the bingo game system 100. For example, the mobile client device 140 may communicate with a game webserver cluster 108 and a bingo connection proxy cluster 124. In another example, the desktop client device 140 may communicate with a game webserver cluster 108 and a bingo broadcaster cluster 118. It will be readily understood that although when describing some embodiments reference may be made to a "cluster" of devices, embodiments of the present invention are not limited to only a plurality of such devices. Some embodiments may comprise only one of any given type of device.

In some embodiments, the game webserver cluster 108 may act as an interface between a plurality of players and at least one bingo server. In one or more embodiments, the game webserver cluster 108 provides log in functionality, website navigation, game lobby functionality, and/or game user interface (UI) assets. In one embodiment, the game webserver cluster 108 receives a player request to purchase one or more bingo games, and passes such purchase requests to a bingo game server (e.g., of bingo game server cluster 106).

In some embodiments, to aid with speed and responsiveness and the ability to scale as use fluctuates, even with respect to large amounts of data and/or a high volume of data requests, data collected by the game webserver cluster 108 may be cached using a high-volume data management cache 112 (e.g., BigMemory™ in-memory, data management service by Terracotta).

In one or more embodiments, the game webserver cluster 108 may communicate with the bingo game server cluster 106, comprising one or more specialized bingo game servers. A bingo game server of bingo game server cluster 106, in accordance with one embodiment of the present invention, may store logic enabling the purchase of bingo games and/or the management of bingo game play. A specialized bingo game server in accordance with some embodiments of the present invention may, for example, be specially configured to provide for one or more of:

a) receiving a message (e.g., from a client device) that indicates, detecting, or otherwise determining, that at least one bingo space has been daubed (e.g., on a bingo space);

b) identifying, detecting, or otherwise determining whether more than one RNG is associated with (and/or to be associated with) the same bingo ball and/or with a bingo space;

c) selecting or otherwise determining a number of RNGs to provide in a bingo game session;

d) selecting or otherwise determining a number of bingo game symbol draw sequences to use in a bingo game session;

e) selecting, identifying, or otherwise determining a number of bingo game symbols to draw from each of a plurality of draw sequences in a bingo game session;

f) generating or otherwise determining a respective first graphical representation of game symbols drawn from a first bingo game symbol draw sequence, and a respective second graphical representation of game symbols drawn from a second bingo game symbol draw sequence (e.g., bingo balls from a first ball queue are displayed as red, and bingo balls from a second ball queue are displayed as blue);

g) identifying, accessing, or otherwise determining and/or generating a respective first graphical representation of a bingo game space daubed in accordance with a bingo game;

h) generating or otherwise determining a respective first graphical representation of a bingo game space daubed in accordance with a game symbol drawn from a first bingo game symbol draw sequence (e.g., bingo balls from a first ball queue are daubed with an orange daub, and bingo balls from a second ball queue are daubed with a green daub);

i) generating, transmitting, and/or modifying a representation of a bingo game space to indicate bingo game space has been double daubed; and/or j) identifying, detecting, or otherwise determining whether a bingo game pattern achieved during play of a bingo game satisfies a winning bingo pattern for the bingo game (e.g., in which the winning bingo pattern requires at least one double daub)

In addition to one or more of the specialized features described above, a bingo game server may be configured to generate one or more bingo number calls, to generate one or more (conventional) player ticket numbers, to determine one or more winners of a bingo game, and/or to determine a distribution of prizes. Other examples of processes that may be performed by a bingo game server of bingo game server cluster 106 (directly or indirectly) may include, but are not limited to: (i) determining a set of available numbers and/or other types of bingo symbols for a bingo game; (ii) conducting a symbol draw or otherwise determining or selecting (e.g., at random) which symbols, of a plurality of bingo symbols available (e.g., depending on the type of bingo game), are drawn for a particular round of a bingo game; (iii) transmitting an indication of at least one drawn symbol to a player device; (iv) determining one or more drawn symbols that are in play for a bingo game (e.g., that previously may have been visible and/or queued but not yet available for play); (v) transmitting an indication of at least one drawn and queued symbol to a player device; (vi) determining and/or transmitting (e.g., to a player device) one or more cards, tickets, or other type of bingo game space for a bingo game; (vii) determining one or more players of a bingo game; (viii) determining and/or establishing at least one winning pattern for a bingo game; (ix) determining at least one bingo card having at least one valid winning pattern (e.g., of daubed spaces); (x) determining an outcome of a bingo game; (xi) transmitting an indication of an outcome of a bingo game to a player device; (xii) determining one or more drawn symbols that are queued to be enabled for play in a bingo game (e.g., but are not yet available for play); (xiii) determining one or more drawn symbols for which respective visual representations are (or are to be) made visible to one or more players; (xiv) authorizing a game program to be downloaded to a player device; and/or (xv) modifying (and/or directing a player device to modify) a game interface (e.g., to provide for electronic gaming).

According to some embodiments, a bingo game server of bingo game server cluster 106 may store game data in a database 104, and may transmit game data to a bingo broadcaster cluster 118 via message service 116. In some embodiments, message service 116 may comprise a scalable, asynchronous message service such as a Java™ message service (JMS) (e.g., JBoss® A-MQ by Red Hat or ActiveMQ™ by Apache).

The database 104 may store, for example, game data (e.g., processed and/or defined by a specially-programmed bingo game server of bingo game server cluster 106), data associated with players (e.g., players interacting with the bingo game servers via a mobile client device 140 and/or a desktop client device 130), and/or specialized instructions that cause various devices (e.g., of the bingo game server 106, scheduler server cluster 114, game webserver cluster 108, bingo broadcaster cluster 118, bingo controller cluster 102, bingo connection proxy cluster 124, the devices 130, and/or the devices 140) to operate in accordance with embodiments described in this disclosure.

A bingo game server in accordance with some embodiments of the present invention and/or one or more of the devices 130, 140, stores and/or has access to data useful for facilitating play of a bingo game. For example, a bingo game server and/or the mobile client device 140 may store (i) one or more probability databases for determining one or more outcome(s) for a game, (ii) a current state or status of a game or game session, (iii) one or more user interfaces for use in a game, (iv) one or more game themes for a game and/or (v) profiles or other personal information associated with a player of a game. It should be noted that in some embodiments such data may be stored on the bingo game server and information based on such data may be output to a player's device during play of a game, while in other embodiments a game program may be downloaded to a local memory of a player's device and thus such data may be stored on a player's device (e.g., in encrypted or other secure or tamper-resistant form).

According to some embodiments, any or all of the components of example bingo game system 100 may conduct (in whole or in part), facilitate, and/or otherwise be associated with execution of one or more stored procedures, applications, processes, and/or methods described in this disclosure.

According to some embodiments, a bingo player may, for example, connect to the bingo broadcaster cluster 118 via a desktop client device to acquire bingo game data and play a bingo game. In one or more embodiments, the bingo broadcaster cluster 118 sends information, such as number calls (e.g., determined by and received from a bingo game server) and/or winner information, to the bingo game player (e.g., via a browser application or game application at a client device) in a manner that provides for an enjoyable game play experience.

In some embodiments, the bingo broadcaster cluster 118 may also provide game data to users of mobile devices (e.g., mobile device client 140). In one embodiment, a bingo broadcaster may communicate game data to the mobile device client 140 by forwarding the game data first to a bingo listener 120, such as a Java™-based messaging component, which then forwards the information to a message broker 122 (e.g., an ActiveMQ™ channel) and then to a bingo connection proxy cluster 124 in communication with a client mobile device 140.

The bingo game server cluster 106 may also, in accordance with some embodiments, manage requests to purchase bingo game tickets and award prizes to bingo game winners. A bingo controller cluster 102 according to some embodiments of the present invention may be specially programmed to communicate with the bingo game server cluster 106 to provide scheduling information to create and schedule bingo games, providing information such as the start and end times for multiple games, in succession, simultaneously, or both. For example, the bingo controller cluster 102 may communicate with the database 104 to read stored schedules for games. The bingo controller cluster 102 may, in some embodiments, create new bingo games based on a stored schedule for a predetermined time period (e.g., a 24-hour time frame). According to one embodiment, once new bingo games are created, the bingo game server cluster 106 may then be informed (e.g., by a bingo controller) as to what games are available, and can sell these bingo games at appropriate times (e.g., in accordance with a schedule), as indicated by the bingo controller cluster 102.

In one or more embodiments of the present invention, a bingo game may provide a bonus game at the end of bingo play. The bonus game may not be considered part of the initial bingo game, so in some embodiments, a scheduler server cluster 114 may be used by the bingo game system 100 to set a schedule, or otherwise alter the existing bingo game schedules, to allow time for bonus game play. This schedule server cluster 114 may, in some embodiments, communicate with the bingo game server cluster 106. In one or more embodiments, information from the schedule server cluster 114 may be cached in the high-volume data management cache 112.

Accordingly, Applicants have provided for specialized bingo game servers, controllers, and systems providing for advantages of scalability and accommodating communication with a variety of types of client devices, and, in accordance with some embodiments, further configured to provide for the specialized functions of one or more types of bingo games, including the management of game elements such as multiple pools of bingo game symbols and/or multiple bingo game symbol draw sequences, at a plurality of client devices.

According to some embodiments, a bingo game server may comprise a computing device for facilitating play of a bingo game (e.g., by receiving an input from a player, determining an outcome for a bingo game, causing an outcome of a bingo game to be displayed on a player device, facilitating a wager and/or a provision of a payout for a bingo game). For example, the bingo game server may comprise a server computer operated by a bingo game provider or another entity (e.g., a social network website). In some embodiments, the game server may determine an outcome for a first aspect and/or second aspect of a bingo game by requesting and receiving such an outcome from another remote server operable to provide such outcomes. In some embodiments, the bingo game server may further be operable to facilitate a bingo game program for a bingo game (e.g., a wagering game). In accordance with some embodiments, in addition to administering or facilitating play of a bingo game, a bingo game server may comprise one or more computing devices responsible for handling online processes such as, but not limited to: serving a website comprising one or more games to a player device and/or processing transactions (e.g., wagers, deposits into financial accounts, managing accounts, controlling games, etc.). In some embodiments, a bingo game server may comprise two or more server computers operated by the same entity (e.g., one server being primarily for storing states of games in progress and another server being primarily for storing mechanisms for determining outcomes of games, such as a random number generator).

In accordance with some embodiments, a player's device 130 and/or device 140 may be used to play a wagering or non-wagering bingo game over a network and to output information relating to the game to the player participating in the game (e.g., outcomes for a round of a bingo game, prize values associated with bingo tickets, an indication of bingo game symbol calls from a plurality of bingo game symbol draw sequences and/or RNGs, an indication of one or more temporary daubs, balance of credits available for play of the game, amount of time or bingo game symbol calls remaining in the game, etc.). Any and all information relevant to any of the aforementioned functions may be stored locally on one or more of a player's devices and/or may be accessed using one or more of the player's devices. In one embodiment, such information may be stored on, or provided via, a bingo game server). In another embodiment, a player's device may store some or all of the program instructions for providing one or more of the functions described with respect to a bingo game server (e.g., in a downloadable software application). In some embodiments, a bingo game server may be operable to authorize the one or more of the player's devices to access such information and/or program instructions remotely via a network and/or download from the bingo game server (e.g., directly or via an intermediary server such as a game webserver) some or all of the program code for executing one or more of the various functions described in this disclosure. In other embodiments, outcome and result determinations may be carried out by a bingo game server (or another server with which the bingo game server communicates) and a player's devices may be terminals for displaying to an associated player such outcomes and results and other graphics and data related to a bingo game.

Figure 2A:
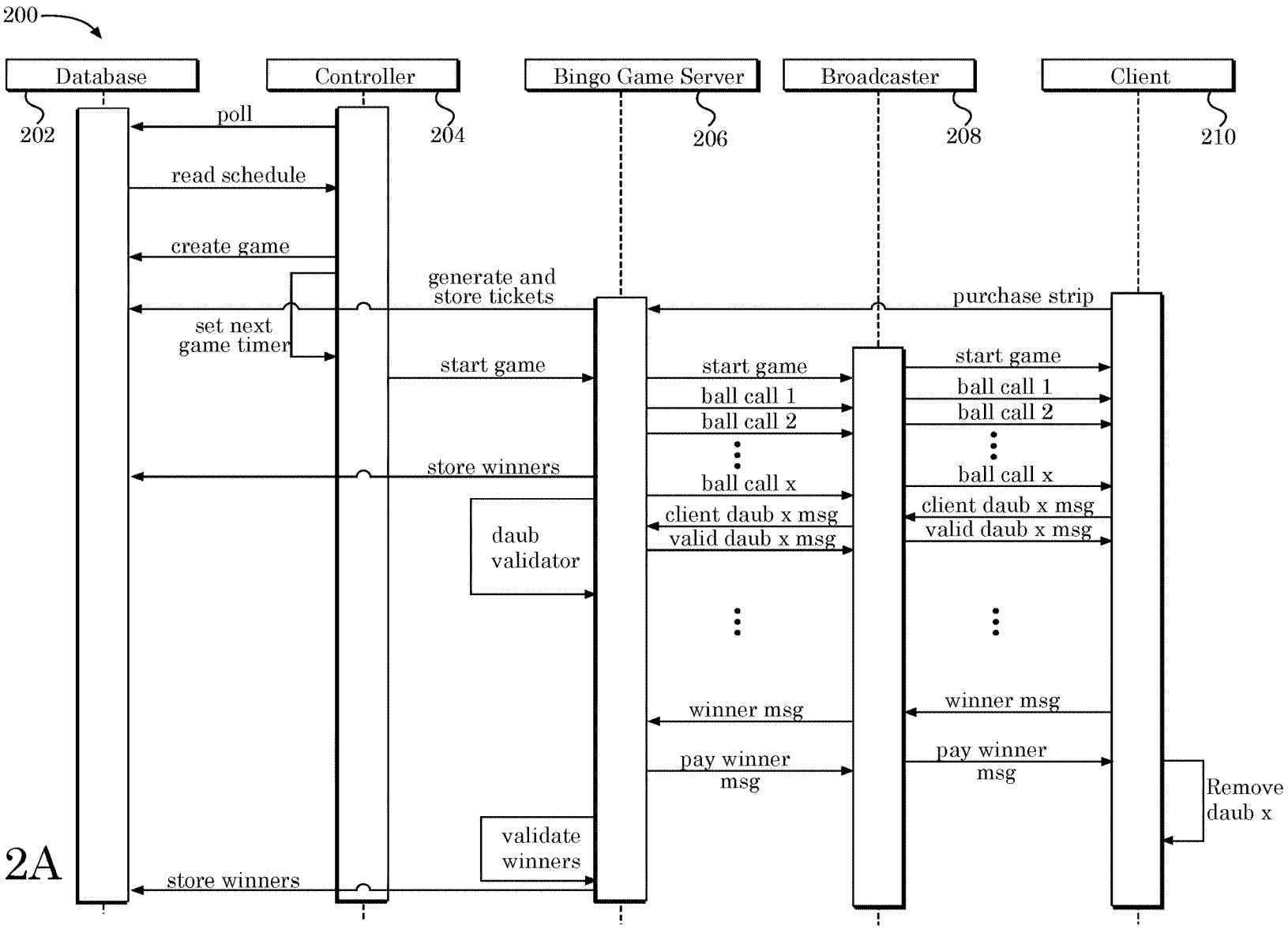
FIG. 2A is a block diagram of a bingo system according to one or more embodiments.

Referring now to FIG. 2A, a block diagram of a bingo game system 200 according to some embodiments is shown. The bingo game system 200, in accordance with some embodiments of the present invention, may comprise a database 202, a controller 204, a bingo game server 206, a broadcaster 208, and a client device 210. In particular, the example bingo game system 200 provides for bingo game play in which a player (e.g., at client device 210) may interact with and may affect play of a bingo game (e.g., via a bingo game interface at client device 210). In one example, a player may be able to daub bingo game spaces (e.g., by clicking on bingo game spaces corresponding to called bingo game symbols) and/or may be able to call "Bingo" (e.g., by clicking a "Bingo" button) or otherwise indicate that the player believes he has achieved a winning pattern on a bingo game board.

As depicted in FIG. 2A, a client device 210 of a player may initiate (e.g., via a gaming website) a purchase of a strip of one or more bingo game tickets from a bingo game server 206. The bingo game server 206 may then generate and store tickets for the player on a database 202.

In some embodiments, as depicted in bingo game system 200, the database 202 may be in communication with a controller 204. The controller 204 may, for example, poll the database 202 for a gaming schedule stored in the database, and read a schedule provided by the controller 204. Based on this information, the controller 204 may then create a game which may, in turn, be stored by the database 202.

In one or more embodiments, a player's gaming experience may or may not be affected by game data which may include, for example, the player's game play history (e.g., stored in the database 202). For example, the database 202 may store information concerning game winners, and may send this information to the bingo game server 206, which may then use this data to affect the game in one or more ways described in this specification.

The bingo game server 206, in some examples, may send game data to the broadcaster 208 to control what is broadcast to the client device 210 (e.g., based on how the bingo game server 206 may have configured the game). In one example, the bingo game server 206 may forward information to the broadcaster 208 about a sequence of bingo game symbols to be called in a bingo game. In some embodiments, the bingo game server 206 affects game data based on data stored in the database 202.

In one or more embodiments, once a game is created, the controller 204 may set a timer to determine when the next game should begin. Once the game is scheduled to begin, the controller 204 may, in some examples, communicate with the bingo game server 206 to begin game play. The bingo game server 206 then preferably communicates with the broadcaster 208 to begin game play. The broadcaster 208, in turn, broadcasts the started game to the client 210. Once game play is initiated, the broadcaster 208 may communicate with the client device 210 directly.

As indicated in the example operation of bingo game system 200 depicted in FIG. 2A, the bingo game server 206 may send a signal to the broadcaster 208 to start play of a bingo game, and the broadcaster 208 may in turn forward a signal to client 210 to start play of the bingo game. The bingo game server 206 may also send to the broadcaster 208 an indication of a plurality of ball calls in a sequence (e.g., ball calls 1, 2, . . . X). In one embodiment, the entire sequence of ball calls may be forwarded to the broadcaster at once; in another embodiment indications of ball calls in a sequence may be transmitted to the broadcaster one at a time, or in any desired distribution. In accordance with some embodiments, the broadcaster preferably transmits indications of ball calls to the client periodically (e.g., every 20 seconds). In one example, an online gaming interface at the client 210 may be updated, in response to receiving a signal from a broadcaster 208, of a new called ball.

According to some embodiments, the client 210 may transmit to the bingo game server 206 (e.g., via the broadcaster 208) an indication of a client daub X message that indicates a user has selected a bingo space to daub (e.g., by touching a space on bingo game board using a touchscreen input device). The bingo game server 206 determines, using a daub validator routine, whether the attempt to daub the particular bingo space is valid (e.g., based on whether the bingo space corresponds to a bingo game symbol that was actually called in the game and/or whether the attempt to daub the bingo space took place within a predetermined time after the bingo game symbol was called).

For example, the bingo game server 206 may determine that the daub attempt was for a bingo game symbol that was called, and the attempt was made appropriately within one minute of the symbol being called. In that case, the bingo game server 206 may transmit a message back to the client 210 that the daub X attempt was valid in the bingo game. In response to receiving the message, an online gaming interface may change a display of a bingo game board to indicate that the selected bingo space has been daubed. In another example, the bingo game server 206 may determine that the daub attempt by the player is not valid (e.g., because the bingo number for the selected bingo space was not actually called, or was called too long ago). In that case, the bingo game server 206 may transmit a message back to the client 210 that the daub X attempt was not valid for the bingo game. In response to receiving the message, an online gaming interface may generate a message to display to a player, indicating that the attempted daub was not a valid daub.

According to some embodiments, the client device 210 may comprise, without limitation, a player's tablet computer, desktop computer, or mobile device. As depicted with respect to functions of the bingo game system 200, the broadcaster 208 may, for example, communicate a plurality of ball calls in real time, present winner messages if applicable, and provide "game over" signals. In one or more embodiments, the game outcome and winners may be determined by the bingo game server 206. In some embodiments, for example, the controller 204 may alert the bingo game server 206 as to the end of game play (e.g., upon the completion of the first line, second line, and full house winning bingo patterns), and the bingo game server 206 facilitates payment of the winners (e.g., by initiating the transfer of winnings to a player accounts).

In accordance with some embodiments, a client device may generate a winner message indicating a winning bingo pattern has been achieved by a player (e.g., in response to a player selecting a "Bingo" button on a game interface). The bingo game server 206 may validate whether the predetermined bingo pattern has been achieved. If the win is valid, the bingo game server 206 may transmit a message to the client device 210 that the player as won, and may transmit an indication of the win to the database 202 for storage.

Figure 2B:
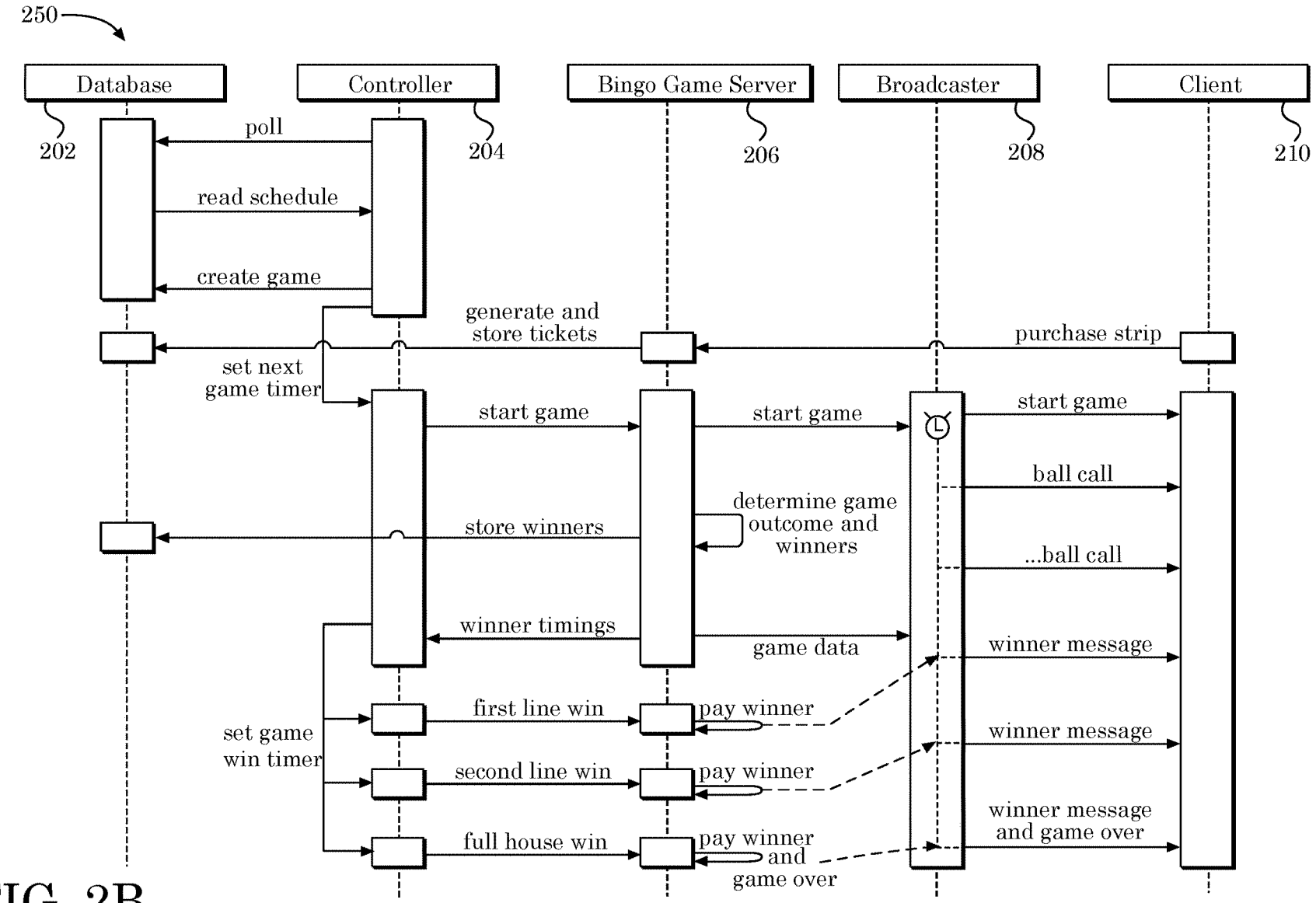
FIG. 2B is a block diagram of a bingo system according to one or more embodiments.

Referring now to FIG. 2B, a block diagram of an alternative bingo game system 250 according to some embodiments is shown. Like the bingo game system 200 described with respect to FIG. 2A, the bingo game system 250 may comprise a database 202, a controller 204, a bingo game server 206, a broadcaster 208, and a client 210. Play may be initiated in a manner similar to that described with respect to bingo game system 200 of FIG. 2A.

In some embodiments, as depicted in bingo game system 250, the database 202 may be in communication with a controller 204. The controller 204 may, for example, poll the database 202 for a gaming schedule stored in the database, and read a schedule provided by the controller 204. Based on this information, the controller 204 may then create a game which may, in turn, be stored by the database 202.

In one or more embodiments, a player's gaming experience may or may not be affected by game data which may include, for example, the player's game play history (e.g., stored in the database 202). For example, the database 202 may store information concerning game winners, and may send this information to the bingo game server 206, which may then use this data to affect the game in one or more ways described in this specification. The bingo game server 206, in some examples, may send game data to the broadcaster 208 to control what is broadcast to the client device 210 (e.g., based on how the bingo game server 206 may have altered the game). In some embodiments, the bingo game server 206 affects both game data and winner timings based on data stored in the database 202.

As described with respect to bingo game system 200, in some embodiments the controller 204 of alternative bingo game system 250 may alert the bingo game server 206 as to the end of game play, and the bingo game server 206 may facilitate payment of the winners.

Figure 3:
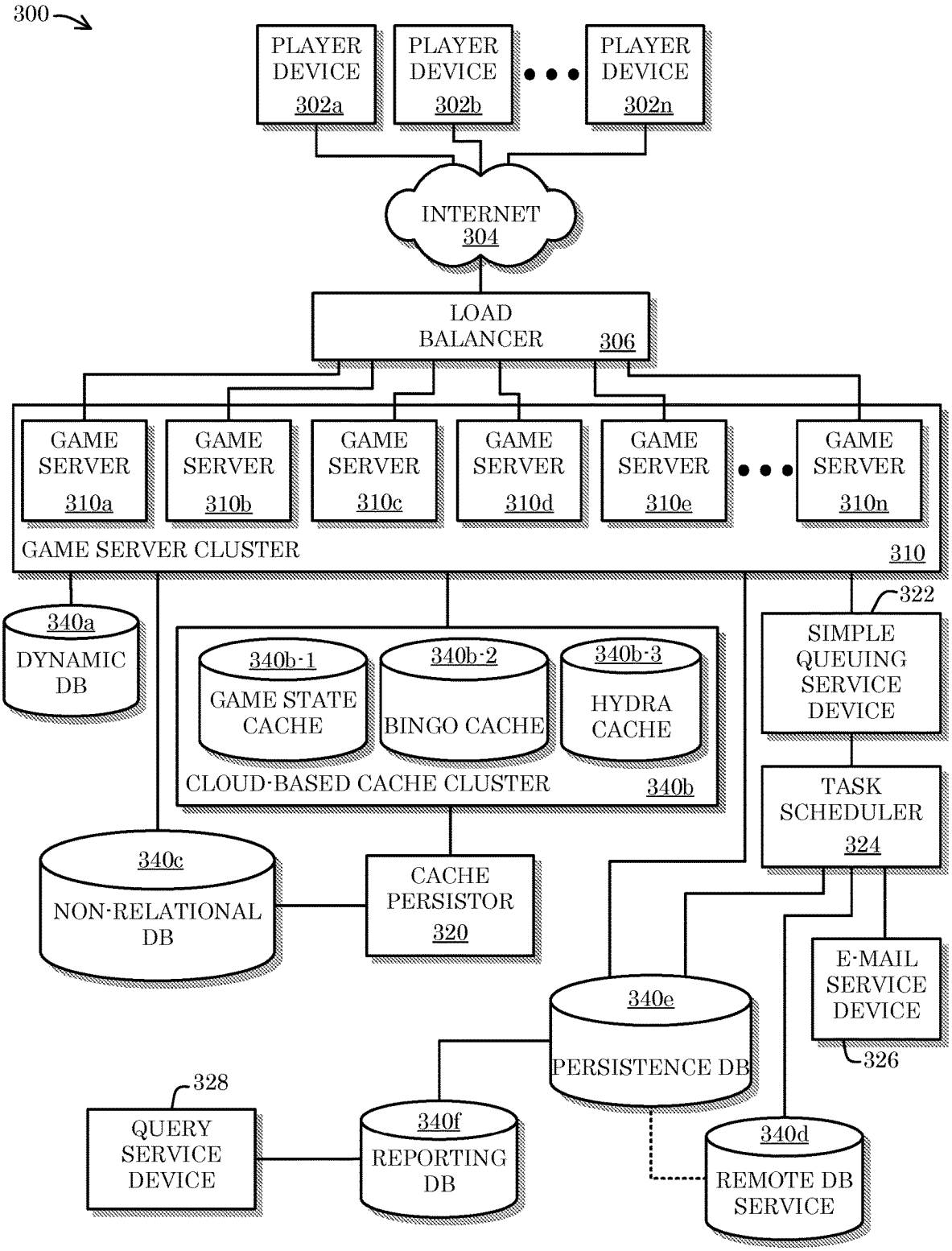
FIG. 3 is a block diagram of a system according to one or more embodiments.

Referring now to FIG. 3, a block diagram of a system 300 according to some embodiments is shown. In some embodiments, the system 300 may comprise a gaming platform such as a platform via which social, multiplayer, and/or online games may be played (e.g., one or more bingo games as described in this disclosure). In some embodiments, the system 300 may comprise a plurality of player devices 302*a-n*, the Internet 304, a load balancer 306, and/or a game server cluster 310. The game server cluster 310 may, in some embodiments, comprise a plurality of game servers 310*a-n*. In some embodiments, the system 300 may comprise a cache persistor 320, a Simple Queuing Service (SQS) device 322, a task scheduler 324, an e-mail service device 326, and/or a query service device 328. As depicted in FIG. 3, any or all of the various components 302*a-n*, 304, 306, 310*a-n*, 320, 322, 324, 326, 328 may be in communication with and/or coupled to one or more databases 340*a-f*. The system 300 may comprise, for example, a dynamic database (DB) 340*a*, a cloud-based cache cluster 340*b* (e.g., comprising a game state cache 340*b*-1, a bingo cache 340*b*-2, and/or a "hydra" cache 340*b*-3), a non-relational DB 340*c*, a remote DB service 340*d*, a persistence DB 340*e*, and/or a reporting DB 340*f*.

According to some embodiments, any or all of the components 302*a-n*, 304, 306, 310*a-n*, 320, 322, 324, 326, 328, 340*a-f* of the system 300 may be similar in configuration and/or functionality to any similarly named and/or numbered components described in this disclosure. Fewer or more components 302*a-n*, 304, 306, 310*a-n*, 320, 322, 324, 326, 328, 340*a-f* (and/or portions thereof) and/or various configurations of the components 302*a-n*, 304, 306, 310*a-n*, 320, 322, 324, 326, 328, 340*a-f* may be included in the system 300 without deviating from the scope of embodiments described in this disclosure. While multiple instances of some components 302*a-n*, 310*a-n*, 340*a-f* are depicted and while single instances of other components 304, 306, 320, 322, 324, 326, 328 are depicted, for example, any component 302*a-n*, 304, 306, 310*a-n*, 320, 322, 324, 326, 328, 340*a-f* depicted in the system 300 may comprise a single device, a combination of devices and/or components 302*a-n*, 304, 306, 310*a-n*, 320, 322, 324, 326, 328, 340*a-f*, and/or a plurality of devices, as deemed practicable for a desired implementation. Similarly, in some embodiments, one or more of the various components 302*a-n*, 304, 306, 310*a-n*, 320, 322, 324, 326, 328, 340*a-f* may not be needed and/or desired in the system 300.

According to some embodiments, the player devices 302*a-n* may be utilized to access (e.g., via the Internet 304 and/or one or more other networks not explicitly shown) content provided by the game server cluster 310. The game server cluster 310 may, for example, provide, manage, host, and/or conduct various online and/or otherwise electronic games such as online bingo, slot-style games, poker, and/or other games of chance, skill, and/or combinations thereof. In some embodiments, the various game servers 310*a-n* (virtual and/or physical) of the game server cluster 310 may be configured to provide, manage, host, and/or conduct individual instances and/or sessions of available game types. A first game server 310*a*, for example, may host a first particular session of an online bingo game (or tournament), a second game server 310*c* may host a second particular session of an online bingo game (or tournament), a third game server 310*c* may facilitate an online poker tournament (e.g., and a corresponding plurality of game sessions that comprise the tournament), and/or a fourth game server 310*d* may provide an online slots game (e.g., by hosting one or more slot game sessions).

In some embodiments, the player devices 302*a-n* may comprise various components (hardware, firmware, and/or software; not explicitly shown) that facilitate game play and/or interaction with the game server cluster 310. The player device 302*a-n* may, for example, comprise a gaming client such as a software application programmed in Adobe® Flash® and/or HTML5 that is configured to send requests to, and receive responses from, one or more of the game servers 310*a-n* of the game server cluster 310. In some embodiments, such an application operating on and/or via the player devices 302*a-n* may be configured in model-view-controller (MVC) architecture with a communication manager layer responsible for managing the requests to/responses from the game server cluster 310. In some embodiments, one or more of the game servers 310*a-n* may also or alternatively be configured in a MVC architecture with a communication manager and/or communications management layer (not explicitly shown in FIG. 3). In some embodiments, communications between the player devices 302*a-n* and the game server cluster 310 may be conducted in accordance with the hypertext transfer protocol (HTTP) version 1.1 (HTTP/1.1) as published by the Internet Engineering Taskforce (IET) and the World Wide Web Consortium (W3C) in RFC 2616 (June 1999).

According to some embodiments, communications between the player devices 302*a-n* and the game server cluster 310 may be managed and/or facilitated by the load balancer 306. The load balancer 306 may, for example, route communications from player devices 302*a-n* to one or more of the specific game servers 310*a-n* depending upon various attributes and/or variables such as bandwidth availability (e.g., traffic management/volumetric load balancing), server load (e.g., processing load balancing), server functionality (e.g., contextual awareness/availability), and/or player-server history (e.g., session awareness/"stickiness"). In some embodiments, the load balancer 306 may comprise one or more devices and/or services provided by a third-party (not separately shown in FIG. 3). The load balancer 306 may, for example, comprise an elastic load balancer (ELB) service provided by Amazon® Web Services, LLC of Seattle, Wash. According to some embodiments, such as in the case that the load balancer 306 comprises the ELB or a similar service, the load balancer 306 may manage, set, determine, define, and/or otherwise influence the number of game servers 310*a-n* within the game server cluster 310. In the case that traffic and/or requests from the player devices 302*a-n* only require the first and second game servers 310*a-b*, for example, all other game servers 310*c-n* may be taken off-line, may not be initiated and/or called, and/or may otherwise not be required and/or utilized in the system 300. As demand increases (and/or if performance, security, and/or other issues cause one or more of the first and second game servers 310*a-b* to experience detrimental issues), the load balancer 306 may call and/or bring online one or more of the other game servers 310*c-n* depicted in FIG. 3. In the case that each game server 310*a-n* comprises an instance of a resizable compute capacity service, such as the Amazon Elastic Compute Cloud™ (Amazon EC2™) web service provided by Amazon Web Services, Inc., the load balancer 306 may add or remove instances as deemed practicable and/or desirable in a given implementation.

In some embodiments, the load balancer 306 and/or the Internet 304 may comprise one or more proxy servers and/or devices (not shown in FIG. 3) via which communications between the player devices 302*a-n* and the game server cluster 310 are conducted and/or routed. Such proxy servers and/or devices may comprise one or more regional game hosting centers, for example, which may be geographically dispersed and addressable by player devices 302*a-n* in a given geographic proximity. In some embodiments, the proxy servers and/or devices may be located in one or more geographic areas and/or jurisdictions while the game server cluster 310 (and/or certain game servers 310*a-n* and/or groups of game servers 310*a-n* thereof) is located in a separate and/or remote geographic area and/or jurisdiction.

According to some embodiments, for specific game types such as bingo, the game server cluster 310 may provide game results (such as a full set of drawn bingo numbers and/or bonus metrics) to a controller device (not separately shown in FIG. 3) that times the release of game result information to the player devices 302*a-n* such as by utilizing a broadcaster device (also not separately shown in FIG. 3) that transmits the time-released game results to the player devices 302*a-n* (e.g., in accordance with the Transmission Control Protocol (TCP) and Internet Protocol (IP) suite of communications protocols (TCP/IP), version 4, as defined by "Transmission Control Protocol" RFC 793 and/or "Internet Protocol" RFC 791, Defense Advance Research Projects Agency (DARPA), published by the Information Sciences Institute, University of Southern California, J. Postel, ed. (September 1981)).

In some embodiments, the game server cluster 310 (and/or one or more of the game servers 310*a-n* thereof) may be in communication with the dynamic DB 340*a*. According to some embodiments, the dynamic DB 340*a* may comprise a dynamically-scalable database service such as the DyanmoDB™ service provided by Amazon Web Services, Inc. The dynamic DB 340*a* may, for example, store information specific to one or more certain game types (e.g., bingo games) provided by the game server cluster 310 such as to allow, permit, and/or facilitate reporting and/or analysis of such information.

According to some embodiments, the game server cluster 310 (and/or one or more of the game servers 310*a-n* thereof) may be in communication with the cloud-based cache cluster 340*b*. Game state information from the game server cluster 310 may be stored in the game state cache 340*b*-1; bingo state data (e.g., the current state of spaces (marked or unmarked) of a player's bingo card, history of called balls, information about ball call order, etc.) may be stored in the bingo cache 340*b*-2; and/or other game and/or player information (e.g., progressive data, referral data, player rankings, audit data) may be stored in the hydra cache 340*b*-3. In some embodiments, the cache persistor 320 may move and/or copy data stored in the cloud-based cache cluster 340*b* to the non-relational DB 340*c*. The non-relational DB 340*c* may, for example, comprise a SimpleDB™ service provided by Amazon Web Services, Inc. According to some embodiments, the game server cluster 310 may generally access the cloud-based cache cluster 340*b* as-needed to store and/or retrieve game-related information. The data stored in the cloud-based cache cluster 340*b* may generally comprise a subset of the newest or freshest data, while the cache persistor 320 may archive and/or store or move such data to the non-relational DB 340*c* as it ages and/or becomes less relevant (e.g., once a player logs off, and/or once a game session and/or tournament ends). The game server cluster 310 may, in accordance with some embodiments, have access to the non-relational DB 340*c* as-needed and/or desired. The game servers 310*a-n* may, for example, be initialized with data from the non-relational DB 340*c* and/or may store and/or retrieve low frequency and/or low priority data via the non-relational DB 340*c*.

In some embodiments, the SQS device 322 may queue and/or otherwise manage requests, messages, events, and/or other tasks or calls to and/or from the server cluster 310. The SQS device 322 may, for example, prioritize and/or route requests between the game server cluster 310 and the task scheduler 324. In some embodiments, the SQS device 322 may provide mini-game and/or tournament information to the server cluster 310. According to some embodiments, the task scheduler 324 may initiate communications with the SQS device 322, the e-mail service provider 326 (e.g., providing e-mail lists), the remote DB service 340*d* (e.g., providing inserts and/or updates), and/or the persistence DB 340*e* (e.g., providing and/or updating game, player, and/or other reporting data), e.g., in accordance with one or more schedules.

According to some embodiments, the persistence DB 340*e* may comprise a data store of live environment game and/or player data. The game server cluster 310 and/or the task scheduler 324 or SQS device 322 may, for example, store game and/or player data to the persistence DB 340*e* and/or may pull and/or retrieve data from the persistence DB 340*e*, as-needed and/or desired. The server cluster 310 may, according to some embodiments, provide and/or retrieve spin and/or other game event info and/or configuration information via the persistence DB 340*e*.

In some embodiments, the reporting DB 340*f* may be created and/or populated based on the persistence DB 340*e*. On a scheduled and/or other basis, for example, a data transformation and/or mapping program may be utilized to pull data from the live environment (e.g., the persistence DB 340*e*) into the reporting DB 340*f*. The query service 328 may then be utilized, for example, to query the reporting DB 340*f*, without taxing the live environment and/or production system directly accessible by the game server cluster 310.

According to some embodiments, any or all of the player devices 302*a-n* in conjunction with one or more of the game servers 310*a-n* and/or the databases 340*a-f* (e.g., via the network 304) may conduct (in whole or in part), facilitate, and/or otherwise be associated with execution of one or more stored procedures, applications, processes, and/or methods as described in this disclosure.

Figure 4:
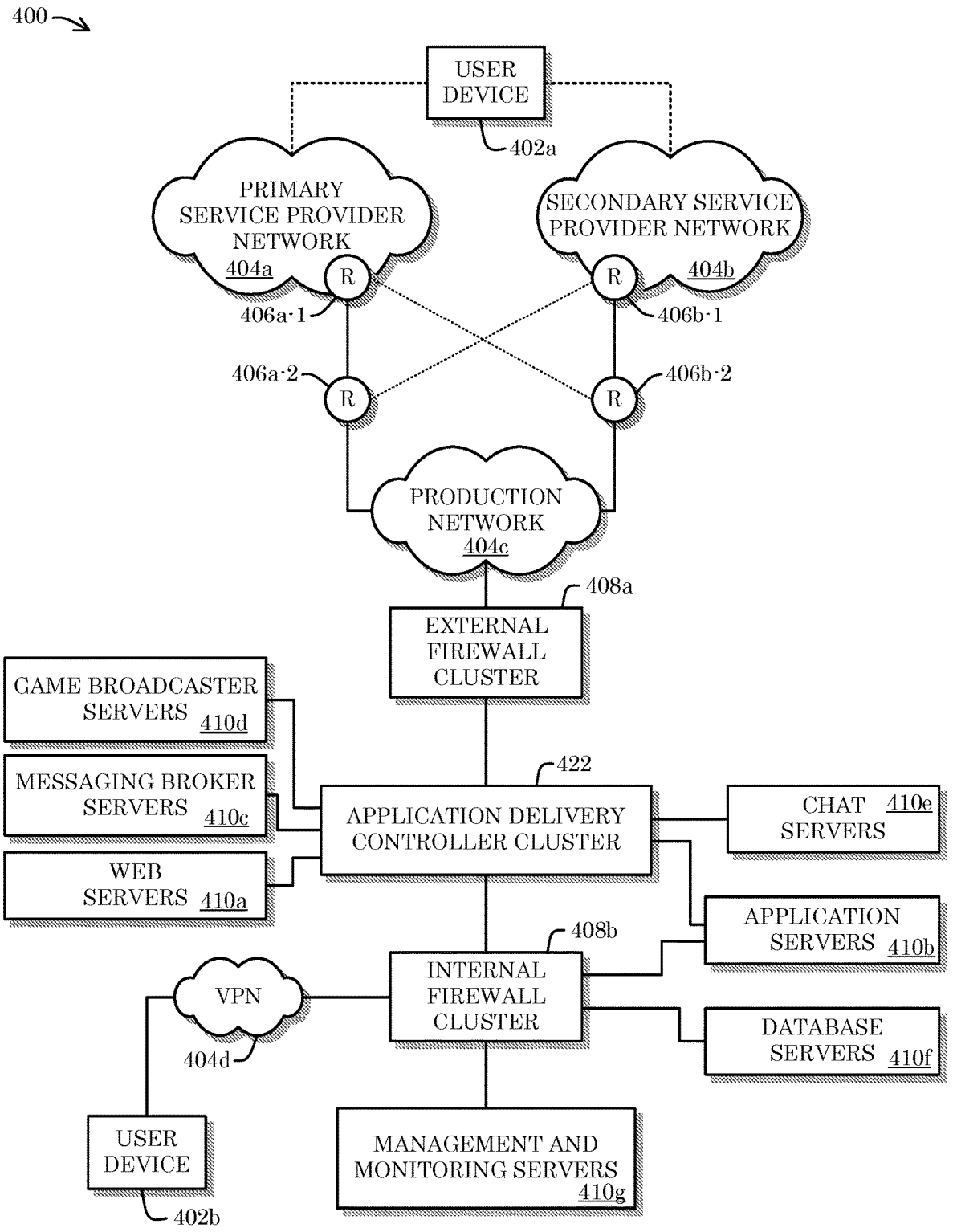
FIG. 4 is a block diagram of a system according to one or more embodiments.

Turning now to FIG. 4, a block diagram of a system 400 according to some embodiments is shown. In some embodiments, the system 400 may comprise and/or define a "front-end" architecture of a gaming platform such as a platform via which social, multiplayer, and/or online games may be played (e.g., one or more bingo games as described in this disclosure). In some embodiments, the system 400 may comprise a plurality of user devices 402*a-b*, a plurality of networks 404*a-b* (e.g., a primary service provider network 404*a*, a secondary service provider network 404*b*, a production network 404*c*, and/or a VPN 404*d*), a plurality of routers 406*a-b*, a plurality of firewall devices 408*a-b*, a plurality of game servers 410*a-g* (e.g., web servers 410*a*, application servers 410*b*, messaging broker servers 410*c*, game broadcaster servers 410*d*, chat servers 410*e*, database servers 410*f*, and/or management and monitoring servers 410*g*), and/or an application delivery controller cluster 422.

According to some embodiments, any or all of the components 402*a-b*, 404*a-b*, 406*a-b*, 408*a-b*, 410*a-g*, 422 of the system 400 may be similar in configuration and/or functionality to any similarly named and/or numbered components described in this disclosure. Fewer or more components 402*a-b*, 404*a-b*, 406*a-b*, 408*a-b*, 410*a-g*, 422 (and/or portions thereof) and/or various configurations of the components 402*a-b*, 404*a-b*, 406*a-b*, 408*a-b*, 410*a-g*, 422 may be included in the system 400 without deviating from the scope of embodiments described in this disclosure. While multiple instances of some components 402*a-b*, 404*a-b*, 406*a-b*, 408*a-b*, 410*a-g* are depicted and while single instances of other components 422 are depicted, for example, any component 402*a-b*, 404*a-b*, 406*a-b*, 408*a-b*, 410*a-g*, 422 depicted in the system 400 may comprise a single device, a combination of devices and/or components 402*a-b*, 404*a-b*, 406*a-b*, 408*a-b*, 410*a-g*, 422, and/or a plurality of devices, as deemed practicable for a particular implementation. Similarly, in some embodiments, one or more of the various components 402*a-b*, 404*a-b*, 406*a-b*, 408*a-b*, 410*a-g*, 422 may not be needed and/or desired in the system 400.

In some embodiments, a first user device 402*a* may comprise an electronic device owned and/or operated by a player of an online game (not explicitly shown) and/or by an entity that otherwise accesses online game content and/or services externally (e.g., requiring external login and/or access credentials and/or procedures). The first user device 402*a* may, for example, be utilized to access content provided by and/or via the application delivery controller cluster 422. In some embodiments, the first user device 402*a* may interface with and/or connect to the production network 404*c* via the primary service provider network 404*a* and/or the secondary service provider network 404*b*. The primary service provider network 404*a* and the secondary service provider network 404*b* may, for example, load balance and/or provide redundant coverage for outage recovery by utilization of a first primary service provider network router 406*a*-1, a second primary service provider network router 406*a*-2, a first secondary service provider network router 406*b*-1, and/or a second secondary service provider network router 406*b*-2.

According to some embodiments, the application delivery controller cluster 422 may be insulated and/or protected from the production network 404*c* by an external firewall cluster 408*a*. The first user device 402*a* may, for example, be required to provide credentials to and/or otherwise access the application delivery controller cluster 422 via the external firewall cluster 408*a*.

In some embodiments, the application delivery controller cluster 422 may receive via and/or from the external firewall cluster 408*a* and/or the production network 404*c*, one or more requests, calls, transmissions, and/or commands from the first user device 402*a*. The first user device 402*a* may, for example, submit a call for an online gaming interface to the application delivery controller cluster 422. In some embodiments, the application delivery controller cluster 422 may comprise one or more hardware, software, and/or firmware devices and/or modules configured (e.g., specially-programmed) to route events and/or responses between the first user device 402*a* and one or more of the servers 410*a-g*. In the case that the first user device 402*a* is utilized to access an online gaming interface for example, one or more of the web servers 410*a* (e.g., that may provide graphical and/or rendering elements for an interface and/or other web services) and/or the application servers 410*b* (e.g., that may provide rule and/or logic-based programming routines, elements, and/or functions—e.g., game play engines) may be called and/or managed by the application delivery controller cluster 422.

In some embodiments, the messaging broker servers 410*c* may receive and/or retrieve messages from the first user device 402*a* (and/or from one or more of the other servers 410*a-b*, 410*d-g*) and perform one or more inter-application processes in relation thereto. The messaging broker servers

410*c* may, for example, route, transform, consolidate, aggregate, store, augment, and/or otherwise process one or more requests in connection with provision of online gaming services to the first user device 402*a* (e.g., facilitating a decoupling of services provided by various applications on and/or from the various servers 410*a-b*, 410*d-g*). According to some embodiments, the game broadcaster servers 410*d* may provide scheduled releases of information descriptive of an online game. The game broadcaster servers 410*d* may, for example, provide a broadcast feed of bingo numbers, slot and/or other random (and/or pseudo-random) number results that may be accessed by (and/or transmitted to) the first user device 402*a* (e.g., in connection with the play of an online bingo, slots, and/or other game for which broadcast information may be utilized). In some embodiments, the chat servers 410*e* may provide, manage, and/or facilitate communications between the first user device 402*a* (and/or first user thereof) and one or more other player/user devices (such as a second user device 402*b* and/or other player/user devices not shown in FIG. 4).

According to some embodiments, the second user device 402*b* may generally comprise an electronic device owned and/or operated by a user (not shown) closely affiliated with an entity that operates the system 400 (such entity also not shown). An employee (e.g., programmer and/or Customer Service Representative (CSR)), contractor, and/or other agent of an online gaming company may, for example, utilize the second user device 402*b* to interface with the privately-accessible VPN 404*d*. The VPN 404*d* may, for example, provide direct access to the application servers 410*b*, the database servers 410*f*, the management and monitoring servers 410*g*, and/or the application delivery controller cluster 422. In some embodiments (as depicted in FIG. 4), such access may be gated through and/or insulated or protected by an internal firewall cluster 408*b*. The second user device 402*b* may, for example, be required to provide credentials to and/or otherwise access the application delivery controller cluster 422 and/or servers 410*a-g* via the internal firewall cluster 408*b*.

In some embodiments, the database servers 410*f* may provide access to one or more databases and/or data stores (e.g., not shown in FIG. 4; for data storage and/or retrieval). In some embodiments, the management and monitoring servers 410*g* may provide services such as monitoring, reporting, troubleshooting, analysis, configuring, etc. to the second user device 402*b*. The second user device 402*b* may, for example, access the management and monitoring servers 410*g* and/or the database servers 410*f* to run reports descriptive of online gaming operations, game play, and/or game referral setup, management, and/or analysis. According to some embodiments, either or both of the user devices 402*a-b* in conjunction with one or more of the servers 410*a-g* and/or the application delivery controller cluster 422 may conduct (in whole or in part), facilitate, and/or otherwise be associated with execution of one or more stored procedures, applications, processes, and/or methods discussed in this disclosure, and/or one or more portions and/or combinations thereof.

Utilization of the term "server" with respect to the servers 410*a-g* of the system 400 of FIG. 4 is meant solely to ease description of the configuration and/or functionality of the servers 410*a-g*. The term "server" is not intended to be limiting with respect to any particular hardware, software, firmware, and/or quantities thereof utilized to implement any or all of the servers 410*a-g* of the system 400. Similarly, while multiple types and/or instances of the servers 410*a-g* are depicted in FIG. 4, any or all of the servers 410*a-g* may be implemented in, on, and/or by one or multiple computer server and/or other electronic devices.

Figure 5:
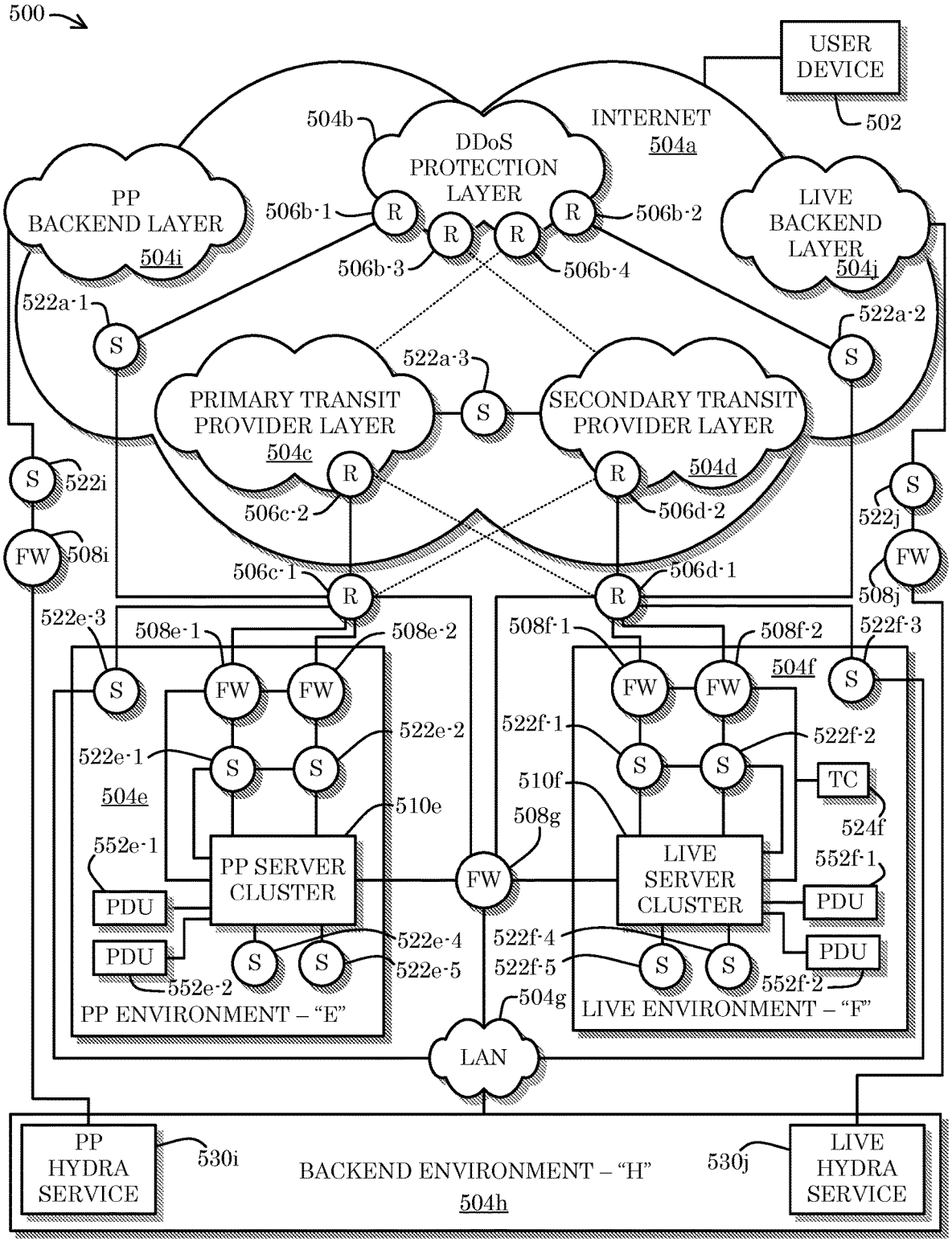
FIG. 5 is a block diagram of a system according to one or more embodiments.

Referring now to FIG. 5, a block diagram of a system 500 according to some embodiments is shown. In some embodiments, the system 500 may comprise and/or define a "front-end" architecture of a gaming platform such as a platform via which social, multiplayer, and/or online games may be played (e.g., one or more bingo games as described in this disclosure). The system 500 may be similar in configuration and/or functionality, for example, to the system 400 of FIG. 4 and/or one or more portions thereof. In some embodiments, the system 500 may comprise a user device 502, a plurality of networks (and/or environments and/or layers) 504*a-j* (e.g., the Internet 504*a*, a distributed denial-of-service (DDoS) protection layer 504*b*, a primary transit provider layer 504*c*, a secondary transit provider layer 504*d*, a pre-production (PP) environment 504*e*, a live environment 504*f*, a LAN 504*g*, a backend environment 504*h*, a PP backend layer 504*i*, and/or a live backend layer 504*j*), a plurality of routers 506*b-d*, a plurality of firewall devices 508*e-g* and 508*i-j*, a plurality of servers 510*e-f* (e.g., a PP server cluster 510*e* and/or a live server cluster 510*f*), a plurality of switching devices 522*a*, 522*e-f*, 522*i-j*, a terminal concentrator (TC) 524*f*, a plurality of "hydra" services 530*i-j* (e.g., a PP hydra service 530*i* and/or a live hydra service 530*j*), and/or a plurality of power distribution unit (PDU) devices 552*e-f*.

According to some embodiments, any or all of the components 502, 504*a-j*, 506*b-d*, 508*e-g*, 508*i-j*, 510*e-f*, 522*a*, 522*e-f*, 522*i-j*, 524*f*, 530*i-j*, 552*e-f* of the system 500 may be similar in configuration and/or functionality to any similarly named and/or numbered components described in this disclosure. Fewer or more components 502, 504*a-j*, 506*b-d*, 508*e-g*, 508*i-j*, 510*e-f*, 522*a*, 522*e-f*, 522*i-j*, 524*f*, 530*i-j*, 552*e-f* (and/or portions thereof) and/or various configurations of the components 502, 504*a-j*, 506*b-d*, 508*e-g*, 508*i-j*, 510*e-f*, 522*a*, 522*e-f*, 522*i-j*, 524*f*, 530*i-j*, 552*e-f* may be included in the system 500 without deviating from the scope of embodiments described in this disclosure. While multiple instances of some components 504*a-j*, 506*b-d*, 508*e-g*, 508*i-j*, 510*e-f*, 522*a*, 522*e-f*, 522*i-j*, 530*i-j*, 552*e-f* are depicted and while single instances of other components 502, 524*f* are depicted, for example, any component 502, 504*a-j*, 506*b-d*, 508*e-g*, 508*i-j*, 510*e-f*, 522*a*, 522*e-f*, 522*i-j*, 524*f*, 530*i-j*, 552*e-f* depicted in the system 500 may comprise a single device, a combination of devices and/or components 502, 504*a-j*, 506*b-d*, 508*e-g*, 508*i-j*, 510*e-f*, 522*a*, 522*e-f*, 522*i-j*, 524*f*, 530*i-j*, 552*e-f*, and/or a plurality of devices, as deemed practicable for a given implementation. Similarly, in some embodiments, one or more of the various components 502, 504*a-j*, 506*b-d*, 508*e-g*, 508*i-j*, 510*e-f*, 522*a*, 522*e-f*, 522*i-j*, 524*f*, 530*i-j*, and 552*e-f* may not be needed and/or desired in the system 500.

In some embodiments, the user device 502 may be utilized to access one or more of the PP environment 504*e*, the live environment 504*f*, and/or the backend environment 504*h*, via the Internet 504*a*. In some embodiments, the user device 502 may be utilized to access the backend environment 504*h* and/or the PP hydra service 530*i* via the PP backend layer 504*i*. A PP backend switch device 522*i* and/or a PP backend firewall device 508*i* may, for example, gate and/or control access to the backend environment 504*h* and/or the PP hydra service 530*i*, via the PP backend layer 504*i*. In some embodiments, the user device 502 may be utilized to access the backend environment 504*h* and/or the live hydra service 530*j* via the live backend layer 504*j*. A live backend switch device 522*j* and/or a live backend firewall device 508*j* may, for example, gate and/or control access to the backend environment 504*h* and/or the live hydra service 530*j*, via the live backend layer 504*j*.

According to some embodiments, any communications (e.g., requests, calls, and/or messages) from the user device 502 may be passed through the DDoS protection layer 504*b*. The DDoS protection layer 504*b* may, for example, monitor and/or facilitate protection against various forms of cyber attacks including, but not limited to, DDoS attacks. In some embodiments, the DDoS protection layer 504*b* may comprise and/or be in communication with a plurality of DDoS router devices 506*b*-1, 506*b*-2, 506*b*-3, 506*b*-4 that may be utilized to route and/or direct incoming communications (e.g., from the user device 502) to appropriate portions of the system 500.

In some embodiments, the DDoS protection layer 504*b* and/or a first DDoS router device 506*b*-1 may route communications from the user device 502 through and/or via a first switch device 522*a*-1 and/or to, through, and/or via a first primary transit provider router device 506*c*-1. In some embodiments, the first switch device 522*a*-1 may comprise a device utilized for security switching such as may implement communications in accordance with the generic routing encapsulation (GRE) communications tunneling protocol described in RFC 2784 "Generic Routing Encapsulation (GRE)" published by the Network Working Group (NWG) in March, 2000. The first primary transit provider router device 506*c*-1 may, for example, provide access to the PP environment 504*e* and/or the PP server cluster 510*e* thereof, such as via one or more PP firewall devices 508*e*-1, 508*e*-2 and/or one or more PP switch devices 522*e*-1, 522*e*-2. According to some embodiments, the PP switch devices 522*e*-1, 522*e*-2 may comprise content switching devices that process and route data (e.g., in the data link layer) based on data content. In some embodiments, the first primary transit provider router device 506*c*-1 may direct communications to, through, and/or via a PP LAN switch device 522*e*-3 that provides and/or facilitates access to the LAN 504*g*. The LAN 504*g* may, for example, provide private access to and/or between the PP environment 504*e*, the live environment 504*f*, and/or the backend environment 504*h*. In some embodiments, the first primary transit provider router device 506*c*-1 and/or the PP LAN switch device 522*e*-3 may direct communications to, through, and/or via a LAN firewall device 508*g* that provides direct access to either or both of the PP server cluster 510*e* and the live server cluster 510*f*.

According to some embodiments, the DDoS protection layer 504*b* and/or a second DDoS router device 506*b*-2 may route communications from the user device 502 through and/or via a second switch device 522*a*-2 and/or to, through, and/or via a first secondary transit provider router device 506*d*-1. In some embodiments, the second switch device 522*a*-2 may comprise a device utilized for security switching such as may implement communications in accordance with the GRE communications tunneling protocol described in RFC 2784 "Generic Routing Encapsulation (GRE)" published by the Network Working Group (NWG) in March, 2000. The first secondary transit provider router device 506*d*-1 may, for example, provide access to the live environment 504*f* and/or the live server cluster 510*f* thereof, such as via one or more live firewall devices 508*f*-1, 508*f*-2 and/or one or more live switch devices 522*f*-1, 522*f*-2. According to some embodiments, the live switch devices 522*f*-1, 522*f*-2 may comprise content switching devices that process and route data (e.g., in the data link layer) based on data content. In some embodiments, the first secondary transit provider router device 506*d*-1 may direct communications to, through, and/or via a live LAN switch device 522*f*-3 that provides and/or facilitates access to the LAN 504*g*. In some embodiments, the first secondary transit provider router device 506*d*-1 and/or the live LAN switch device 522*f*-3 may direct communications to, through, and/or via the LAN firewall device 508*g* that provides direct access to either or both of the PP server cluster 510*e* and the live server cluster 510*f*.

In some embodiments, the DDoS protection layer 504*b* and/or one or more of a third DDoS router device 506*b*-3 and/or a fourth DDoS router device 506*b*-4 may route communications from the user device 502 through and/or via one or more of the primary transit provider layer 504*c* and/or the secondary transit provider layer 504*d*. In some embodiments, a transit provider switch device 522*a*-3 may direct, swap, route, and/or manage communications between the primary transit provider layer 504*c* and the secondary transit provider layer 504*d*. According to some embodiments, the transit provider switch device 522*a*-3 may comprise a switching device that operates in accordance with an Exterior Border Gateway Protocol (EBGP)—e.g., the transit provider switch device 522*a*-3 may comprise one or more edge or border routers. In some embodiments, the first primary transit provider router device 506*c*-1, the first secondary transit provider router device 506*d*-1, a second primary transit provider router device 506*c*-2, and/or a second secondary transit provider router device 506*d*-2 may be utilized to route and/or direct communications between (i) the primary transit provider layer 504*c* and/or the secondary transit provider layer 504*d* and (ii) the PP environment 504*e* and/or the live environment 504*f*.

According to some embodiments, the PP server cluster 510*e* and/or the PP environment 504*e* may comprise various hardware, software, and/or firmware that permits a user (e.g., of the user device 502) to program, edit, manage, and/or otherwise interface with PP game elements and/or interfaces (e.g., for development and/or testing purposes). In some embodiments, the PDU devices 552*e*-1, 552*e*-2 may generally provide power distribution, supply, management, backup, and/or conditioning services (e.g., to the PP server cluster 510*e*) as desired for a particular implementation. According to some embodiments, additional switch devices 522*e*-4, 522*e*-5 may be utilized to distribute, balance, manage, and/or control communications to, from, and/or within the PP server cluster 510*e*.

In some embodiments, the live server cluster 510*f* and/or the live environment 504*f* may comprise various hardware, software, and/or firmware that permits a user (e.g., of the user device 502) to program, edit, manage, and/or otherwise interface with live game elements and/or interfaces (e.g., for troubleshooting, corrective, and/or live environment management purposes). In some embodiments, the PDU devices 552*f*-1, 552*f*-2 may generally provide power distribution, supply, management, backup, and/or conditioning services (e.g., to the live server cluster 510*f*) as desired for a particular implementation. According to some embodiments, additional switch devices 522*f*-4, 522*f*-5 may be utilized to distribute, balance, manage, and/or control communications to, from, and/or within the live server cluster 510*f*. In some embodiments, the TC device 524*f* may be utilized to manage communications from a variety of data sources such as by providing communication capability between various communications channels (not separately depicted in FIG. 5).

According to some embodiments, the user device 502 in conjunction with the live server cluster 510*f* (e.g., via the Internet 504*a*) may conduct (in whole or in part), facilitate, and/or otherwise be associated with execution of one or more stored procedures, applications, processes, and/or methods (and/or one or more portions and/or combinations thereof) as described in this disclosure.

Figure 6:
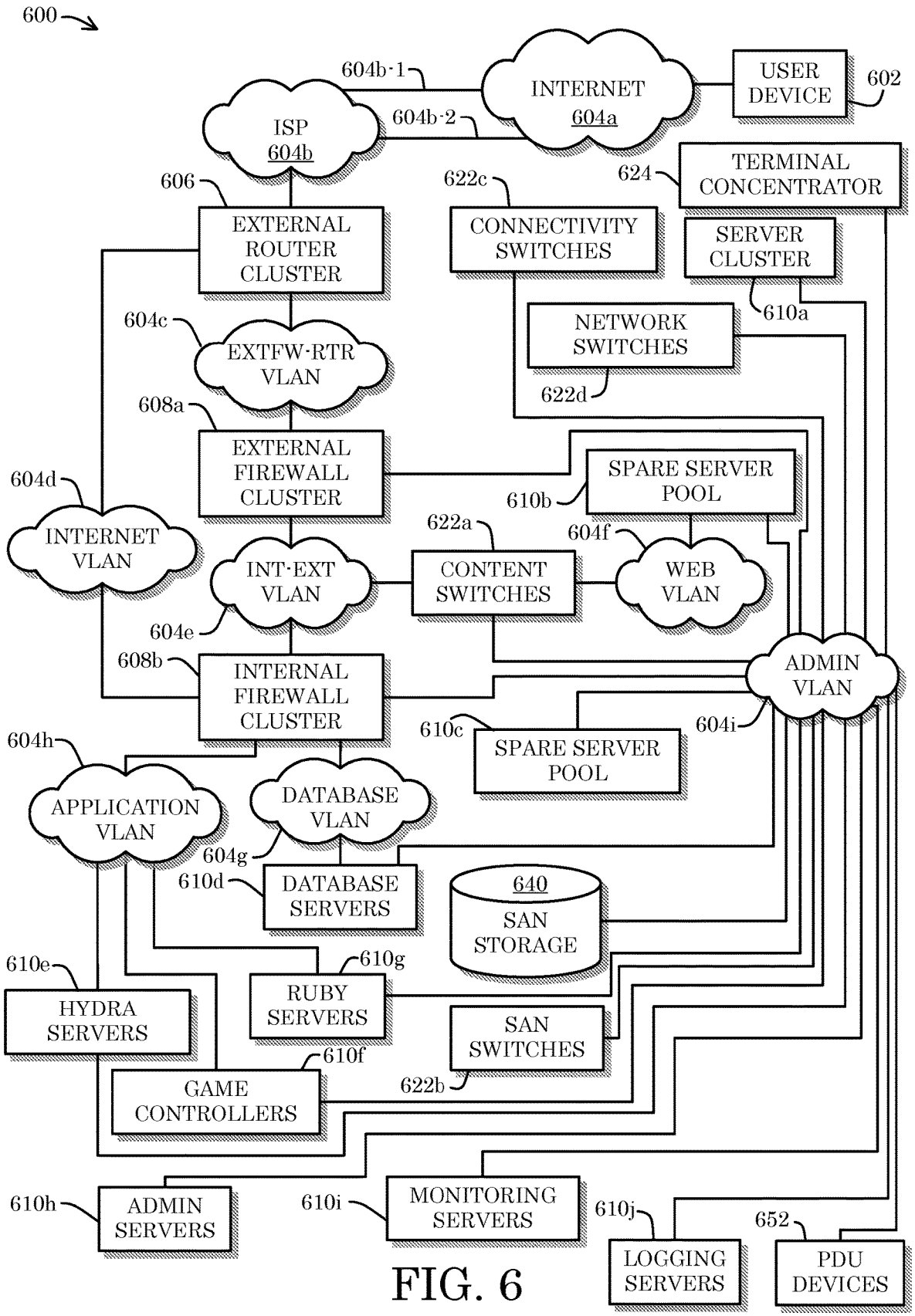
FIG. 6 is a block diagram of a system according to one or more embodiments.

Turning to FIG. 6, a block diagram of a system 600 according to some embodiments is shown. In some embodiments, the system 600 may comprise and/or define a "backend" architecture of a gaming platform such as a platform via which social, multiplayer, and/or online games may be played (e.g., one or more bingo games as described in this disclosure). The system 600 may be utilized in conjunction with the systems 400, 500 of FIG. 4 and/or FIG. 5 in this disclosure, for example, and/or may be similar in configuration and/or functionality to the backend environment 504*h* of the system 500 of FIG. 5. In some embodiments, the system 600 may comprise a user device 602, a plurality of networks (and/or environments and/or layers) 604*a-i* (e.g., the Internet 604*a*, an ISP 604*b*, an External Firewall-Router (EXTFW-RTR) Virtual LAN (VLAN) 604*c*, an Internet VLAN 604*d*, an Internal-External (INT-EXT) VLAN 604*e*, a web VLAN 604*f*, a database VLAN 604*g*, an application VLAN 604*h*, and/or an administrator VLAN 604*i*), an external router cluster 606, a plurality of firewall clusters 608*a-b* (e.g., an external firewall cluster 608*a* and/or an internal firewall cluster 608*b*), a plurality of servers 610*a-j* (e.g., a server cluster 610*a*, a first spare server pool 610*b*, a second spare server pool 610*c*, database servers 610*d*, "hydra" servers 610*e*, game controllers 610*f*, ruby servers 610*g*, admin servers 610*h*, monitoring servers 610*i*, and/or logging servers 610*j*), a plurality of switches 622*a-d* (e.g., content switches 622*a*, Storage Area Network (SAN) switches 622*b*, connectivity switches 622*c*, and/or network switches 622*d*), a TC device 624, a SAN storage device 640, and/or one or more PDU devices 652.

According to some embodiments, any or all of the components 602, 604*a-i*, 606, 608*a-b*, 610*a-j*, 622*a-d*, 624, 640, 652 of the system 600 may be similar in configuration and/or functionality to any similarly named and/or numbered components described in this disclosure. Fewer or more components 602, 604*a-i*, 606, 608*a-b*, 610*a-j*, 622*a-d*, 624, 640, 652 (and/or portions thereof) and/or various configurations of the components 602, 604*a-i*, 606, 608*a-b*, 610*a-j*, 622*a-d*, 624, 640, 652 may be included in the system 600 without deviating from the scope of embodiments described in this disclosure. While multiple instances of some components 604*a-i*, 608*a-b*, 610*a-j*, 622*a-d* are depicted and while single instances of other components 602, 606, 624, 640, 652 are depicted, for example, any component 602, 604*a-i*, 606, 608*a-b*, 610*a-j*, 622*a-d*, 624, 640, 652 depicted in the system 600 may comprise a single device, a combination of devices and/or components 602, 604*a-i*, 606, 608*a-b*, 610*a-j*, 622*a-d*, 624, 640, 652, and/or a plurality of devices, as deemed practicable for a particular implementation. Similarly, in some embodiments, one or more of the various components 602, 604*a-i*, 606, 608*a-b*, 610*a-j*, 622*a-d*, 624, 640, 652 may not be needed and/or desired in the system 600.

In some embodiments, the user device 602 may be utilized to access and/or interface with one or more of the servers 610*a-j* via the Internet 604*a*. In some embodiments, the Internet 602*a* may be linked to the ISP 604*b* via multiple (e.g., redundant) connectivity paths 604*b*-1, 604*b*-2 (e.g., for load balancing, security, and/or failure recovery). According to some embodiments, the ISP 604*b* may be in communication with (and/or comprise) the external router cluster 606. The external router cluster 606 may route certain requests, calls, and/or transmissions (and/or users—e.g., based on credentials and/or other information) through the EXTFW-RTR VLAN 604*c* and/or through the external firewall cluster 608*a*, for example, and/or may route certain requests, calls, and/or transmissions (and/or users—e.g., based on credentials and/or other information) through the Internet VLAN 604*d* and/or through the internal firewall cluster 608*b*.

In the case that a user (not shown) of the user device 602 comprises an online game player, consumer, and/or other member of the public, for example, the external router cluster 606 may direct communications through the EXTFW-RTR VLAN 604*c* and/or through the external firewall cluster 608*a*. In the case that the user of the user device 602 comprises a programmer, tester, employee, and/or other agent of an entity that operates the system 600, for example, the external router cluster 606 may direct communications through the Internet VLAN 604*d* and/or through the internal firewall cluster 608*b*. In some embodiments, access via either or both of the external firewall cluster 608*a* and/or the internal firewall cluster 608*b* may permit the user device 602 to communicate via the INT-EXT VLAN 604*e*. The INT-EXT VLAN 604*e* may, for example, provide access to the content switches 622*a* which may, in some embodiments, serve content from any or all of the servers 610*a-j* to the user device 602, as deemed practicable for a given implementation. In some embodiments, the content switches 622*a* may communicate with the first spare server pool 610*b* via the web LAN 604*f*.

According to some embodiments, private and/or other specialized access to the system 600 via the internal firewall cluster 608*b* may permit the user device 602 to communicate via one or more of the database VLAN 604*g*, the application VLAN 604*h*, and/or the admin VLAN 604*i*. The database VLAN 604*g* may be utilized, for example, to access and/or communicate with the database servers 610*d*. In some embodiments, the application VLAN 604*h* may be utilized to access and/or communicate with any or all of the hydra servers 610*e*, the game controllers 610*f*, and/or the ruby servers 610*g*.

The admin VLAN 604*i* may allow, promote, conduct, facilitate, and/or manage a wide variety of communications within the system 600. The admin VLAN 604*i* may, for example, communicatively connect and/or couple any or all of the firewalls 608*a-b*, the servers 610*a-j*, the switches 622*a-d*, the TC device 624, the SAN storage 640, and/or the PDU devices 652. The user device 602 may be utilized, in conjunction with the admin servers 610*h* and/or via the admin VLAN 604*i* for example, to define, edit, adjust, manage, and/or otherwise access settings (and/or data) of the firewalls 608*a-b*, any or all of the switches 622*a-d*, the TC device 624, and/or the PDU devices 652. In some embodiments, the user device 602 (and/or the admin servers 610*h*) may be utilized to manage and/or access content, rules, settings, and/or performance characteristics or preferences for any or all of the servers 610*a-j*.

In some embodiments, the server cluster 610*a* may comprise one or more servers and/or other electronic controller devices (e.g., blade servers) configured to provide online gaming data (e.g., interfaces, outcomes, and/or results) to the user device 602. According to some embodiments, the first spare server pool 610*b* and/or the second spare server pool 610*c* may comprise one or more server and/or other electronic controller devices configured to supplement and/or replace the server cluster 610*a* as needed and/or desired (e.g., to manage load and/or error recovery situations). In some embodiments, the database servers 610*c* may provide and/or manage access to stored data such as data stored in and/or by the SAN storage device 640. In some embodiments, the hydra servers 610*e* and/or the game controllers 610*f* may provide online game information such as interfaces, results, graphics, sounds, and/or other media to the user device 602 (e.g., via the application VLAN 604*h*). In some embodiments, the ruby servers 610*g* may comprise one or more processing devices configured to provide access to one or more programming languages (e.g., "Ruby") and/or Application Programming Interface (API) mechanisms via which the servers 610*a-j* and/or other portions of the system 600 may be configured to operate (e.g., in accordance with specially and/or pre-programmed instructions written in the programming language and/or developed by the API provided by the ruby servers 610*g*). According to some embodiments, the admin servers 610*h*, the monitoring servers 610*i*, and/or the logging servers 610*j* may be utilized and/or configured to provide administrative, parameter and/or metric monitoring and/or reporting, and/or data logging and/or audit services, respectively.

According to some embodiments, the user device 602 in conjunction with one or more of the servers 610*a-j* (e.g., via the Internet 604*a*) may conduct (in whole or in part), facilitate, and/or otherwise be associated with execution of one or more stored procedures, applications, processes, and/or methods as described in this disclosure.

Figure 7A:
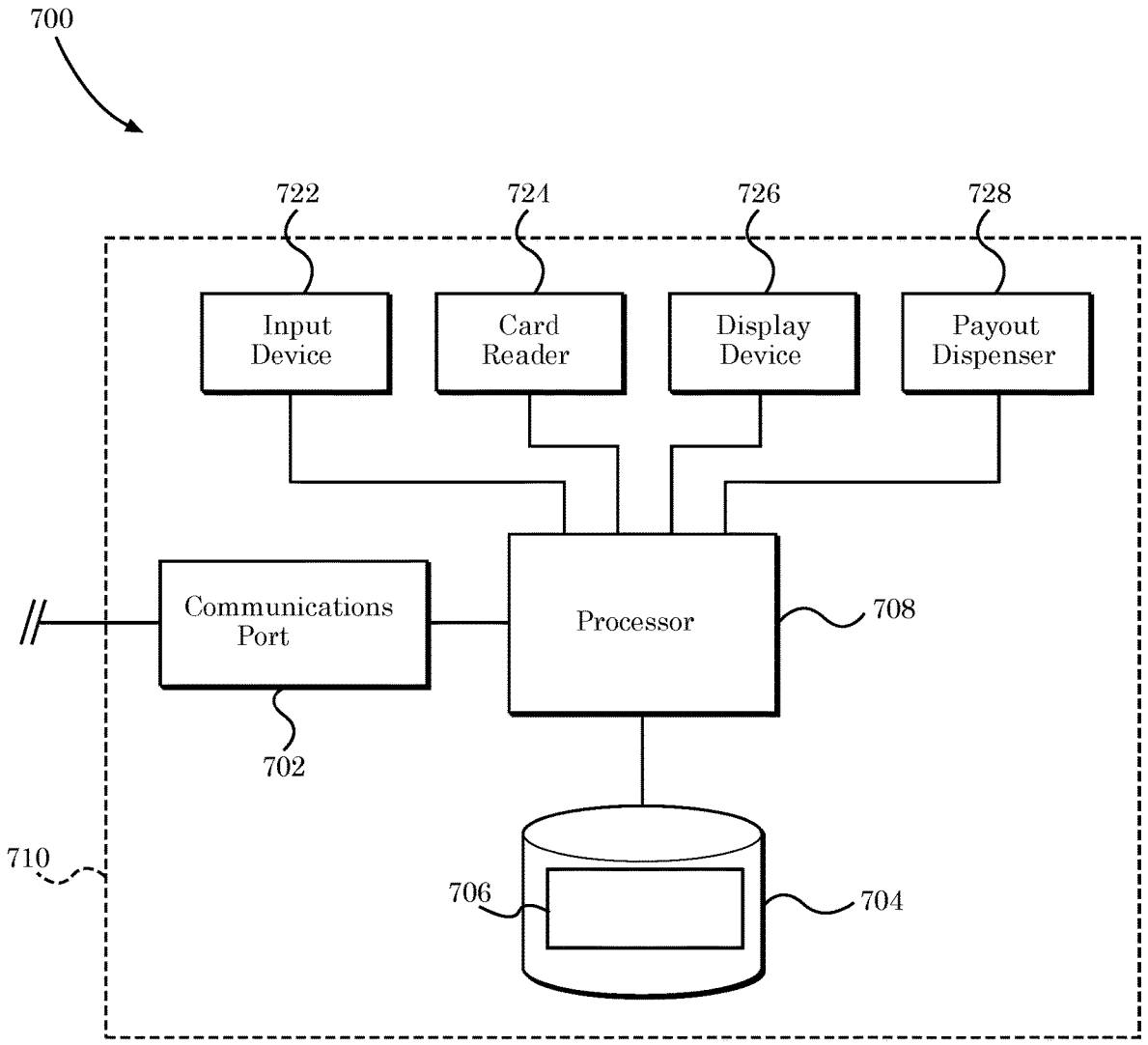
FIG. 7A is a block diagram of a gaming device according to one or more embodiments.

According to some embodiments, a user device (e.g., client device 210) configured for playing one or more bingo games (e.g., via an online gaming system) may comprise a gaming device, which may be a stand-alone gaming device (e.g., a dedicated gaming device), or a mobile gaming device. Turning to FIG. 7A, a block diagram of an example gaming device 700 is depicted. A gaming device 700 according to the present invention may include a processor 708 coupled to a communication port 702, and a data storage device 704.

The communication port 702 provides one- or two-way data communications with a controller device or game server. For example, the communication port 702 may be embodied as a serial port, modem, wireless transmitter/receiver or the like, operative to assist the gaming device 700 in providing one- or two-way data communications with bingo game server 206 (FIG. 2A).

The data storage device 704 includes an appropriate combination of magnetic, optical and/or semiconductor memory, and may include, for example, additional processors, communication ports, Random Access Memory ("RAM"), Read-Only Memory ("ROM"), a compact disc and/or a hard disk. The processor 708 and the storage device 704 may each be, for example: (i) located entirely within a single computer or other computing device; or (ii) connected to each other by a remote communication medium, such as a serial port cable, a LAN, a telephone line, radio frequency transceiver, a fiber optic connection or the like. In some embodiments, for example, the gaming device 700 may comprise one or more computers (or processors 708) that are connected to a remote server computer operative to maintain databases, where the data storage device 704 is comprised of the combination of the remote server computer and the associated databases.

The data storage device 704, in some embodiments, stores a gaming device program 706 for controlling the processor 708. The processor 708 performs instructions of the program 706, and thereby operates in accordance with the present invention, and particularly in accordance with the methods described in detail in this disclosure. The program 706 may be stored in a compressed, uncompiled, and/or encrypted format. The program 706 furthermore may include program elements that may be generally useful, such as an operating system, a database management system, and "device drivers" for allowing the processor 708 to interface with computer peripheral devices.

The program 706 is operative to execute a number of embodiment-specific modules or subroutines including but not limited to: one or more routines to identify a player at the gaming device 106; one or more routines to receive information about a player; one or more routines to offer play of a bingo game having multiple bingo game symbol draw sequences; one or more routines to offer play of a bingo game having a temporary daub feature; one or more routines to determine the result of play of the bingo game; one or more routines dispense a payout if a player matches a winning bingo pattern; one or more routines to facilitate and control communications between the gaming device 700 and a controller device; and one or more routines to control databases or software objects that track information regarding players, multiple draw sequences, temporary daubs, daubed bingo spaces, and gaming devices.

According to some embodiments of the present invention, the instructions of the program 706 may be read into a main memory of the processor 708 from another computer-readable medium, such as from a ROM to a RAM, or from a data storage device of a remote controller device. Execution of sequences of the instructions in the program 706 causes processor 708 to perform the process steps described. In alternative embodiments, hard-wired circuitry, or integrated circuits may be used in place of, or in combination with, software instructions for implementation of the processes of the present invention. Thus, embodiments of the present invention are not limited to any specific combination of hardware, firmware, and/or software.

In addition to the program 706, the storage device 704 may also be operative to store one or more databases storing information for use in providing for one or more embodiments described in this disclosure.

The gaming device program 706 may include one or more routines to facilitate and control communications and interaction with a game server (e.g., bingo game server 206), as well as a user interface to facilitate communications and interaction with a player.

A gaming device 700 according to the present invention may also include an input device 722, a card reader device 724, a display screen 726, a payout dispenser 728, and, in some embodiments, a random number generator (not shown). In one embodiment, the input device 722 may comprise one or more payment devices, such as for example, a physical payment acceptor for accepting physical notes, tokens, tickets (e.g., cashless gaming tickets), coins, and/or bills. In other embodiments, payment devices, such as readers or validators for credit cards, debit cards, and/or credit slips, may be used to accept payments electronically from a player.

In one embodiment, a card reader device 724 may be configured to receive an identification card for a player. In one embodiment, the identification card may comprise a smart card having a programmed microchip, a coded magnetic strip, or coded rewritable magnetic strip, wherein the programmed microchip or magnetic strips are coded with a player's identification, credit totals, and/or other relevant information.

In one embodiment, money may be transferred to a gaming device through electronic funds transfer. When a player funds the gaming device 700, the processor determines the amount of funds entered and displays the corresponding amount on the display screen 726 display screen.

The gaming device 700 may include one or more input devices, such as, for example: (i) a currency acceptor, (ii) a player tracking card reader/writer, (iii) a printer (e.g. for printing receipts), (iv) one or more starting controllers for initiating a primary or secondary game of chance, (v) a keypad, (vi) a mouse, (vii) a security camera, etc.

In addition, the gaming device 700 may include one or more output devices, such as, for example: (i) a display screen, (ii) audio output such as a speaker, (iiii) a payment device (e.g., coin/cash/token dispenser), etc.

Figure 7B:
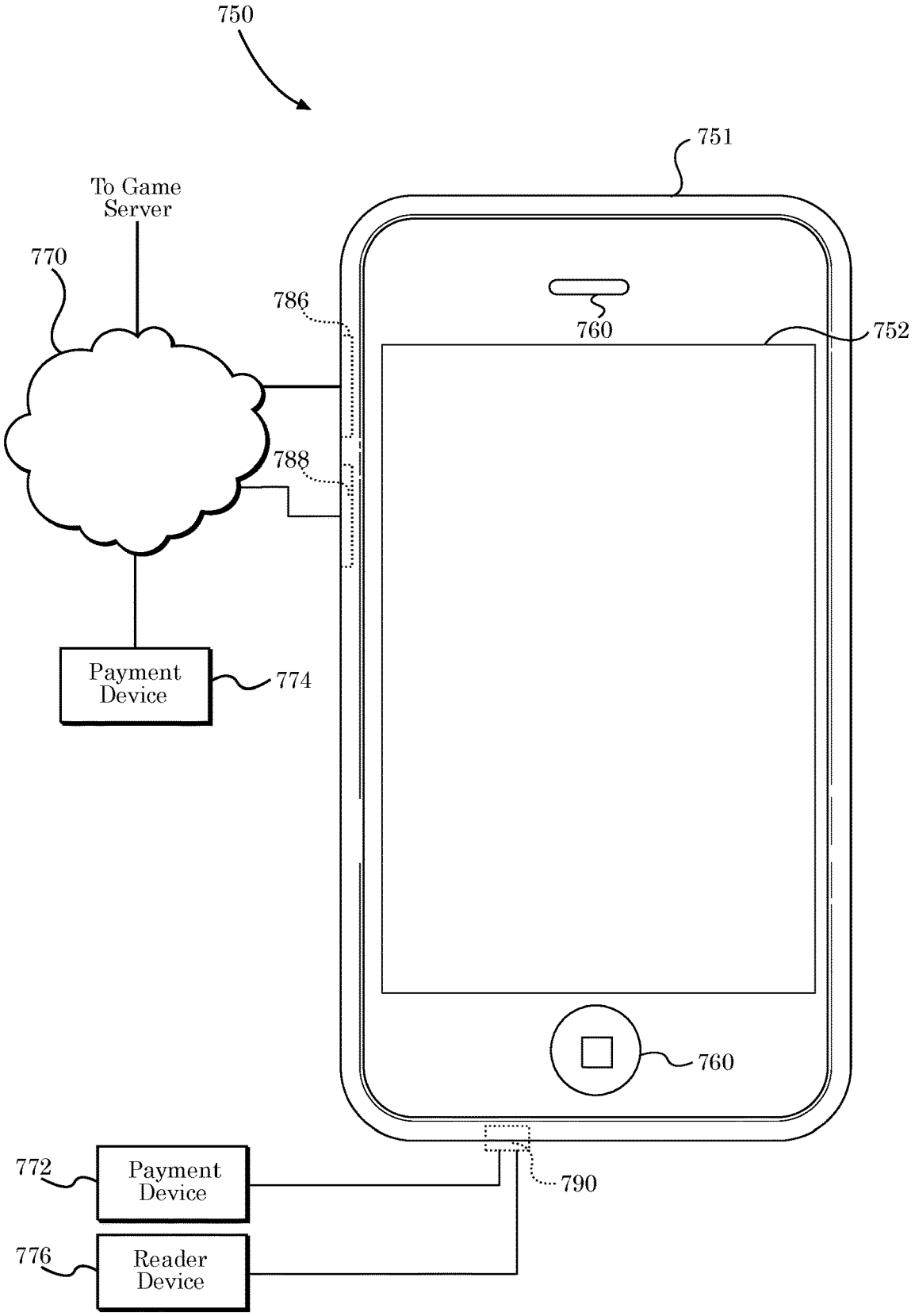
FIG. 7B is a block diagram of a mobile gaming device according to one or more embodiments.

According to some embodiments, a user device (e.g., client device 210) configured for playing one or more bingo games (e.g., via an online gaming system) may comprise a mobile gaming device. Turning to FIG. 7B, a block diagram of an example mobile gaming device 750 according to some embodiments is shown. In some embodiments, the mobile gaming device 750 comprises a display 752. The display 752 may be implemented with liquid crystal display (LCD) technology, light emitting polymer display (LPD) technology, or some other display technology. The display 752 may be a touch-sensitive display that is sensitive to haptic contact and/or tactile contact by a user. Alternately or in addition, other touch-sensitive display technologies may be used, such as, without limitation, a display in which contact is made using a stylus or other pointing device.

In some embodiments, the mobile gaming device 750 may be adapted to display one or more graphical user interfaces on a display (e.g., display 752) for providing the user access to various system objects and/or for conveying information to the user. In some embodiments, the graphical user interface may include one or more display objects, such as icons or other graphic representations of respective system objects. Some examples of system objects include, without limitation, device functions, applications, windows, files, alerts, events, or other identifiable system objects.

In some embodiments, the mobile gaming device 750 can implement multiple device functionalities, such as a telephony device, an e-mail device, a network data communication device, a Wi-Fi base station device, and a media processing device. In some embodiments, particular display objects can be displayed in a menu bar. In some embodiments, device functionalities can be accessed from a top-level graphical user interface. Touching one of the display objects can, for example, invoke corresponding functionality. For example, touching a display object for an email application would invoke the email application on the mobile gaming device 750 for sending email messages.

In some embodiments, the top-level graphical user interface environment or state can be restored by pressing a button 760 of the mobile gaming device 750.

In some embodiments, the mobile gaming device 750 can include one or more input/output (I/O) devices and/or sensor devices. For example, a speaker and/or a microphone can be included to facilitate voice-enabled functionalities, such as phone, voicemail, or recorded audio functions. In some embodiments, an up/down button for volume control of the speaker and/or the microphone can be included. In some embodiments, a loud speaker can be included to facilitate hands-free voice functionalities, such as speaker phone functions. An audio jack can also be included for use of headphones and/or a microphone.

In some embodiments, the mobile gaming device 750 may include circuitry and sensors for supporting a location determining capability, such as that provided by the global positioning system (GPS) or other positioning systems (e.g., systems using Wi-Fi access points, television signals, cellular grids, Uniform Resource Locators (URLs)). In some embodiments, a positioning system (e.g., a GPS receiver) can be integrated into the mobile gaming device 750 (e.g., embodied as a mobile type of user device, such as a tablet computer or smartphone) or provided as a separate device that can be coupled to the mobile gaming device 750 through an interface to provide access to location-based services.

In some embodiments, a port device 790, e.g., a Universal Serial Bus (USB) port, or a docking port, or some other wired port connection, can be included. The port device 790 can, for example, be utilized to establish a wired connection to other computing devices, such as other communication devices 300, network access devices, a personal computer, a printer, a display screen, or other processing devices capable of receiving and/or transmitting data. In some embodiments, the port device 390 allows the mobile gaming device 750 to synchronize with a host device using one or more protocols, such as, for example, the TCP/IP, HTTP, UDP and any other known protocol.

The mobile gaming device 750 can also include one or more wireless communication subsystems, such as an 802.11b/g communication device 786, and/or a Bluetooth™ communication device 788. Other communication protocols can also be supported, including other 802.x communication protocols (e.g., WiMax, Wi-Fi, 4G), code division multiple access (CDMA), global system for mobile communications (GSM), Enhanced Data GSM Environment (EDGE), etc.

In some embodiments, the mobile gaming device 750 may be in communication with one or more payment devices 772, 774 and/or reader devices 776, using a communication network 770, via one or more of a wireless communication device 786, Bluetooth™ communication device 788, and/or port device 790. In some embodiments, the mobile gaming device may in communication with an online gaming server (e.g., bingo game server 206) using the communication network 770. Some examples of payment devices and reader devices are described above with respect to FIG.

In some embodiments, the mobile gaming device 750 comprises a housing 751, a supporting structure that supports one or more of the example components 752, 760, 786, 788, and/or 788 of the mobile gaming device 750.

Figure 7C:
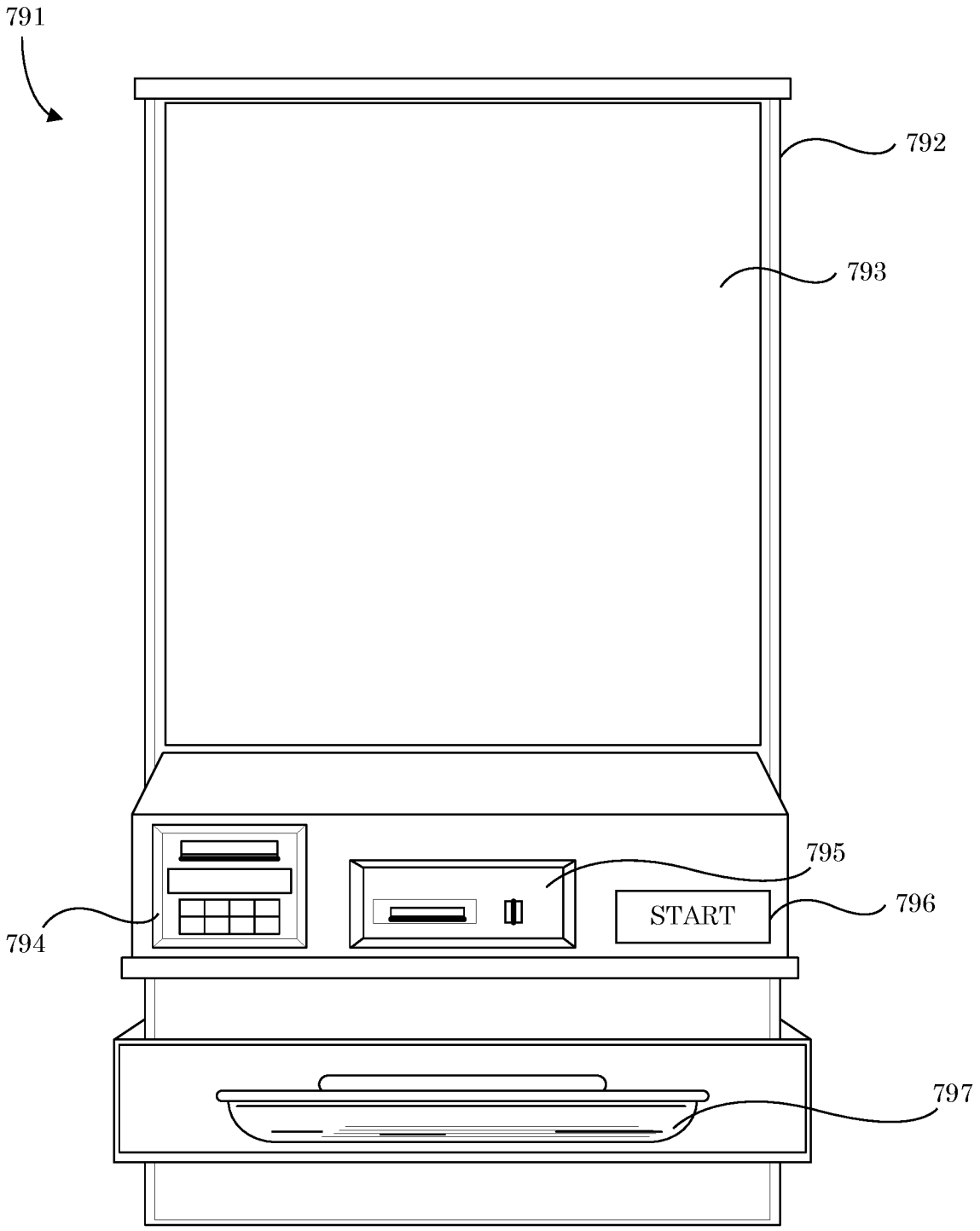
FIG. 7C is a block diagram of a gaming device according to one or more embodiments.

Turning to FIG. 7C, an illustration of an additional example of the exterior of a gaming device 791 is provided. Example gaming device 791 has a support structure, housing, or cabinet 792 providing support for a plurality of displays, inputs, controls, and other features of the gaming machine (e.g., a stand-alone, dedicated gaming machine). In one example, the gaming device 791 may be configured so that a player can use the machine while standing or sitting. In another example, the gaming device 791 may be configured as a table-top game that a player can operate preferably while sitting.

According to some embodiments, the gaming device 791 may comprise one or more display devices 793, card reader devices 794 (e.g., for receiving a card identifying a player), payment devices 795 (e.g., for receiving physical payment items such as gaming tickets, vouchers, coins, bills, etc.; for receiving electronic payments, such as for credit cards or debit cards; for receiving financial account identifier information), input devices 796 (e.g., a start button), and/or payment dispenser devices 797 (e.g., for providing physical payments such as currency and/or gaming tickets to a player in response to a player win).

In one or more embodiments, the gaming device 791 may comprise one or more processors and/or data storage devices within the cabinet 792 of the gaming device 791. As described with respect to the gaming device 700, the data storage device may store program code and instructions, executable by the processor, to control the gaming device in accordance with embodiments described in this disclosure for providing for play of a bingo game having multiple draw sequences or temporary daub features.

B. Methods

According to some embodiments, processes described in this disclosure may be performed and/or implemented by and/or otherwise associated with one or more specialized and computerized processing devices (e.g., the devices 130, 140, 302*a-n*, 402*a-b*, 502, 602, and/or the servers and/or controller devices 102, 108, 110, 114, 118, 124, 310*a-n*, 410*a-g*, 510*e-f*, 610*a-j* of FIG. 1, FIG. 3, FIG. 4, FIG. 5, and/or FIG. 6 in this disclosure), specialized computers, computer terminals, computer servers, computer systems and/or networks, and/or any combinations thereof (e.g., by one or more online game providers and/or online gaming player processing devices). In some embodiments, methods may be embodied in, facilitated by, and/or otherwise associated with various specialized input mechanisms and/or interfaces described in this disclosure. According to some other embodiments, some processes described in this disclosure may be performed and/or implemented by and/or otherwise associated with one or more general computing devices (e.g., as described with respect to FIG. 14 and FIG. 15 in this disclosure), servers, systems, and/or networks.

Any processes described in this disclosure do not necessarily imply a fixed order to any depicted actions, steps, and/or procedures, and embodiments may generally be performed in any order that is practicable unless otherwise and specifically noted. Any of the processes and/or methods described in this disclosure may be performed and/or facilitated by hardware, software (including microcode), firmware, or any combination thereof. For example, a storage medium (e.g., a hard disk, Universal Serial Bus (USB) mass storage device, and/or Digital Video Disk (DVD)) may store thereon instructions that when executed by a machine (such as a computerized processing device) result in performance according to any one or more of the embodiments described in this disclosure.

Figure 8:
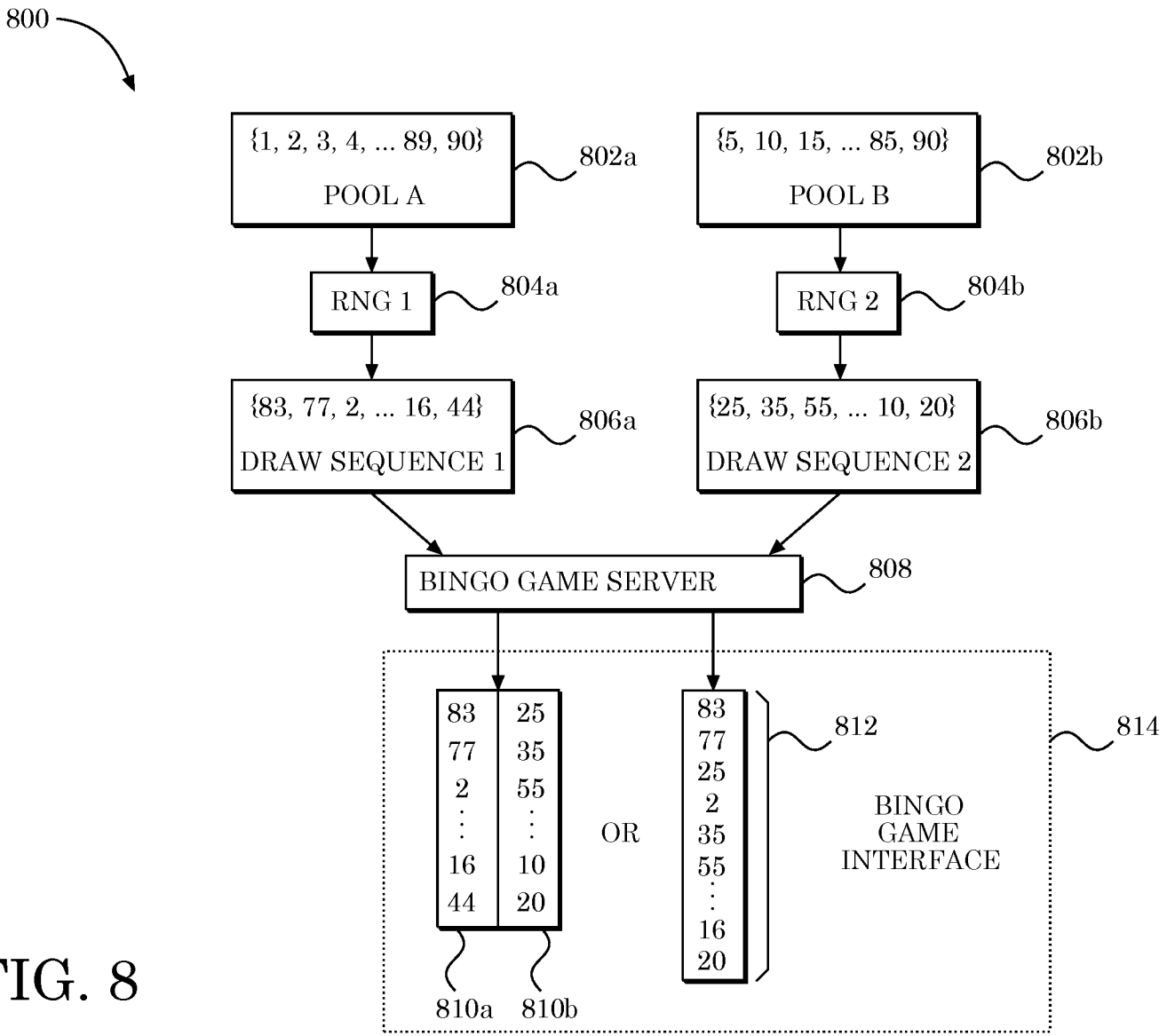
FIG. 8 is a block diagram of a bingo game system with multiple draw sequences, according to one or more embodiments.

Referring now to FIG. 8, a flow diagram of a method 800 according to some embodiments is shown. The method 800 may be performed, for example, by a gaming platform or web server providing online bingo games. It should be noted that although some of the steps of method 800 may be described as being performed by a server computer while other steps are described as being performed by another computing device, any and all of the steps may be performed by a single computing device which may be a mobile device, desktop computer, or another computing device. Further, any steps described in this disclosure as being performed by a particular computing device may, in some embodiments, be performed by another computing device as appropriate.

According to some embodiments, the method 800 may comprise determining a first pool of bingo symbols for a bingo game session (e.g., the set of numbers from 1-90), at 802*a*, and utilizing a first RNG, at 804*a*, to determine a first symbol draw sequence, at 806*a*. As indicated in the example, the symbol draw sequence may comprise a random sequence of the first pool of bingo symbols, generated by the first RNG. The method 800 may comprise determining a second pool of bingo symbols for the bingo game session (e.g., the numbers "5," "10," "15," . . . "85," "90"), at 802*b*, and utilizing a first RNG, at 804*b*, to determine a second symbol draw sequence, at 806*b*. As indicated in the example, the second symbol draw sequence may comprise a random sequence of the second pool of bingo symbols, generated by the second RNG.

In accordance with some embodiments, the respective pools of bingo symbols may comprise at least one symbol in common. In other embodiments, the pools may not share any symbols in common. In still other embodiments, at least two pools may comprise identical sets of symbols. As in the example depicted in FIG. 8, one pool may be a subset of another pool (e.g., "POOL B" is a subset comprising every fifth number that is in the set of "POOL A"). It will be readily understood, however, that any number and type of symbols may be included in respective pools of bingo symbols, as deemed desired for a particular implementation.

In some embodiments, the method 800 may comprise the first symbol draw sequence (906*a*) and the second symbol draw sequence (906*b*) being received and/or processed by a bingo game controller, at 808. In one example, the first RNG and/or the second RNG may be controlled by the bingo game controller, which may direct the first RNG and/or the second RNG to generate the first and second symbol draw sequences. In some embodiments, the bingo game controller may process the first and the second symbol draw sequences to provide for two respective, individual draw sequences (810*a*, 810*b*). Each of the individual draw sequences may be embodied in a separate data store or in the same database, file, or other type of data store. Game play relying on individual symbol draw sequences may comprise alternating calls from each symbol draw sequence, determining at random which symbol draw sequence to draw from next, and/or selecting which symbol draw sequence to draw from next in accordance with a formula or pattern (e.g., three symbols from the first draw sequence, then two symbols from the second draw sequence).

Alternatively, the bingo game controller may combine the first and the second symbol draw sequences to generate a combined symbol draw sequence 812 comprising game symbols. For example, combining may comprise alternating draws from each symbol draw sequence, combining the sequences at random; and/or combining the draw sequences according to a formula or pattern (e.g., three symbols from the first draw sequence, then two symbols from the second draw sequence). During game play utilizing a combined symbol draw sequence 812, game symbols may be called, for example, sequentially from the combined symbol draw sequence.

In some embodiments, the method 800 may comprise presenting one or more of the bingo symbols of the first and second symbol draw sequences via bingo game interface 814 (e.g., as browser-based bingo game served over the Internet).

Figure 9:
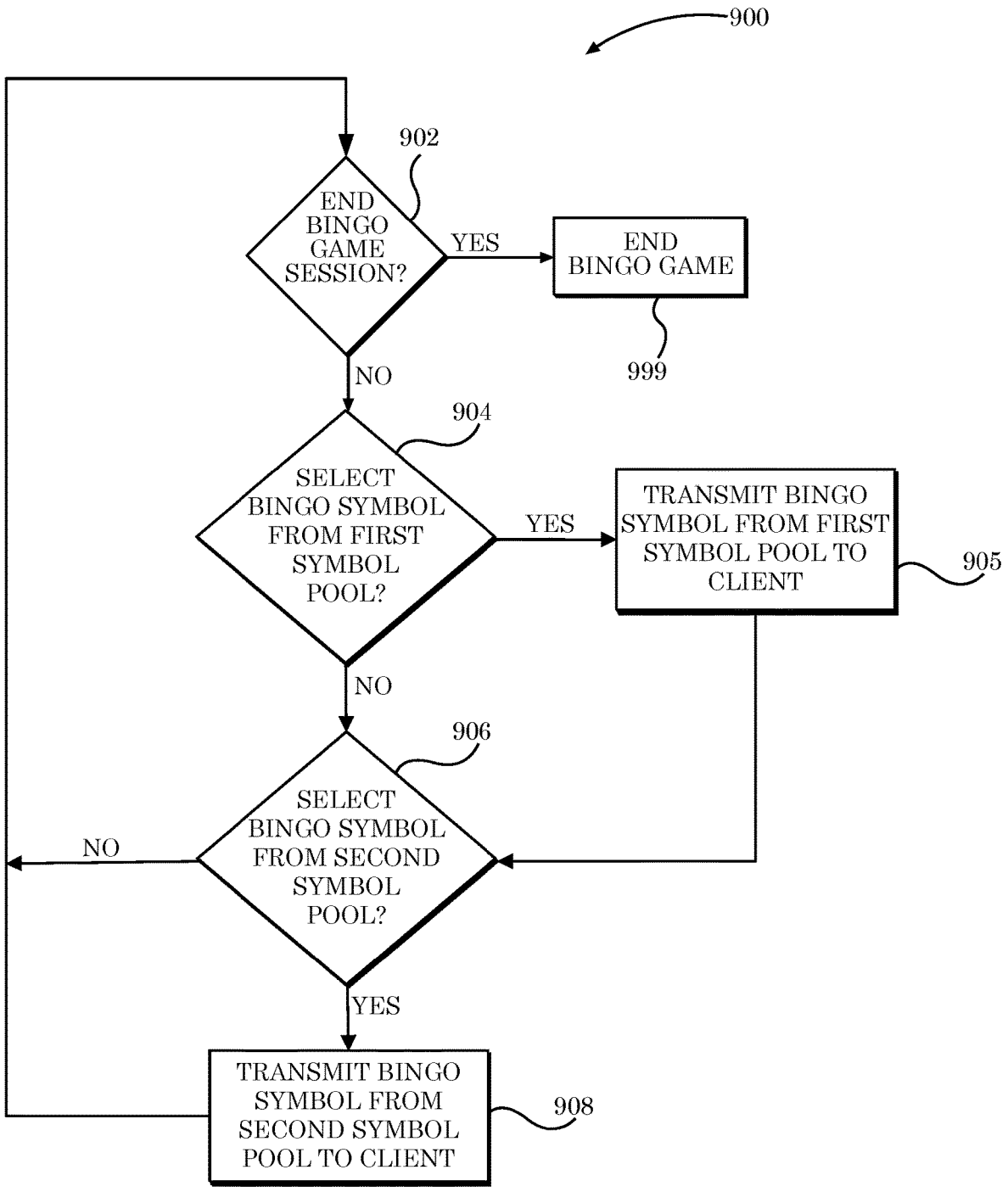
FIG. 9 is a flowchart of a method according to one or more embodiments.

Referring now to FIG. 9, a flow diagram of a method 900 according to some embodiments is shown. The method 900 may be performed, for example, by a bingo game server (e.g., a bingo game server of bingo game server cluster 110).

According to some embodiments, the method 900 may comprise determining whether to end a bingo game session, at 902. In some embodiments, a bingo game server may determine whether a bingo game termination condition has been met. In one example, a bingo game termination condition may comprise a predetermined win condition (e.g., a player achieving a full house bingo pattern) in a bingo game session. In another example, a termination condition may comprise a predetermined number of called bingo game symbols, a predetermined number of winners, a number of players remaining in the bingo game session, or any other predetermined condition deemed desirable for determining whether a bingo game session should end.

According to some embodiments, if the bingo game session is to end, the method 900 may comprise ending the bingo game, at 999. Otherwise, if the bingo game session is to continue (e.g., a termination condition for the bingo game session has not yet been met), the method 900 may comprise determining whether to select a bingo symbol from a first symbol pool, at 904. If so, the method 900 may further comprise transmitting the first bingo symbol from the first symbol pool to a client (e.g., a client device 210).

After transmitting the bingo symbol (905), or if no bingo symbol is to be selected from the first symbol pool (904), the method 900 may further comprise determining whether to select a bingo symbol from a second symbol pool, at 906. If so, the method 900 may further comprise transmitting the bingo symbol from the second symbol pool to the client, at 908. If not, or after transmitting the bingo symbol from the second symbol pool to the client (908), the method 900 may optionally iterate again to determine whether the bingo game session has ended, at 902, and so on.

Figure 10:
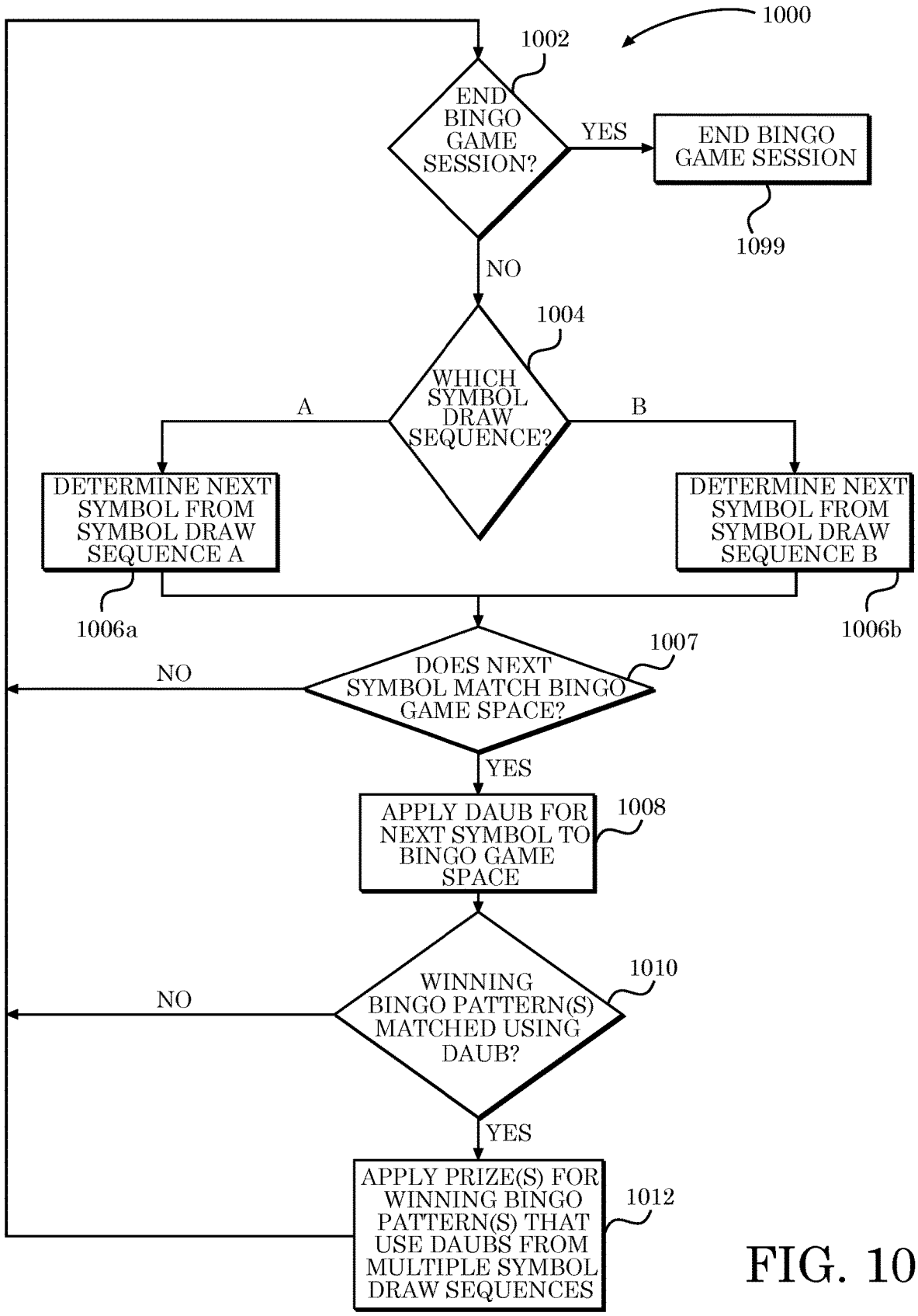
FIG. 10 is a flowchart of a method according to one or more embodiments.

Referring now to FIG. 10, a flow diagram of a method 1000 according to some embodiments is shown. The method 1000 may be performed, for example, by a bingo game server (e.g., a bingo game server of bingo game server cluster 110).

According to some embodiments, the method 1000 may comprise determining whether to end a bingo game session, at 1002 (some examples are described above with respect to FIG. 9). According to some embodiments, if the bingo game session is to end, the method 1000 may comprise ending the bingo game, at 1099.

Otherwise, if the bingo game session is to continue (e.g., a termination condition for the bingo game session has not yet been met), the method 1000 may comprise determining from which of multiple symbol draw sequences to draw a bingo symbol, at 1004. According to this example method, the choice is between an example symbol draw sequence A and an example symbol draw sequence B (but it will be understood that any number of draw sequences may be used, as desired, in accordance with various embodiments). If symbol draw sequence A is selected, the next symbol is determined from symbol draw sequence A, at 1006*a*; otherwise, the next symbol is determined from symbol draw sequence B, at 1006*b*.

The method 1000 may further comprise determining whether the next drawn symbol (from 1006*a* or 1006*b*) matches a bingo game space, at 1007. If it does, a daub may be applied to a bingo game space for the next symbol, at 1008. The method 1000 may further comprise determining whether one or more winning patterns are matched using the applied daub, at 1010. If so, one or more prizes may be applied for the one or more winning bingo patterns that use daubs from multiple symbol draw sequences, at 1012.

If there is no match (1007), or no winning bingo pattern(s) are matched (1010), or after applying the prize(s) (1012), the method 1000 may optionally iterate again to determine whether the bingo game session has ended, at 1002, and so on.

Figure 11:
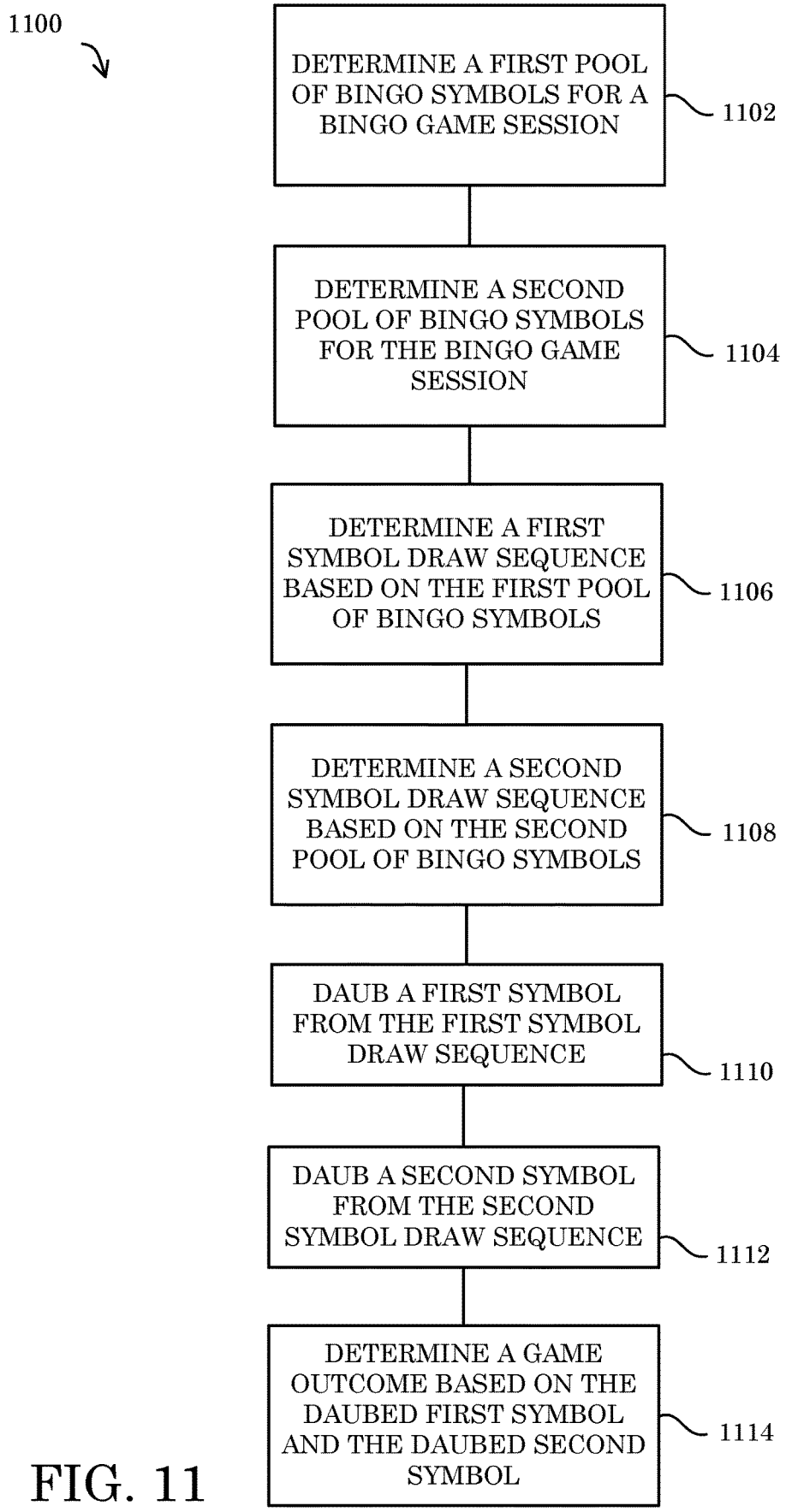
FIG. 11 is a flowchart of a method according to one or more embodiments.

Referring now to FIG. 11, a flow diagram of a method 1100 according to some embodiments is shown. The method 1100 may be performed, for example, by a gaming platform or web server providing online bingo games. It should be noted that although some of the steps of method 1100 may be described as being performed by a server computer while other steps are described as being performed by another computing device, any and all of the steps may be performed by a single computing device which may be a mobile device, desktop computer, or another computing device. Further, any steps described in this disclosure as being performed by a particular computing device may, in some embodiments, be performed by another computing device as appropriate.

According to some embodiments, the method 1100 may comprise determining a first pool of bingo symbols for a bingo game session, at 1102, and determining a second pool of bingo symbols for the bingo game session, at 1104. As described with respect to various embodiments in this disclosure, determining a pool of bingo symbols for a bingo game session may comprise determining the number of symbols to include in the pool, determining a number of symbols in common with another pool, and/or determining a number of symbols not in common with another pool. In one embodiment, the first and second pools may be identical (e.g., both pools include the bingo balls 1 to 90). Determining the respective pools may comprise establishing (e.g., by a user of or acting on behalf of a game provider) the content of each pool, such as by configuring or revising a bingo game application to include pools with specific, predetermined sets of numbers or other bingo symbols.

According to some embodiments, the method 1100 may comprise determining a first symbol draw sequence based on the first pool of bingo symbols, at 1106, and determining a second symbol draw sequence based on the second pool of bingo symbols, at 1108. As described with respect to various embodiments in this disclosure, determining a draw sequence for a bingo game session may comprise using an RNG to determine, randomly, the sequence in which symbols will be called in the bingo game.

According to some embodiments, the method 1100 may comprise daubing a first symbol from the first symbol draw sequence, at 1110, and daubing a second symbol from the second symbol draw sequence, at 1112. As described in this disclosure, each draw sequence may be associated with a respective visual representation used in daubing, such as a particular color or daub symbol, in order to distinguish daubs from different pools. The method 1100 may further comprise calling the first and/or second symbol (e.g., indicating via a user interface that the next symbol in the draw sequence is called and can be daubed). Daubing, as described in this disclosure, may be performed automatically by the bingo game and/or manually by a player.

As discussed with respect to various embodiments, the first daubed symbol may be the same as or different from the second daubed symbol. For example, both the first and the second symbol may be a "5." In such a case, daubing the first symbol and second symbol may comprising double daubing the matching "5" symbol space on a bingo ticket.

According to some embodiments, the method 1100 may comprise determining a game outcome based on the daubed first symbol and the daubed second symbol, at 1114. Various types of outcomes and interactions based on two or more daubed symbols from at least two symbol pools are described in this disclosure. In one example, a double daub (of the same matching symbol space) may result in an additional prize. In another example, a subsequent daub may result in undaubing an initial daub of the same matching symbol. In yet another example, a first daubed symbol and a second daubed symbol may contribute to a winning bingo pattern. In another example, daubing the first symbol (e.g., from a first pool tier) may provide access to the second symbol draw sequence (e.g., from a second pool tier). Other examples are described in this disclosure.

Figure 12:
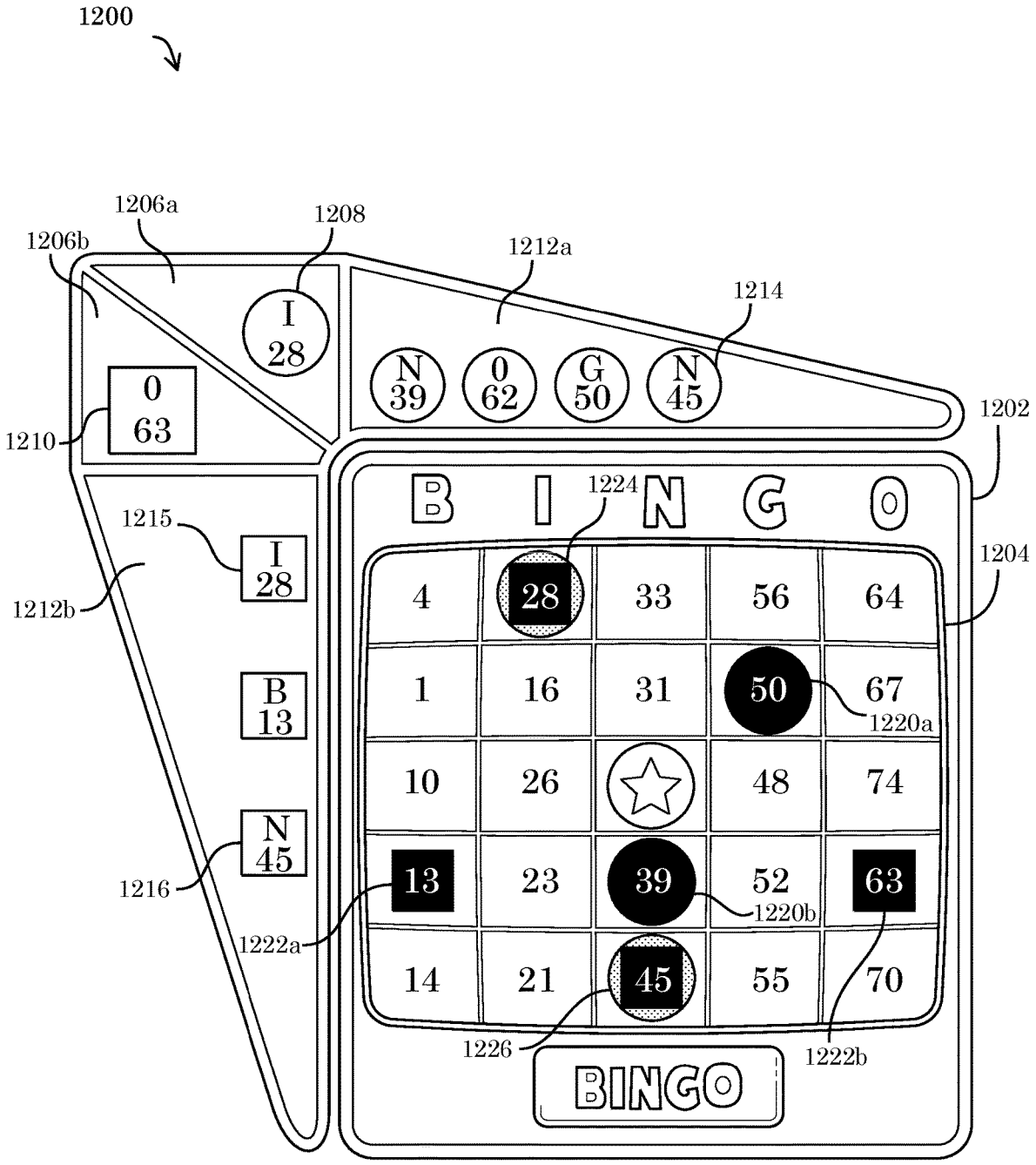
FIG. 12 depicts an example interface according to one or more embodiments.

Some examples of play of an example bingo game provided by a bingo game system that includes multiple bingo symbol draw sequences are depicted in the example interface 1200 of FIG. 12. FIG. 12 illustrates the example interface 1200 presenting a current state of play of a bingo game, in which multiple bingo balls have been called. The example interface 1200, as depicted in FIG. 12, includes a bingo card area 1202. The example bingo card area 1202 includes at least one bingo card 1204 comprising a plurality of bingo spaces for playing a bingo game. Each of the bingo spaces of the example 5×5 array of bingo card 1204 (other than the example center "free" bingo space) is associated with an indicated bingo number.

In the example bingo card 1204, according to some embodiments, bingo spaces daubed based on a bingo symbol drawn from a first bingo symbol draw sequence are daubed with circular daubs (e.g., 1220*a*, 1220*b*), and bingo spaces daubed based on a bingo symbol drawn from a second bingo symbol draw sequence are daubed with square daubs (e.g., 1222*a*, 1222*b*).

According to the example of game play depicted in example interface 1200, bingo spaces have been daubed (e.g., by a player or automatically) with circular daubs 1220*a* and 1220*b* because the number at the respective bingo space matches a previously-called ball (previously-called ball "G50" and previously-called ball "N39", respectively) from the first bingo symbol draw sequence. Bingo spaces have been daubed (e.g., by a player or automatically) with square daubs 1222*a* and 1222*b* because the number at the respective bingo space matches a previously-called ball (previously-called ball "B13" and previously-called ball "063", respectively) from the second bingo symbol draw sequence.

Bingo card area 1202 also includes a plurality of location identifiers ("B", "I", "N", "G", "O"), each associated with a respective column of the bingo card 1204. A bingo button may be configured, for example, to allow a player to indicate that the player has earned a "Bingo" in the bingo game (e.g., by meeting a predetermined winning bingo pattern).

In addition to the represented bingo card area 1202, the example interface 1200 also displays ball call areas 1206*a* and 1206*b* and called ball history areas 1212*a* and 1212*b*.

As depicted in the example interface 1200 in FIG. 12, each of two ball call areas 1206*a* and 1206*b* is associated with a respective bingo symbol draw sequence from which balls are called and then represented in the ball call area. As depicted in the example interface 1200, a called ball 1208 ("128," represented in ball call area 1206*a*) has been called from a first bingo symbol draw sequence. The representation of the called ball 1208 includes an indication of a location identifier ("I") and bingo ball number ("28").

In one embodiment, the appearance of the called ball 1208 in ball call area 1206*a* means that the interface 1200 may now be enabled to allow a player to daub a bingo space that matches the bingo ball number (e.g., using a pointer device or other type of input device to a bingo game interface). As discussed in this disclosure, the daubing of a particular space (whether a persistent or temporary daub) may be performed by a player (e.g., using a touch screen or other input device) and/or automatically by a bingo game server.

As depicted in the example interface 1200, in some embodiments previously-called balls (e.g., previously-called balls 1214, 1215, and 1216) may be represented in the called ball history area 1212*a* or 1212*b* (e.g., depending on which sequence the balls were called from).

In some embodiments, a single called ball history area may be used. In some embodiments, a player may be allowed to mark any balls represented in a ball call area or a called ball history area. In one embodiment, previously-called balls may be removed from called ball history area after a period of time and/or after a predetermined number of balls have been called.

According to the example game play, a double daub 1224 corresponds to the calling of "128" separately from the two bingo symbol draw sequences. "128" was previously called from the second bingo symbol draw sequence, as indicated in called ball history area 1212*b* at 1215, and was daubed with the corresponding square daub. Now, as depicted in the example interface 1200, "128" has been called again, as represented by called ball 1208 in ball call area 1206*a*, and the double daub 1224 at the corresponding bingo space matching "128" is represented by both a square daub and a circular daub.

Similarly, the double daub 1226 indicates that the bingo ball "N45" has been called twice, once from each draw sequence, as indicated in the called ball history area 1212*a* at 1214 and in the called ball history area 1212*b* at 1216, and the corresponding, matching bingo space has been daubed twice to generate the double daub 1226.

Although differently-shaped daubs are used in these examples to distinguish the source of the called ball that resulted in the daub, it is not necessary to use different types of daubs in all embodiments.

Figure 13A:
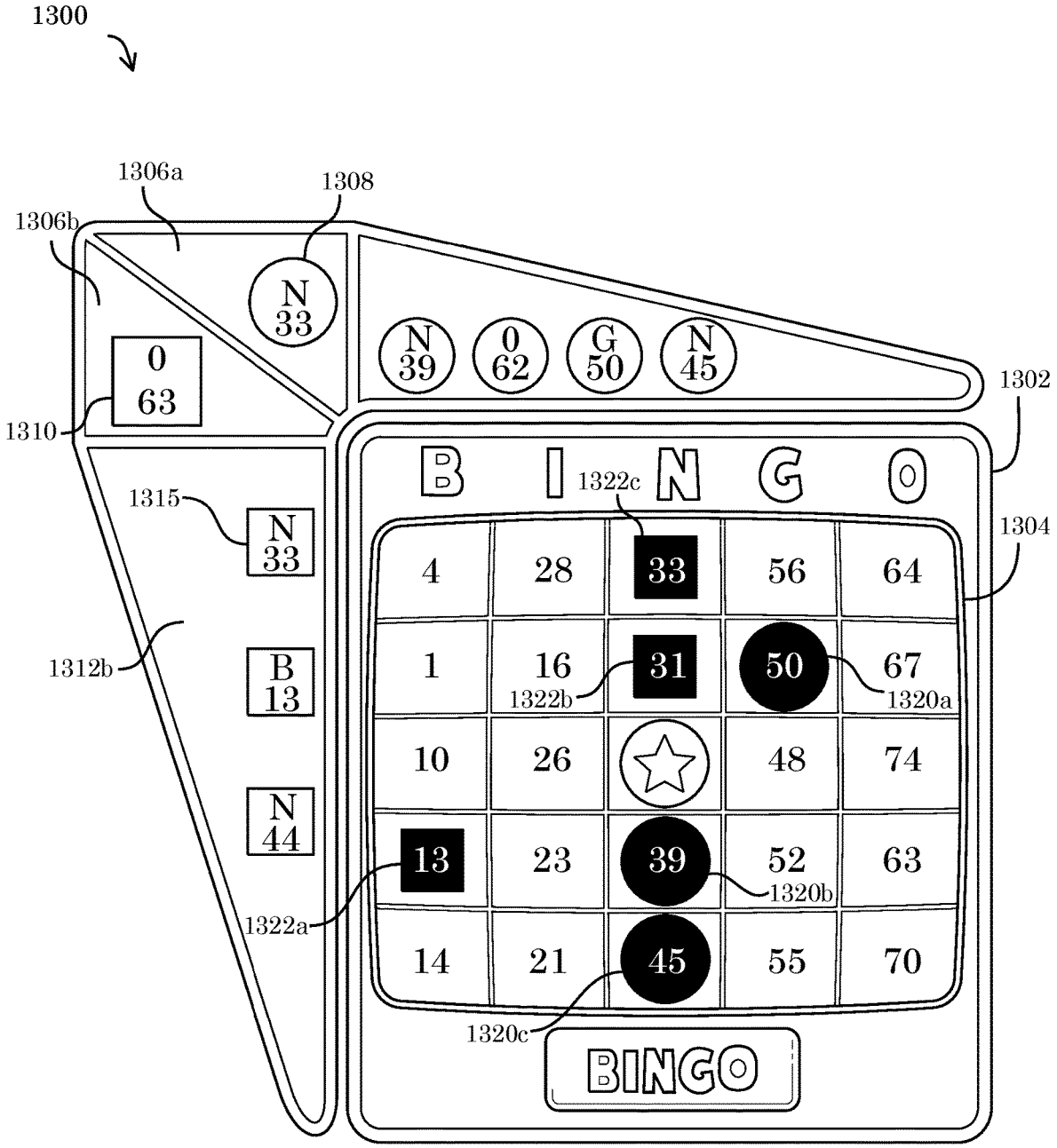
FIG. 13A and FIG. 13B depict an example interface according to one or more embodiments.

Some examples of play of an example bingo game provided by a bingo game system that includes multiple bingo symbol draw sequences are depicted in the example interface 1300 of FIG. 13A. FIG. 13A illustrates another example interface, similar to example interface 1200, and presenting a current state of play of a bingo game, in which multiple bingo balls have been called.

The example interface 1300, as depicted in FIG. 13A, includes a bingo card area 1302 including at least one bingo card 1304 comprising a plurality of bingo spaces for playing a bingo game. Each of the bingo spaces (other than the example center "free" bingo space) is associated with an indicated bingo number.

In the example bingo card 1304, according to some embodiments, bingo spaces daubed based on a bingo symbol drawn from a first bingo symbol draw sequence are daubed with circular daubs (e.g., 1320*a*, 1320*b*, 1320*c*), and bingo spaces daubed based on a bingo symbol drawn from a second bingo symbol draw sequence are daubed with square daubs (e.g., 1322*a*, 1322*b*, 1322*c*).

As depicted in the example interface 1300 in FIG. 13A, each of two ball call areas 1306*a* and 1306*b* is associated with a respective bingo symbol draw sequence from which balls are called and then represented in the ball call area. As depicted in the example interface 1300, a called ball 1308 ("N33," represented in ball call area 1306*a*) has been called from a first bingo symbol draw sequence, but the corresponding bingo space has not yet daubed. The representation of the called ball 1308 includes an indication of a location identifier ("I") and bingo ball number ("33"). Similarly, a called ball 1310 ("063," represented in ball call area 1306*b*) has been called from a second bingo symbol draw sequence, but the corresponding bingo space has not yet daubed.

According to the example state of game play depicted in example interface 1300, the daubs 1322*c*, 1322*b*, the free center daub, and daubs 1320*b* and 1320*c*, completely fill the "N" column of the bingo card 1304. In some embodiments, this may have already completed a winning bingo pattern, and the player might be able to press a "Bingo" button to request validation of a bingo win.

Alternatively, or in addition, in some embodiments, a winning bingo pattern may require a double daub (or other type of multiple daub), using daubs based on ball calls from more than one draw sequence.

Figure 13B:
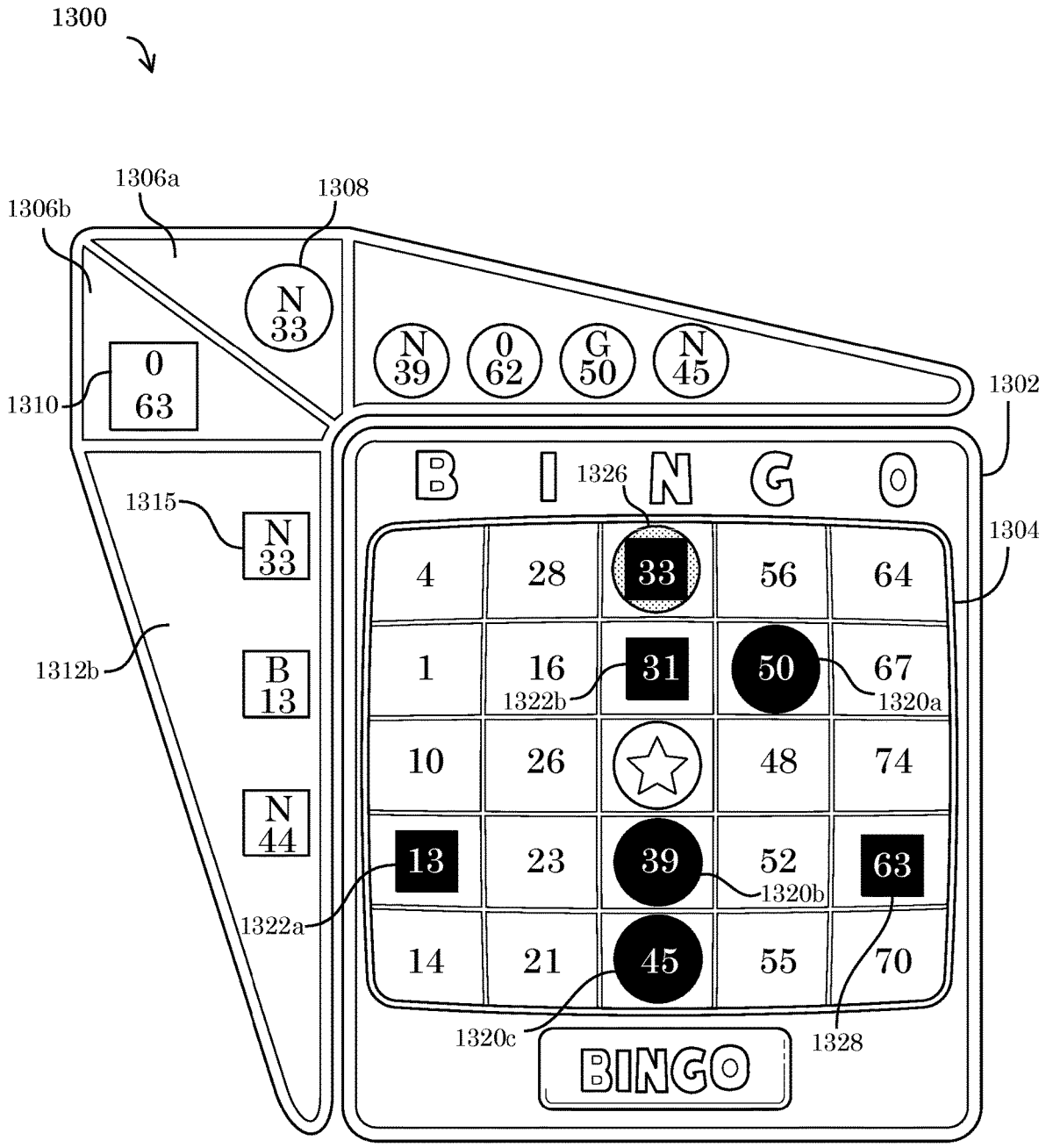

FIG. 13B shows a second example state of the bingo card area 1302 of the example interface 1300, following the state depicted in FIG. 13A, in which the bingo space corresponding to the called bingo ball 1308 ("N33") has been daubed (e.g., by a player or automatically), resulting in a double daub 1326 with representations of both a circular daub and a square daub. As described in this disclosure, the inclusion of double daub 1326 may mean that the daubs in column "N" complete a winning bingo pattern.

The bingo space corresponding to the called bingo ball 1310 ("063") has also been daubed with a square daub 1328, indicating the daub 1328 resulted from a ball drawn from the second bingo symbol draw sequence.

C. Other Example Systems

Figure 14:
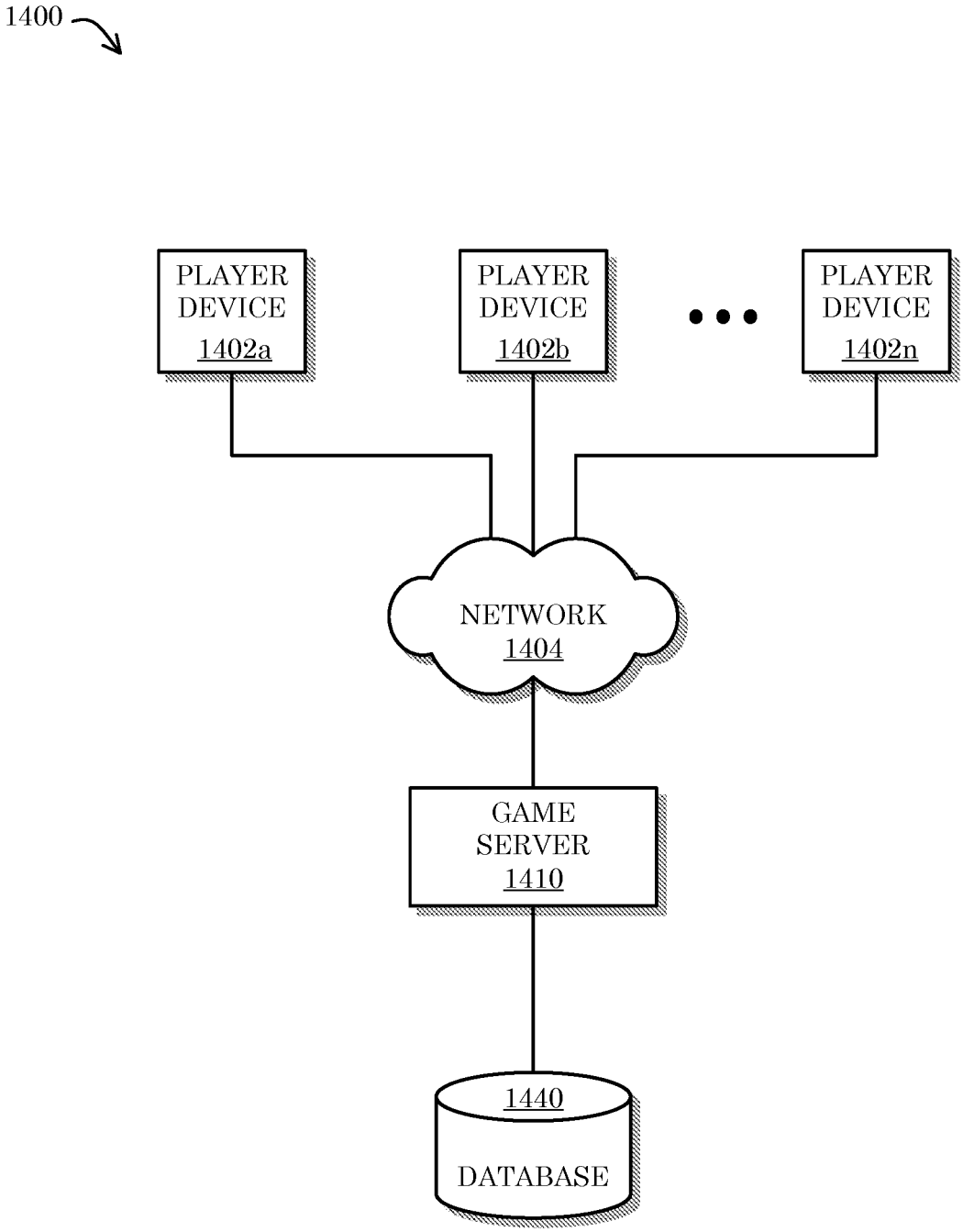
FIG. 14 is a block diagram of a system according to one or more embodiments.

Turning now to FIG. 14, a block diagram of a system 1400 according to some embodiments is shown. In some embodiments, the system 1400 may comprise a general gaming platform such as a gaming platform via which one or more multiplayer and/or online games may be played (e.g., one or more online games). In some embodiments, the system 1400 may comprise a plurality of player devices 1402*a-n* in communication with and/or via a network 1404. In some embodiments, a game server 1410 may be in communication with the network 1404 and/or one or more of the player devices 1402*a-n*. In some embodiments, the game server 1410 (and/or the player devices 1402*a-n*) may be in communication with a database 1440.

In contrast to the specialized, respective bingo game systems of FIG. 1, FIG. 2A, and FIG. 2B, to the specialized game systems of FIG. 3, FIG. 4, and FIG. 5, and to the specialized bingo game systems of FIG. 7A, FIG. 7B, and FIG. 7C, the system 1400 may be embodied using one or more general computing devices executing software (e.g., bingo game software).

The player devices 1402*a-n*, in some embodiments, may comprise any type or configuration of electronic, mobile electronic, and or other network and/or communication devices (or combinations thereof) that are or become known or practicable. A first player device 1402*a* may, for example, comprise one or more PC devices, computer workstations (e.g., game consoles and/or gaming computers), tablet computers, such as an iPad® manufactured by Apple®, Inc. of Cupertino, Calif., and/or cellular and/or wireless telephones such as an iPhone® (also manufactured by Apple®, Inc.) or an Optimus™ S smart phone manufactured by LG® Electronics, Inc. of San Diego, Calif., and running the Android® operating system from Google®, Inc. of Mountain View, Calif. In some embodiments, one or more of the player devices 1402*a-n* may be specifically utilized and/or configured (e.g., via specially-programmed and/or stored instructions such as may define or comprise a software application) to communicate with the game server 1410 (e.g., via the network 1404). In some embodiments, a game server 1410 may be in communication with a variety of different types of player devices 1402*a-n*.

The network 1404 may, according to some embodiments, comprise a LAN, WAN, cellular telephone network, Bluetooth® network, NFC network, and/or RF network with communication links between the player devices 1402*a-n*, the game server 1410, and/or the database 1440. In some embodiments, the network 1404 may comprise direct communications links between any or all of the components 1402*a-n*, 1410, and 1440 of the system 1400. The game server 1410 may, for example, be directly interfaced or connected to the database 1440 via one or more wires, cables, wireless links, and/or other network components, such network components (e.g., communication links) comprising portions of the network 1404. In some embodiments, the network 1404 may comprise one or many other links or network components other than those depicted in FIG. 14. A second player device 1402*b* may, for example, be connected to the game server 1410 via various cell towers, routers, repeaters, ports, switches, and/or other network components that comprise the Internet and/or a cellular telephone (and/or Public Switched Telephone Network (PSTN)) network, and which comprise portions of the network 1404.

While the network 1404 is depicted in FIG. 14 as a single object, the network 1404 may comprise any number, type, and/or configuration of networks as desired for a particular implementation. According to some embodiments, the network 1404 may comprise a conglomeration of different sub-networks and/or network components interconnected, directly or indirectly, by the components 1402*a-n*, 1410, and 1440 of the system 1400. The network 1404 may comprise one or more cellular telephone networks with communication links between the player devices 1402*a-n* and the game server 1410, for example, and/or may comprise the Internet, with communication links between the player devices 1402*a-n* and the database 1440, for example.

According to some embodiments, the game server 1410 may comprise a device (and/or system) owned and/or operated by or on behalf of or for the benefit of a gaming entity (not explicitly shown). The gaming entity may utilize player and/or game information or instructions (e.g., stored by the database 1440), in some embodiments, to host, manage, analyze, design, define, price, conduct, and/or otherwise provide (or cause to be provided) one or more games such as online multiplayer games (e.g., one or more bingo games as described in this disclosure). In some embodiments, the gaming entity (and/or a third-party; not explicitly shown) may provide an interface (not shown in FIG. 14) to and/or via the player devices 1402*a-n*. The interface may be configured, according to some embodiments, to allow and/or facilitate electronic game play by one or more players. In some embodiments, the system 1400 (and/or interface provided by the game server 1410) may present game data (e.g., from the database 1440) in such a manner that allows players to participate in one or more online games (singularly, in/with groups, and/or otherwise). According to some embodiments, the game server 1410 may cause and/or facilitate various functionality and/or features of one or more bingo games, each as described in this disclosure.

In some embodiments, the database 1440 may comprise any type, configuration, and/or quantity of data storage devices that are or become known or practicable. The database 1440 may, for example, comprise an array of optical and/or solid-state hard drives configured to store player and/or game data, and/or various operating instructions, drivers, etc. While the database 1440 is depicted as a stand-alone component of the system 1400 in FIG. 14, the database 1440 may comprise multiple components. In some embodiments, a multi-component database 1440 may be distributed across various devices and/or may comprise remotely dispersed components. Any or all of the player devices 1402*a-n* may comprise the database 1440 or a portion thereof, for example, and/or the game server 1410 may comprise the database 1440 or a portion thereof.

Figure 15:
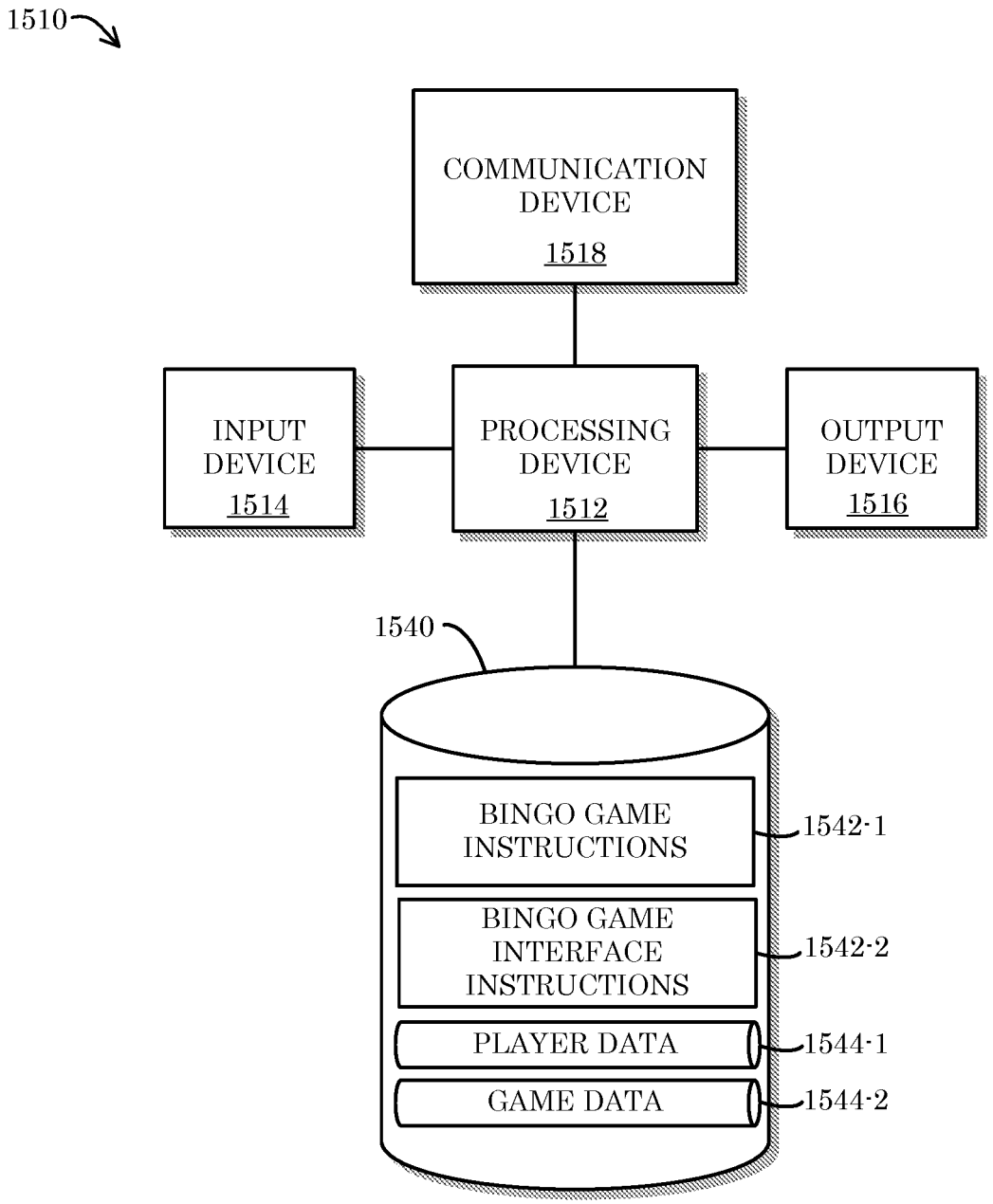
FIG. 15 is a block diagram of an apparatus according to one or more embodiments.

Turning to FIG. 15, a block diagram of an apparatus 1500 according to some embodiments is shown. The apparatus 1500 may, for example, execute, process, facilitate, and/or otherwise be associated with one or more of the methods described in this disclosure. In some embodiments, the apparatus 1500 may comprise a processing device 1512, an input device 1514, an output device 1516, a communication device 1518, and/or a memory device 1540. In some embodiments, the apparatus may comprise a cooling device. According to some embodiments, any or all of the components 1512, 1514, 1516, 1518, 1540 of the apparatus 1500 may be similar in configuration and/or functionality to any similarly named and/or numbered components described in this disclosure. Fewer or more components 1512, 1514, 1516, 1518, 1540 and/or various configurations of the components 1512, 1514, 1516, 1518, 1540 may be included in the apparatus 1500 without deviating from the scope of embodiments described in this disclosure.

According to some embodiments, the processing device 1512 may be or include any type, quantity, and/or configuration of electronic and/or computerized processor. The processing device 1512 may comprise, for example, an Intel® IXP 2800 network processor or an Intel® XEON™ processor coupled with an Intel® E7501 chipset. In some embodiments, the processing device 1512 may comprise multiple inter-connected processors, microprocessors, and/or micro-engines. According to some embodiments, the processing device 1512 (and/or the apparatus 1500 and/or portions thereof) may be supplied power via a power supply (not shown) such as a battery, an Alternating Current (AC) source, a Direct Current (DC) source, an AC/DC adapter, solar cells, and/or an inertial generator. In the case that the apparatus 1500 comprises a server such as a blade server, necessary power may be supplied via a standard AC outlet, power strip, surge protector, a PDU, and/or Uninterruptible Power Supply (UPS) device.

In some embodiments, the input device 1514 and/or the output device 1516 are communicatively coupled to the processing device 1512 (e.g., via wired and/or wireless connections and/or pathways) and they may generally comprise any types or configurations of input and output components and/or devices that are or become known, respectively. The input device 1514 may comprise, for example, a keyboard that allows an operator of the apparatus 1500 to interface with the apparatus 1500 (e.g., by a player, such as to participate in an online game session as described in this disclosure). In some embodiments, the input device 1514 may comprise a sensor configured to provide information such as player relationships to the apparatus 1500 and/or the processing device 1512. The output device 1516 may, according to some embodiments, comprise a display screen and/or other practicable output component and/or device. The output device 1516 may, for example, provide a game interface (not explicitly shown in FIG. 15) to a player (e.g., via a website). According to some embodiments, the input device 1514 and/or the output device 1516 may comprise and/or be embodied in a single device such as a touch-screen monitor.

In some embodiments, the communication device 1518 may comprise any type or configuration of communication device deemed practicable for the desired communication functions. The communication device 1518 may, for example, comprise a network interface card (NIC), a telephonic device, a cellular network device, a router, a hub, a modem, and/or a communications port or cable. In some embodiments, the communication device 1518 may be coupled to provide data to a player device (not shown in FIG. 15), such as in the case that the apparatus 1500 is utilized to provide a game interface to a player as described in this disclosure. The communication device 1518 may, for example, comprise a cellular telephone network transmission device that sends signals indicative of game interface components to customer and/or subscriber handheld, mobile, and/or telephone device. According to some embodiments, the communication device 1518 may also or alternatively be coupled to the processing device 1512. In some embodiments, the communication device 1518 may comprise an IR, RF, Bluetooth™, and/or Wi-Fi® network device coupled to facilitate communications between the processing device 1512 and another device (such as a player device and/or a third-party device).

The memory device 1540 may comprise any appropriate information storage device as deemed practicable for a particular implementation, including, but not limited to, units and/or combinations of magnetic storage devices (e.g., a hard disk drive), optical storage devices, and/or semiconductor memory devices such as RAM devices, Read Only Memory (ROM) devices, Single Data Rate Random Access Memory (SDR-RAM), Double Data Rate Random Access Memory (DDR-RAM), and/or Programmable Read Only Memory (PROM). The memory device 1540 may, according to some embodiments, store one or more of bingo game instructions 1542-1 and/or bingo game interface instructions 1542-2. In some embodiments, the bingo game instructions 1542-1 and/or the bingo game interface instructions 1542-2 may be utilized by the processing device 1512 to provide output information via the output device 1516 and/or the communication device 1518.

According to some embodiments, the bingo game instructions 1542-1 may be operable to cause the processing device 1512 to process player data 1544-1 and/or game data 1544-2. Player data 1544-1 and/or game data 1544-2 received via the input device 1514 and/or the communication device 1518 may, for example, be analyzed, sorted, filtered, decoded, decompressed, ranked, scored, plotted, and/or otherwise processed by the processing device 1512 in accordance with the game instructions 1542-1.

In some embodiments, the bingo game interface instructions 1542-2 may be operable to cause the processing device 1512 to process player data 1544-1 and/or game data 1544-2. Player data 1544-1 and/or game data 1544-2 received via the input device 1514 and/or the communication device 1518 may, for example, be analyzed, sorted, filtered, decoded, decompressed, ranked, scored, plotted, and/or otherwise processed by the processing device 1512 in accordance with the interface instructions 1542-2.

In some embodiments, player data 1544-1 and/or game data 1544-2 may be utilized by the processing device 1512 in accordance with the bingo game interface instructions 1542-2 to provide one or more game interfaces in accordance with embodiments described in this disclosure (e.g., displaying or otherwise transmitting information about one or more called bingo numbers or other types of bingo game symbols and/or winning combinations of bingo symbols).

Any or all of the exemplary instructions and data types described in this disclosure and other practicable types of data may be stored in any number, type, and/or configuration of memory devices as desired for a particular implementation. The memory device 1540 may, for example, comprise one or more data tables or files, databases, table spaces, registers, and/or other storage structures. In some embodiments, multiple databases and/or storage structures (and/or multiple memory devices 1540) may be utilized to store information associated with the apparatus 1500. According to some embodiments, the memory device 1540 may be incorporated into and/or otherwise coupled to the apparatus 1500 (e.g., as shown) or may simply be accessible to the apparatus 1500 (e.g., externally located and/or situated).

In some embodiments, the apparatus 1500 may comprise a cooling device. According to some embodiments, the cooling device may be coupled (physically, thermally, and/or electrically) to the processing device 1512 and/or to the memory device 1540. The cooling device may, for example, comprise a fan, heat sink, heat pipe, radiator, cold plate, and/or other cooling component or device or combinations thereof, configured to remove heat from portions or components of the apparatus 1500.

One or more various types of data storage devices may be utilized to store instructions and/or data for use in accordance with one or more embodiments. In some embodiments, instructions stored on the data storage devices may, when executed by a processing device, cause the implementation of and/or facilitate one or more of various methods, and/or portions or combinations thereof, as described in this disclosure.

According to some embodiments, a data storage device may comprise one or more various types of internal and/or external hard drives. The data storage device may, for example, comprise a data storage medium that is read, interrogated, and/or otherwise communicatively coupled to and/or via a disk-reading device. In some embodiments, the first data storage device and/or the data storage medium may be configured to store information utilizing one or more magnetic, inductive, and/or optical means (e.g., magnetic, inductive, and/or optical-encoding). A data storage medium, for example, may comprise one or more of a polymer layer, a magnetic data storage layer, a non-magnetic layer, a magnetic base layer, a contact layer, and/or a substrate layer. According to some embodiments, a magnetic read head may be coupled and/or disposed to read data from the magnetic data storage layer.

In some embodiments, a data storage medium may comprise a plurality of data points disposed with the data storage medium. The data points may, in some embodiments, be read and/or otherwise interfaced with via a laser-enabled read head disposed and/or coupled to direct a laser beam through the data storage medium.

In some embodiments, a data storage device may comprise a CD, CD-ROM, DVD, Blu-Ray™ Disc, and/or other type of optically-encoded disk and/or other storage medium as desired for a particular implementation. In some embodiments, a data storage device may comprise a USB keyfob, dongle, and/or other type of flash memory data storage device that as deemed practicable for a particular implementation. In some embodiments, a data storage device may comprise RAM of any type, quantity, and/or configuration as deemed practicable for a given implementation. In some embodiments, a data storage device may comprise an off-chip cache such as a Level 2 (L2) cache memory device. According to some embodiments, a data storage device may comprise an on-chip memory device such as a Level 1 (L1) cache memory device.

Any one or more of various types of data storage devices may generally store program instructions, code, and/or modules that, when executed by a processing device, cause a particular machine to function in accordance with one or more embodiments described in this disclosure. Some types of data storage devices may be representative of a class and/or subset of computer-readable media that are defined in this disclosure as "computer-readable memory" (e.g., non-transitory memory devices as opposed to transmission devices or media).

The terms "computer-readable medium" and "computer-readable memory" refer to any medium that participates in providing data (e.g., instructions) that may be read by a computer and/or a processor. Such a medium may take many forms, including but not limited to non-volatile media, volatile media, and other specific types of transmission media. Non-volatile media include, for example, optical or magnetic disks and other persistent memory. Volatile media include DRAM, which typically constitutes the main memory. Other types of transmission media include coaxial cables, copper wire, and fiber optics, including the wires that comprise a system bus coupled to the processor.

Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable medium" and/or "tangible media" specifically exclude signals, waves, and wave forms or other intangible or transitory media that may nevertheless be readable by a computer.

Various forms of computer-readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards, or protocols. For a more exhaustive list of protocols, the term "network" is defined above and includes many exemplary protocols that are also applicable in this disclosure.

In some embodiments, one or more specialized machines such as a computerized processing device, a server, a remote terminal, and/or a customer device may implement one or more of the various practices described in this disclosure. A computer system of a gaming entity may, for example, comprise various specialized computers that interact to provide for online games as described in this disclosure.

Social and/or wagering games of various types of such as online, offline, skill-based, games of chance, and games of mixed skill and chance are a continued source of entertainment to game players, and are often a source of great revenue for gaming companies. Some of the most popular styles of games, and some of the most consistently lucrative for the gaming industry, are bingo games. Accordingly, there is a desire to provide players with increasingly newer, more interesting, engaging, or entertaining bingo games.

Interpretation

Numerous embodiments are described in this patent application, and are presented for illustrative purposes only. The described embodiments are not, and are not intended to be, limiting. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments of the invention nor a listing of features of the invention that must be present in all embodiments. It is contemplated, however, that while some embodiment are not limited by the examples provided in this disclosure, some embodiments may be specifically bounded or limited by provided examples, structures, method steps, and/or sequences. Embodiments having scopes limited by provided examples may also specifically exclude features not explicitly described or contemplated.

Neither the Title (set forth at the beginning of the first page of this patent application) nor the Abstract (set forth at the end of this patent application) is to be taken as limiting in any way the scope of the disclosed invention(s).

The term "product" means any machine, manufacture and/or composition of matter as contemplated by 35 U.S.C. § 101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

A reference to "another embodiment" in describing an embodiment does not imply that the referenced embodiment is mutually exclusive with another embodiment (e.g., an embodiment described before the referenced embodiment), unless expressly specified otherwise. Similarly, any reference to an "alternate," "alternative," and/or "alternate embodiment" is intended to connote one or more possible variations—not mutual exclusivity. In other words, it is expressly contemplated that "alternatives" described in this disclosure may be utilized and/or implemented together, unless they inherently are incapable of being utilized together.

The terms "including," "comprising" and variations thereof mean "including but not limited to," unless expressly specified otherwise.

The terms "a," "an," and "the" mean "one or more," unless expressly specified otherwise.

The term "plurality" means "two or more," unless expressly specified otherwise.

The terms "herein" or "in this disclosure" mean "in the present application, including the specification, its claims and figures, and anything which may be incorporated by reference, unless expressly specified otherwise."

The phrase "at least one of," when such phrase modifies a plurality of things (such as an enumerated list of things) means any combination of one or more of those things, unless expressly specified otherwise. For example, the phrase at least one of a widget, a car and a wheel means (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on," unless expressly specified otherwise. In other words, the phrase "based on" describes both "based only on" and "based at least on." In some embodiments, a first thing being "based on" a second thing refers specifically to the first thing taking into account the second thing in an explicit manner. In such embodiments, for example, a processing step based on the local weather, which itself is in some manner based on or affected by (for example) human activity in the rainforests, is not "based on" such human activities because it is not those activities that being explicitly analyzed, included, taken into account, and/or processed.

The term "whereby" is used in this disclosure only to precede a clause or other set of words that express only the intended result, objective, or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "wherein," as utilized in this disclosure, does not evidence intended use. The term "wherein" expressly refers to one or more features inclusive in a particular embodiment and does not imply or include an optional or conditional limitation.

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

When an ordinal number (such as "first", "second", "third" and so on) is used as an adjective before a term, that ordinal number is used (unless expressly specified otherwise) merely to indicate a particular feature, such as to allow for distinguishing that particular referenced feature from another feature that is described by the same term or by a similar term. For example, a "first widget" may be so named merely to allow for distinguishing it in one or more claims from a "second widget," so as to encompass embodiments in which (1) the "first widget" is or is the same as the "second widget" and (2) the "first widget" is different than or is not identical to the "second widget." Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; (3) does not indicate that either widget ranks above or below any other, as in importance or quality; and (4) does not indicate that the two referenced widgets are not identical or the same widget. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described in this disclosure, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described in this disclosure (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices which are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features is required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described in this disclosure may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this patent application and the title of this patent application are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining and the like.

It will be readily apparent that the various methods and algorithms described in this disclosure may be implemented by, e.g., appropriately and/or specially-programmed general purpose computers and/or computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software A "processor" generally means any one or more microprocessors, CPU devices, computing devices, microcontrollers, digital signal processors, or like devices, as further described in this disclosure. According to some embodiments, a "processor" may primarily comprise and/or be limited to a specific class of processors referred to in this disclosure as "processing devices." "Processing devices" are a subset of processors limited to physical devices such as CPU devices, Printed Circuit Board (PCB) devices, transistors, capacitors, logic gates, etc. "Processing devices", for example, explicitly exclude biological, software-only, and/or biological or software-centric physical devices. While processing devices may include some degree of soft logic and/or programming, for example, such devices must include a predominant degree of physical structure in accordance with 35 U.S.C. § 101.

The term "computer-readable medium" refers to any medium that participates in providing data (e.g., instructions or other information) that may be read by a computer, a processor, or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire, and fiber optics, including the wires that comprise a system bus coupled to the processor. Transmission media may include or convey acoustic waves, light waves, and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave, or any other medium from which a computer can read.

The term "computer-readable memory" may generally refer to a subset and/or class of computer-readable medium that does not include transmission media such as waveforms, carrier waves, electromagnetic emissions, etc. Computer-readable memory may typically include physical media upon which data (e.g., instructions or other information) are stored, such as optical or magnetic disks and other persistent memory, DRAM, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, computer hard drives, backup tapes, Universal Serial Bus (USB) memory devices, and the like.

Various forms of computer readable media may be involved in carrying data, including sequences of instructions, to a processor. For example, sequences of instruction (i) may be delivered from RAM to a processor, (ii) may be carried over a wireless transmission medium, and/or (iii) may be formatted according to numerous formats, standards or protocols, such as Bluetooth™, TDMA, CDMA, 3G.

Where databases are described, it will be understood by one of ordinary skill in the art that (i) alternative database structures to those described may be readily employed, and (ii) other memory structures besides databases may be readily employed. Any illustrations or descriptions of any sample databases presented in this disclosure are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described in this disclosure. Further, despite any depiction of the databases as tables, other formats (including relational databases, object-based models and/or distributed databases) could be used to store and manipulate the data types described in this disclosure. Likewise, object methods or behaviors of a database can be used to implement various processes, such as those described in this disclosure. In addition, the databases may, in a known manner, be stored locally or remotely from a device that accesses data in such a database.

The present invention can be configured to work in a network environment including a computer that is in communication, via a communications network, with one or more devices. The computer may communicate with the devices directly or indirectly, via a wired or wireless medium such as the Internet, LAN, WAN or Ethernet, Token Ring, or via any appropriate communications means or combination of communications means. Each of the devices may comprise computers, such as those based on the Intel® Pentium® or Centrino™ processor, that are adapted to communicate with the computer. Any number and type of machines may be in communication with the computer.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the general inventive concept.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

What is claimed is:

1. An online gaming system for providing an online bingo game to a plurality of remote players, comprising:

a plurality of gaming devices, each gaming device comprising a display device supported by a housing; and a bingo game server, in communication with each of the plurality of gaming devices, the bingo game server comprising a non-transitory memory device storing (i) bingo game instructions and (ii) bingo game interface instructions which, when executed by the bingo game server, result in:

displaying an electronic gaming interface at one or more of the gaming devices of the plurality of gaming devices, the electronic gaming interface comprising:

(a) an interface object for receiving an indication from a player that the player has achieved a winning bingo pattern, (b) a bingo card area for the bingo game, the bingo card area including at least one bingo card comprising a plurality of bingo spaces for playing a bingo game session, and (c) a called bingo game symbol history area for representing previously-called bingo game symbols;

determining, by the bingo game server, a first pool of bingo symbols for the bingo game session;

determining, by the bingo game server, a first symbol draw sequence based on the first pool of bingo symbols;

determining, by the bingo game server, a second pool of bingo symbols for the bingo game session;

determining, by the bingo game server, a second symbol draw sequence based on the second pool of bingo symbols, by removing at least one bingo symbol from the second symbol draw sequence or the second pool of bingo symbols;

daubing a first symbol from the first symbol draw sequence;

daubing a second symbol from the second symbol draw sequence; and determining a game outcome based on the daubed first symbol from the first symbol draw sequence and the daubed second symbol from the second symbol draw sequence by performing at least one of the following actions:

undaubing a player symbol on a bingo ticket, incrementing a count of repeat daubs, providing a bonus prize, incrementing a count of times a player symbol has been daubed, determining whether to terminate game play, combining a digit of the first symbol and a digit of the second symbol, determining a third symbol based on the first symbol and the second symbol, and determining whether a winning bingo pattern is met based on a dedicated portion of a bingo ticket for the first pool of bingo symbols, a dedicated portion of the bingo ticket for the second pool of bingo symbols, or a combination of respective dedicated portions; and determining a game outcome based on the daubed first symbol from the first symbol draw sequence and the daubed second symbol from the second symbol draw sequence.

2. The online gaming system of claim 1, wherein the first pool of bingo symbols is the same as the second pool of bingo symbols.

3. The online gaming system of claim 1, wherein the first pool of bingo symbols is different from the second pool of bingo symbols.

4. The online gaming system of claim 1, wherein the bingo game instructions and bingo game interface instructions, when executed by the bingo game server, further result in:

determining that a player is eligible to receive symbols from the second pool of bingo symbols.

5. The online gaming system of claim 1, wherein the bingo game instructions and bingo game interface instructions, when executed by the bingo game server, further result in:

determining a winning bingo pattern for a player; and providing access to the second symbol draw sequence in response to determining the winning bingo pattern for the player.

6. The online gaming system of claim 1, wherein each of the first pool of bingo symbols and the second pool of bingo symbols is associated with at least one respective prize.

7. A method comprising:

displaying an electronic gaming interface at one or more gaming devices of plurality of gaming devices, the electronic gaming interface comprising:

(a) an interface object for receiving an indication from a player that the player has achieved a winning bingo pattern, (b) a bingo card area for the bingo game, the bingo card area including at least one bingo card comprising a plurality of bingo spaces for playing a bingo game session, and (c) a called bingo game symbol history area for representing previously-called bingo game symbols;

determining, by a bingo game server in communication with each of the one or more gaming devices of the plurality of gaming devices, and the bingo game server comprising a non-transitory memory device storing (i) bingo game instructions and (ii) bingo game interface instructions, a first pool of bingo symbols for a bingo game session;

determining, by the bingo game server, a first symbol draw sequence based on the first pool of bingo symbols;

determining, by the bingo game server, a second pool of bingo symbols for the bingo game session;

determining, by the bingo game server, a second symbol draw sequence based on the second pool of bingo symbols by removing at least one bingo symbol from the second symbol draw sequence or the second pool of bingo symbols;

daubing, via the electronic gaming interface, a first symbol from the first symbol draw sequence;

daubing, via the electronic gaming interface, a second symbol from the second symbol draw sequence; and determining, by the bingo game server, a game outcome based on the daubed first symbol from the first symbol draw sequence and the daubed second symbol from the second symbol draw sequence by performing at least one of the following actions:

undaubing a player symbol on a bingo ticket, incrementing a count of repeat daubs, providing a bonus prize, incrementing a count of times a player symbol has been daubed, determining whether to terminate game play, combining a digit of the first symbol and a digit of the second symbol, determining a third symbol based on the first symbol and the second symbol, and determining whether a winning bingo pattern is met based on a dedicated portion of a bingo ticket for the first pool of bingo symbols, a dedicated portion of the bingo ticket for the second pool of bingo symbols, or a combination of respective dedicated portions; and determining a game outcome based on the daubed first symbol from the first symbol draw sequence and the daubed second symbol from the second symbol draw sequence.

8. The method of claim 7, wherein the first pool of bingo symbols is the same as the second pool of bingo symbols.

9. The method of claim 7, wherein the first pool of bingo symbols is different from the second pool of bingo symbols.

10. The method of claim 7, further comprising:

determining that a player is eligible to receive symbols from the second pool of bingo symbols.

11. The method of claim 7, further comprising:

determining a winning bingo pattern for a player; and providing access to the second symbol draw sequence in response to determining the winning bingo pattern for the player.

12. The method of claim 7, wherein each of the first pool of bingo symbols and the second pool of bingo symbols is associated with at least one respective prize.

* * * * *